US009126323B2

(12) United States Patent
Meili et al.

(10) Patent No.: US 9,126,323 B2
(45) Date of Patent: Sep. 8, 2015

(54) DEVICE FOR TREATING A TARGET SURFACE AND HAVING AN ERGONOMICALLY PIVOTING HANDLE

(75) Inventors: Mark Alan Meili, Montgomery, OH (US); William Michael Cannon, West Harrison, OH (US); Mark John Steinhardt, Cincinnati, OH (US); Jeremy David Jarrett, Cincinnati, OH (US); Daniel James Prenger, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 429 days.

(21) Appl. No.: 13/558,369

(22) Filed: Jul. 26, 2012

(65) Prior Publication Data

US 2013/0047361 A1 Feb. 28, 2013

Related U.S. Application Data

(60) Provisional application No. 61/526,097, filed on Aug. 22, 2011.

(51) Int. Cl.

| | |
|---|---|
| ***A47L 1/06*** | (2006.01) |
| ***B25G 3/08*** | (2006.01) |
| ***B25G 1/10*** | (2006.01) |
| ***B25G 3/38*** | (2006.01) |
| ***A47L 13/12*** | (2006.01) |
| ***A47L 13/17*** | (2006.01) |

(52) U.S. Cl.

CPC ... *B25G 3/08* (2013.01); *A47L 1/06* (2013.01); *A47L 13/12* (2013.01); *A47L 13/17* (2013.01); *B25G 1/102* (2013.01); *B25G 3/38* (2013.01)

(58) Field of Classification Search

CPC ..... A47L 1/06; A47L 13/10; A47L 13/11; A47L 13/12

USPC ..... 15/144.1, 104.93, 104.94, 228, 220.1, 15/244.1; 401/188 R

See application file for complete search history.

(56) References Cited

U.S. PATENT DOCUMENTS

| | | | | |
|---|---|---|---|---|
| 731,338 | A * | 6/1903 | Cattelle | 15/245 |
| 1,477,685 | A | 12/1923 | Bostwick | |
| 2,641,513 | A | 6/1953 | Fryda | |
| 4,200,948 | A | 5/1980 | Nesseth | |
| 4,831,678 | A | 5/1989 | Dietsche | |

(Continued)

FOREIGN PATENT DOCUMENTS

| | | |
|---|---|---|
| BE | 1 017 735 A3 | 5/2009 |
| DE | 20 58 374 A1 | 3/1972 |

(Continued)

OTHER PUBLICATIONS

Search Report, 5 Pages.

(Continued)

*Primary Examiner* — Shay Karls

(74) *Attorney, Agent, or Firm* — Larry L. Huston; Steven W. Miller

(57) ABSTRACT

A device for treating a target, such as cleaning a window. The device has a handle and head, mounted in pivotal relationship to each other. When the head is placed in sliding, contacting relationship with the target surface the handle can pivot relative to the head for the ergonomic convenience of the user.

12 Claims, 61 Drawing Sheets

(56) References Cited

U.S. PATENT DOCUMENTS

| | | | |
|---|---|---|---|
| 5,009,009 | A | 4/1991 | Stinson |
| 5,175,902 | A | 1/1993 | Samuelsson |
| 5,549,167 | A | 8/1996 | Keperling, Sr. et al. |
| 5,666,685 | A | 9/1997 | von Gralman et al. |
| 5,862,562 | A | 1/1999 | Erken |
| 5,888,006 | A | 3/1999 | Ping et al. |
| D409,343 | S | 5/1999 | Hague et al. |
| 6,702,497 | B1 | 3/2004 | Tien |
| 6,842,936 | B2 | 1/2005 | Policicchio et al. |
| 6,872,021 | B1 | 3/2005 | Wilson et al. |
| 7,007,338 | B2 | 3/2006 | Garabedian, Jr. et al. |
| 7,124,474 | B2 | 10/2006 | Nicolay et al. |
| 7,308,729 | B2 | 12/2007 | Seasholtz et al. |
| 7,516,508 | B2 | 4/2009 | Stackpole et al. |
| 7,571,945 | B2 | 8/2009 | Walker et al. |
| D615,260 | S | 5/2010 | Koenig |
| D622,463 | S | 8/2010 | Wolfe, Jr. et al. |
| 2007/0212989 | A1 | 9/2007 | Henke et al. |
| 2008/0265536 | A1 | 10/2008 | Hume |

FOREIGN PATENT DOCUMENTS

| | | | |
|---|---|---|---|
| EP | 0 095 733 | A1 | 12/1983 |
| EP | 1 342 445 | A2 | 9/2003 |
| FR | 1 419 902 | A | 12/1965 |
| GB | 687 164 | A | 2/1953 |

OTHER PUBLICATIONS

U.S. Appl. No. 13/558,370, filed Jul. 26, 2012, Steinhardt, et al.
U.S. Appl. No. 13/558,371, filed Jul. 26, 2012, Steinhardt, et al.
U.S. Appl. No. 13/558,370, filed Jul. 26, 2012, Meili, et al.
U.S. Appl. No. 13/558,371, filed Jul. 26, 2012, Meili, et al.

* cited by examiner

Grip Angle 102°

| Angle of Iteration | Forearm Angle | D1 (cm) | D2 (cm) | D3 (cm) | D4 (cm) | D5 (cm) | D6 (cm) | Applied Moment (N-m) |
|---|---|---|---|---|---|---|---|---|
| 0.0 | -13.5 | 0.42 | 10.21 | 2.62 | 1.92 | 0.42 | 10.83 | 0.37 |
| 5.0 | -8.5 | 0.42 | 10.21 | 2.62 | 1.92 | 1.31 | 10.86 | 0.37 |
| 10.0 | -3.5 | 0.42 | 10.21 | 2.62 | 1.92 | 2.19 | 10.89 | 0.37 |
| 15.0 | 1.5 | 0.42 | 10.21 | 2.62 | 1.92 | 3.06 | 10.91 | 0.36 |
| 20.0 | 6.5 | 0.42 | 10.21 | 2.62 | 1.92 | 3.91 | 10.93 | 0.35 |
| 25.0 | 11.5 | 0.42 | 10.21 | 2.62 | 1.92 | 4.73 | 10.94 | 0.34 |
| 30.0 | 16.5 | 0.42 | 10.21 | 2.62 | 1.92 | 5.52 | 10.95 | 0.32 |
| 35.0 | 21.5 | 0.42 | 10.21 | 2.62 | 1.92 | 6.27 | 10.95 | 0.31 |
| 40.0 | 26.5 | 0.42 | 10.21 | 2.62 | 1.92 | 6.98 | 10.95 | 0.29 |
| 45.0 | 31.5 | 0.42 | 10.21 | 2.62 | 1.92 | 7.64 | 10.94 | 0.26 |
| 50.0 | 36.5 | 0.42 | 10.21 | 2.62 | 1.92 | 8.24 | 10.92 | 0.24 |
| 55.0 | 41.5 | 0.42 | 10.21 | 2.62 | 1.92 | 8.78 | 10.91 | 0.21 |
| 60.0 | 46.5 | 0.42 | 10.21 | 2.62 | 1.92 | 9.26 | 10.88 | 0.19 |
| 65.0 | 51.5 | 0.42 | 10.21 | 2.62 | 1.92 | 9.67 | 10.85 | 0.16 |
| 70.0 | 56.5 | 0.42 | 10.21 | 2.62 | 1.92 | 10.01 | 10.82 | 0.13 |
| 75.0 | 61.5 | 0.42 | 10.21 | 2.62 | 1.92 | 10.28 | 10.78 | 0.10 |
| 80.0 | 66.5 | 0.42 | 10.21 | 2.62 | 1.92 | 10.47 | 10.74 | 0.07 |
| 85.0 | 71.5 | 0.42 | 10.21 | 2.62 | 1.92 | 10.59 | 10.69 | 0.03 |
| 90.0 | 76.5 | 0.42 | 10.21 | 2.62 | 1.92 | 10.63 | 10.64 | 0.00 |

Fig. 1A

Grip Angle 102°

| Device Angle | Forearm Angle | D1 (cm) | D2 (cm) | D3 (cm) | D4 (cm) | D5 (cm) | D6 (cm) | Applied Moment (N-m) |
|---|---|---|---|---|---|---|---|---|
| 0.0 | N/A | 0.90 | N/A | 3.25 | 2.76 | N/A | N/A | 1.01 |
| 5.0 | N/A | 0.90 | N/A | 3.25 | 2.76 | N/A | N/A | 1.01 |
| 10.0 | N/A | 0.90 | N/A | 3.25 | 2.76 | N/A | N/A | 1.00 |
| 15.0 | 18.0 | 0.90 | 8.92 | 3.25 | 2.76 | 2.30 | 10.02 | 0.98 |
| 20.0 | 29.0 | 0.90 | 8.70 | 3.25 | 2.76 | 3.00 | 9.78 | 0.95 |
| 25.0 | 38.0 | 0.90 | 8.38 | 3.25 | 2.76 | 3.54 | 9.42 | 0.92 |
| 30.0 | 48.5 | 0.90 | 7.99 | 3.25 | 2.76 | 4.02 | 9.01 | 0.88 |
| 35.0 | 58.0 | 0.90 | 7.58 | 3.25 | 2.76 | 4.35 | 8.53 | 0.83 |
| 40.0 | 69.0 | 0.90 | 7.10 | 3.25 | 2.76 | 4.55 | 8.00 | 0.78 |
| 45.0 | 78.2 | 0.90 | 6.53 | 3.25 | 2.76 | 4.63 | 7.38 | 0.72 |
| 50.0 | 87.0 | 0.90 | 5.98 | 3.25 | 2.76 | 4.54 | 6.74 | 0.65 |
| 55.0 | 98.0 | 0.90 | 5.28 | 3.25 | 2.76 | 4.33 | 6.01 | 0.58 |
| 60.0 | 108.0 | 0.90 | 4.63 | 3.25 | 2.76 | 4.01 | 5.29 | 0.51 |
| 65.0 | 118.3 | 0.90 | 3.88 | 3.25 | 2.76 | 3.88 | 4.77 | 0.43 |
| 70.0 | 128.8 | 0.90 | 3.17 | 3.25 | 2.76 | 2.97 | 3.71 | 0.35 |
| 75.0 | N/A | 0.90 | N/A | 3.25 | 2.76 | N/A | N/A | 0.26 |
| 80.0 | N/A | 0.90 | N/A | 3.25 | 2.76 | N/A | N/A | 0.18 |
| 85.0 | N/A | 0.90 | N/A | 3.25 | 2.76 | N/A | N/A | 0.09 |
| 90.0 | N/A | 0.90 | N/A | 3.25 | 2.76 | N/A | N/A | 0.00 |

Fig. 14A

Grip Angle 102°

| Angle of Iteration | Forearm Angle | D1 (cm) | D2 (cm) | D3 (cm) | D4 (cm) | D5 (cm) | D6 (cm) | Applied Moment (N-m) |
|---|---|---|---|---|---|---|---|---|
| 0.0 | 46.8 | -0.20 | 11.92 | 2.53 | 1.25 | -0.20 | 11.90 | 0.39 |
| 5.0 | 51.8 | -0.20 | 11.92 | 2.53 | 1.25 | 0.84 | 11.88 | 0.38 |
| 10.0 | 56.8 | -0.20 | 11.92 | 2.53 | 1.25 | 1.87 | 11.87 | 0.38 |
| 15.0 | 61.8 | -0.20 | 11.92 | 2.53 | 1.25 | 2.88 | 11.85 | 0.37 |
| 20.0 | 66.8 | -0.20 | 11.92 | 2.53 | 1.25 | 3.88 | 11.83 | 0.36 |
| 25.0 | 71.8 | -0.20 | 11.92 | 2.53 | 1.25 | 4.84 | 11.82 | 0.35 |
| 30.0 | 76.8 | -0.20 | 11.92 | 2.53 | 1.25 | 5.76 | 11.80 | 0.33 |
| 35.0 | 81.8 | -0.20 | 11.92 | 2.53 | 1.25 | 6.63 | 11.79 | 0.32 |
| 40.0 | 86.8 | -0.20 | 11.92 | 2.53 | 1.25 | 7.46 | 11.78 | 0.30 |
| 45.0 | 91.8 | -0.20 | 11.92 | 2.53 | 1.25 | 8.23 | 11.76 | 0.27 |
| 50.0 | 96.8 | -0.20 | 11.92 | 2.53 | 1.25 | 8.93 | 11.75 | 0.25 |
| 55.0 | 101.8 | -0.20 | 11.92 | 2.53 | 1.25 | 9.56 | 11.74 | 0.22 |
| 60.0 | 106.8 | -0.20 | 11.92 | 2.53 | 1.25 | 10.12 | 11.73 | 0.19 |
| 65.0 | 111.8 | -0.20 | 11.92 | 2.53 | 1.25 | 10.60 | 11.73 | 0.16 |
| 70.0 | 116.8 | -0.20 | 11.92 | 2.53 | 1.25 | 11.00 | 11.72 | 0.13 |
| 75.0 | 121.8 | -0.20 | 11.92 | 2.53 | 1.25 | 11.31 | 11.72 | 0.10 |
| 80.0 | 126.8 | -0.20 | 11.92 | 2.53 | 1.25 | 11.53 | 11.72 | 0.07 |
| 85.0 | 131.8 | -0.20 | 11.92 | 2.53 | 1.25 | 11.67 | 11.71 | 0.03 |
| 90.0 | 136.8 | -0.20 | 11.92 | 2.53 | 1.25 | 11.72 | 11.72 | 0.00 |

Fig. 17A

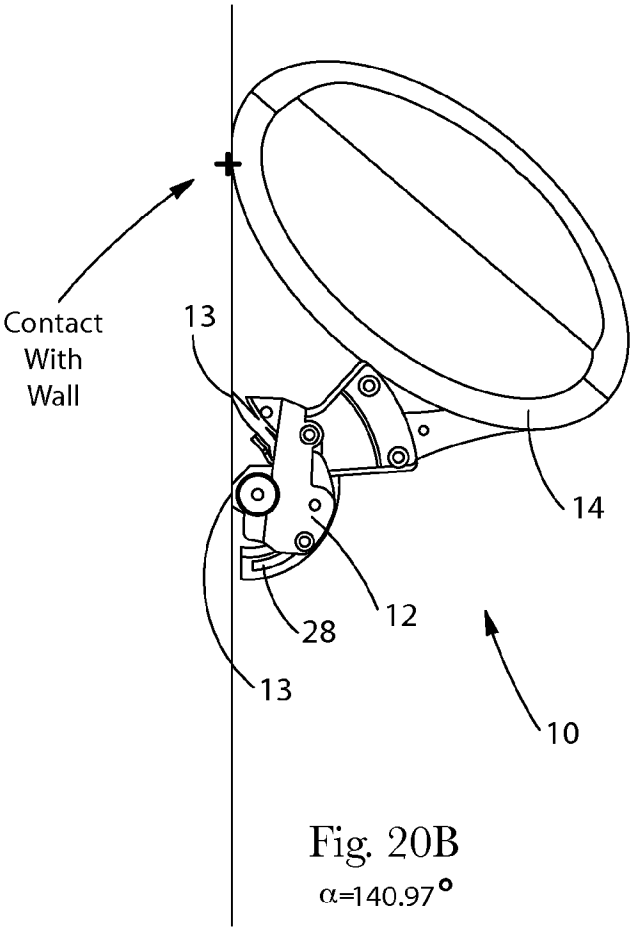
Fig. 20B
$\alpha$=140.97°
| Wall Limitations | |
|---|---|
| Device Start Angle | 39° |
| Device End Angle | 141° |
| Range | 102° |
Fig. 20AB
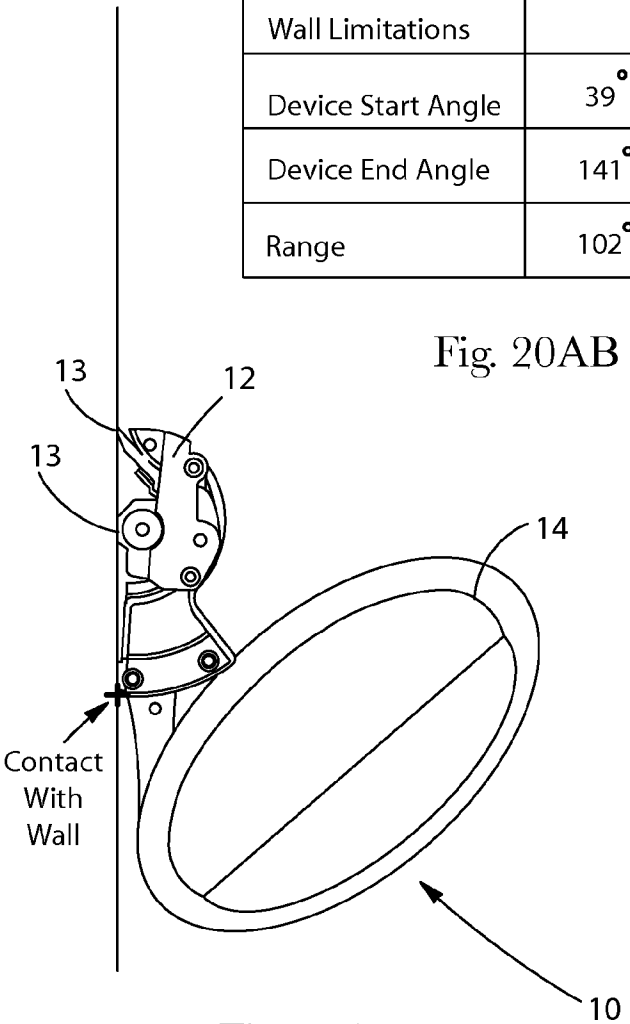
Fig. 20A
$\alpha$=38.96° grip angle =102 °

| Angle of Iteration | Forearm Angle | D1 (cm) | D2 (cm) | D3 (cm) | D4 (cm) | D5 (cm) | D6 (cm) | Applied Moment (N-m) |
|---|---|---|---|---|---|---|---|---|
| 0.0 | 72.2 | 1.12 | 5.05 | 1.85 | 0.00 | 1.12 | 4.28 | 0.22 |
| 5.0 | 77.2 | 1.12 | 5.05 | 1.85 | 0.00 | 1.56 | 4.40 | 0.22 |
| 10.0 | 82.2 | 1.12 | 5.05 | 1.85 | 0.00 | 2.00 | 4.52 | 0.22 |
| 15.0 | 87.2 | 1.12 | 5.05 | 1.85 | 0.00 | 2.43 | 4.64 | 0.22 |
| 20.0 | 92.2 | 1.12 | 5.05 | 1.85 | 0.00 | 2.85 | 4.77 | 0.21 |
| 25.0 | 97.2 | 1.12 | 5.05 | 1.85 | 0.00 | 3.26 | 4.90 | 0.20 |
| 30.0 | 102.2 | 1.12 | 5.05 | 1.85 | 0.00 | 3.65 | 5.02 | 0.19 |
| 35.0 | 107.2 | 1.12 | 5.05 | 1.85 | 0.00 | 4.02 | 5.15 | 0.18 |
| 40.0 | 112.2 | 1.12 | 5.05 | 1.85 | 0.00 | 4.37 | 5.27 | 0.17 |
| 45.0 | 117.2 | 1.12 | 5.05 | 1.85 | 0.00 | 4.70 | 5.39 | 0.16 |
| 50.0 | 122.2 | 1.12 | 5.05 | 1.85 | 0.00 | 5.00 | 5.51 | 0.14 |
| 55.0 | 127.2 | 1.12 | 5.05 | 1.85 | 0.00 | 5.26 | 5.62 | 0.13 |
| 60.0 | 132.2 | 1.12 | 5.05 | 1.85 | 0.00 | 5.50 | 5.73 | 0.11 |
| 65.0 | 137.2 | 1.12 | 5.05 | 1.85 | 0.00 | 5.71 | 5.83 | 0.10 |
| 70.0 | 142.2 | 1.12 | 5.05 | 1.85 | 0.00 | 5.87 | 5.93 | 0.08 |
| 75.0 | 147.2 | 1.12 | 5.05 | 1.85 | 0.00 | 6.01 | 6.02 | 0.06 |
| 80.0 | 152.2 | 1.12 | 5.05 | 1.85 | 0.00 | 6.10 | 6.10 | 0.04 |
| 85.0 | 157.2 | 1.12 | 5.05 | 1.85 | 0.00 | 6.16 | 6.18 | 0.02 |
| 90.0 | 162.2 | 1.12 | 5.05 | 1.85 | 0.00 | 6.18 | 6.25 | 0.00 |

Fig. 28A
PRIOR ART grip angle = 102°

| Angle of Iteration | Forearm Angle | D1 (cm) | D2 (cm) | D3 (cm) | D4 (cm) | D5 (cm) | D6 (cm) | Applied Moment (N-m) |
|---|---|---|---|---|---|---|---|---|
| 0.0 | 58.3 | 1.86 | 11.00 | 7.62 | 3.81 | 1.86 | 11.2 | 4.33 |
| 5.0 | 63.3 | 1.86 | 11.00 | 7.62 | 3.81 | 2.82 | 11.3 | 4.31 |
| 10.0 | 68.3 | 1.86 | 11.00 | 7.62 | 3.81 | 3.77 | 11.5 | 4.26 |
| 15.0 | 73.3 | 1.86 | 11.00 | 7.62 | 3.81 | 4.71 | 11.6 | 4.18 |
| 20.0 | 78.3 | 1.86 | 11.00 | 7.62 | 3.81 | 5.62 | 11.8 | 4.07 |
| 25.0 | 83.3 | 1.86 | 11.00 | 7.62 | 3.81 | 6.51 | 11.9 | 3.92 |
| 30.0 | 88.3 | 1.86 | 11.00 | 7.62 | 3.81 | 7.36 | 12.0 | 3.75 |
| 35.0 | 93.3 | 1.86 | 11.00 | 7.62 | 3.81 | 8.17 | 12.2 | 3.55 |
| 40.0 | 98.3 | 1.86 | 11.00 | 7.62 | 3.81 | 8.93 | 12.3 | 3.32 |
| 45.0 | 103.3 | 1.86 | 11.00 | 7.62 | 3.81 | 9.64 | 12.4 | 3.06 |
| 50.0 | 108.3 | 1.86 | 11.00 | 7.62 | 3.81 | 10.29 | 12.5 | 2.78 |
| 55.0 | 113.3 | 1.86 | 11.00 | 7.62 | 3.81 | 10.87 | 12.6 | 2.48 |
| 60.0 | 118.3 | 1.86 | 11.00 | 7.62 | 3.81 | 11.39 | 12.6 | 2.17 |
| 65.0 | 123.3 | 1.86 | 11.00 | 7.62 | 3.81 | 11.83 | 12.7 | 1.83 |
| 70.0 | 128.3 | 1.86 | 11.00 | 7.62 | 3.81 | 12.20 | 12.8 | 1.48 |
| 75.0 | 133.3 | 1.86 | 11.00 | 7.62 | 3.81 | 12.49 | 12.8 | 1.12 |
| 80.0 | 138.3 | 1.86 | 11.00 | 7.62 | 3.81 | 12.69 | 12.8 | 0.75 |
| 85.0 | 143.3 | 1.86 | 11.00 | 7.62 | 3.81 | 12.82 | 12.9 | 0.38 |
| 90.0 | 148.3 | 1.86 | 11.00 | 7.62 | 3.81 | 12.86 | 12.9 | 0.00 |

Fig. 29A
PRIOR ART

Grip Angle = 102°

| Angle of Iteration | Forearm Angle | D1 (cm) | D2 (cm) | D3 (cm) | D4 (cm) | D5 (cm) | D6 (cm) | Applied Moment (N-m) |
|---|---|---|---|---|---|---|---|---|
| 0.0 | 38.8 | 1.95 | 11.49 | 1.56 | 0.67 | 1.95 | 11.5 | 0.51 |
| 5.0 | 43.8 | 1.95 | 11.49 | 1.56 | 0.67 | 2.95 | 11.7 | 0.51 |
| 10.0 | 48.8 | 1.95 | 11.49 | 1.56 | 0.67 | 3.95 | 11.9 | 0.50 |
| 15.0 | 53.8 | 1.95 | 11.49 | 1.56 | 0.67 | 4.93 | 12.0 | 0.49 |
| 20.0 | 58.8 | 1.95 | 11.49 | 1.56 | 0.67 | 5.88 | 12.2 | 0.48 |
| 25.0 | 63.8 | 1.95 | 11.49 | 1.56 | 0.67 | 6.81 | 12.4 | 0.46 |
| 30.0 | 68.8 | 1.95 | 11.49 | 1.56 | 0.67 | 7.70 | 12.5 | 0.44 |
| 35.0 | 73.8 | 1.95 | 11.49 | 1.56 | 0.67 | 8.54 | 12.6 | 0.42 |
| 40.0 | 78.8 | 1.95 | 11.49 | 1.56 | 0.67 | 9.34 | 12.8 | 0.39 |
| 45.0 | 83.8 | 1.95 | 11.49 | 1.56 | 0.67 | 10.08 | 12.9 | 0.36 |
| 50.0 | 88.8 | 1.95 | 11.49 | 1.56 | 0.67 | 10.75 | 13.0 | 0.33 |
| 55.0 | 93.8 | 1.95 | 11.49 | 1.56 | 0.67 | 11.36 | 13.1 | 0.29 |
| 60.0 | 98.8 | 1.95 | 11.49 | 1.56 | 0.67 | 11.90 | 13.2 | 0.26 |
| 65.0 | 103.8 | 1.95 | 11.49 | 1.56 | 0.67 | 12.37 | 13.2 | 0.22 |
| 70.0 | 108.8 | 1.95 | 11.49 | 1.56 | 0.67 | 12.75 | 13.3 | 0.17 |
| 75.0 | 113.8 | 1.95 | 11.49 | 1.56 | 0.67 | 13.05 | 13.4 | 0.13 |
| 80.0 | 118.8 | 1.95 | 11.49 | 1.56 | 0.67 | 13.27 | 13.4 | 0.09 |
| 85.0 | 123.8 | 1.95 | 11.49 | 1.56 | 0.67 | 13.40 | 13.4 | 0.04 |
| 90.0 | 128.8 | 1.95 | 11.49 | 1.56 | 0.67 | 13.44 | 13.4 | 0.00 |

Fig. 31C

DEVICE FOR TREATING A TARGET SURFACE AND HAVING AN ERGONOMICALLY PIVOTING HANDLE

CROSS-REFERENCE TO RELATED APPLICATIONS

This application claims priority under 35 U.S.C. §119(e) to U.S. Provisional Application Ser. No. 61/526,097, filed Aug. 22, 2011.

FIELD OF THE INVENTION

The present invention relates to devices usable to treat a target surface. Such devices may be used for cleaning windows, dusting floors, applying surface treatments, smoothing concrete, etc.

BACKGROUND OF THE INVENTION

Devices for treating target surfaces are well known in the art. Such devices include squeegees, paint rollers, cleaning heads, concrete floats, dust mops having renewable surfaces, dust mops having replaceable surfaces, such as the Swiffer Sweeper sold by the instant assignee.

These devices typically have a blade or other edge which contacts the target surface. The blade may be used to spread a liquid for treating the target surface or for removing liquid from the target surface. For example, a squeegee blade may be used to remove cleaning solution, and concomitantly remove soil, from a window. Or the blade may be used to spread stain or lacquer onto a hardwood floor.

One problem the user may encounter when using such a device is that it is difficult to maintain control over the blade or other component which contacts the target surface. This difficulty may be exacerbated as the size of the target surface increases. Particularly, when the user encounters a vertical target surface and wishes to begin the stroke overhead and finish the stroke near the floor, it may be difficult to maintain proper pressure against the target surface throughout the stroke.

For example, the user may be attempting to clean a window which vertically extends from floor to ceiling. The user is typically able to apply adequate pressure if the head of the cleaning device is disposed between the waist and shoulders of the user. Likewise, the user is typically able to apply adequate pressure against the target surface when the head of the cleaning device is disposed between the waist and knees of the user. However, somewhere around waist level the user may encounter difficulty in the transition and not apply sufficient pressure against the target surface for the cleaning device to operate at optimum efficacy. This difficulty may result in chatter or even separation from the target surface.

A simple planar handle and scraper are shown in U.S. Pat. Nos. 4,200,948 and 5,009,009. Another example of a planarly disposed handle and head is found in the common paint roller. Attempts to improve upon this system is found in U.S. Pat. No. 5,666,685 which shows a cleaning implement having a curved handle and in U.S. Pat. No. 7,308,729 B2 showing a vacuum nozzle with integral squeegee. But these devices hold the head in fixed relationship to the handle. As such, they do not provide optimum ergonomics for all conditions.

An attempt to improve upon this system is found in devices having a pivot or universal joint on the head, as disclosed in U.S. D622,463 S, U.S. Pat. Nos. 5,175,902, 5,549,167, 5,862,562, 7,007,338 and in commonly assigned Des. 409,343, D615,260 S, U.S. Pat. Nos. 5,888,006, 6,842,936 B2 and 7,516,508 B2. But these attempts to work with just the head have not proven entirely successful.

Attempts have also been made to compensate for the ergonomic shortcomings by providing different handle arrangements. Illustrative handle arrangements are shown in US 2008/0265536 A1, 2008/0236972 A1, 7,124,474 B2 and 7,571,945 B2. Yet other handle arrangements can be found. For example, Lowes advertises a paint roller handle having the roller axis in adjustable, non-planar relationship relative to the longitudinal axis of the handle.

But attempts to improve the handle, in isolation, like the attempts to improve the head, in isolation, have not proven entirely satisfactory. Accordingly, a new approach is needed.

SUMMARY OF THE INVENTION

The invention comprises device having a handle and head. The handle and head are mounted in pivotal relationship to each other. When the head is placed in contacting relationship with a target surface, the handle and head can advantageously pivot relative to the other, for the ergonomic convenience of the user.

BRIEF DESCRIPTION OF THE DRAWINGS

FIG. 1A is a table of the effect of device angle iteration on forearm angle, lengths D1-D6 and applied moment for the device of FIG. 1.

FIG. 14A is a table of the effect of device angle iteration on forearm angle, lengths D1-D6 and applied moment for the device of FIG. 14.

FIG. 17A is a table of the effect of device angle iteration on forearm angle, lengths D1-D6 and applied moment for the device of FIG. 17.

FIG. 20A is a side elevational view of an alternative embodiment to the device of FIGS. 1-3, shown in an illustrative starting position near the top of a vertically oriented target surface and having a transmission intermediate the head and handle, and shown at the beginning of a stroke.

FIG. 20B is a side elevational view of the device of FIG. 20A, shown in an illustrative final position near the bottom of a vertically oriented target surface.

FIG. 20AB is a chart showing the starting and ending angles of the device of FIGS. 20A and 20B, respectively.

FIG. 28A is a table of the effect of device angle iteration on forearm angle, lengths D1-D6 and applied moment for the device of FIG. 28.

FIG. 29A is a table of the effect of device angle iteration on forearm angle, lengths D1-D6 and applied moment for the device of FIG. 29.

FIG. 31C is a table of the effect of device angle iteration on forearm angle, lengths D1-D6 and applied moment for the device of FIG. 31.

DETAILED DESCRIPTION OF THE INVENTION

Figure 1:
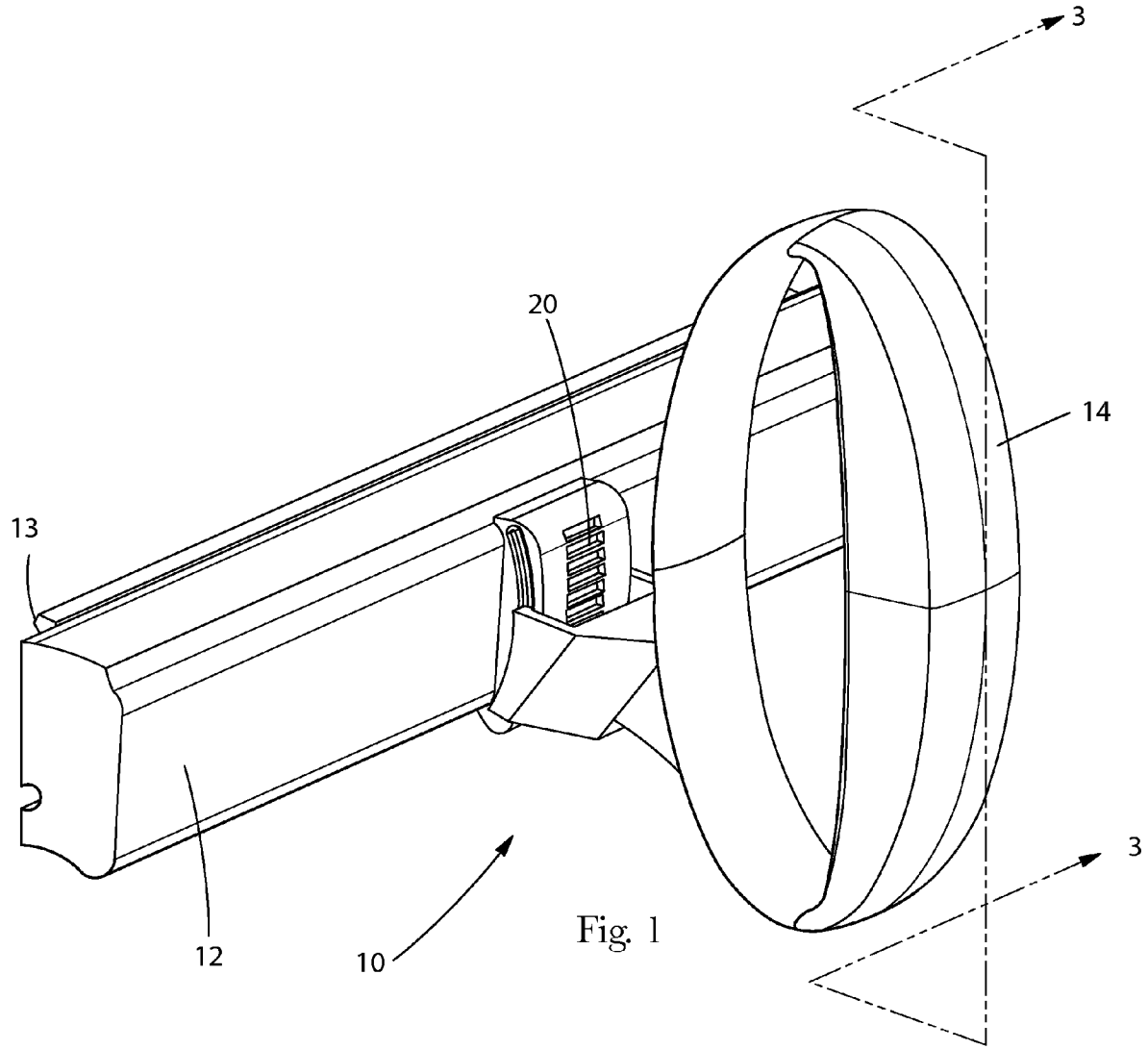
FIG. 1 is a rear perspective view of a first embodiment of a device according to the invention.

Referring to FIGS. 1, 1A, 2 and 3, the invention comprises a device 10 for treating a target surface. The device 10 will be described with respect to one suitable for cleaning a window, and particularly a vertically oriented window which extends above the shoulders of the user to below the knees of a user, although one of skill will recognize the invention is not so limited. The device 10 of the present invention may be used for other treatments of a target surface.

The device 10 may comprise a handle 12 and a head 14 pivotally joined thereto by a pivot mechanism. The pivoting motion may provide articulation about a single axis, which axis is generally perpendicular to the plane of the page in FIG. 2. Prophetically a ball and socket joint could be employed for this purpose.

Examining the components in more detail, the head 14 may extend in a generally width-wise direction. The head 14 may comprise one or more elements to contact and treat the target surface. For example, the head 14 may have an applicator, such as a roller, to apply liquid to the target surface. The liquid may comprise a cleanser, disinfectant, solvent, paint, stain, perfume, coating, etc. Alternatively or additionally, a liquid may be applied to the target surface by spraying from a separate dispenser or other application means.

The applicator may be saturated with the liquid. Alternatively or additionally, a separate substrate may cross the applicator for compression against the target surface at the tangent line. Compression against the target surface may result in the applicator expressing the liquid from a pre-wetted substrate or a saturated roller and onto the target surface.

The head 14 may also comprise a squeegee. The squeegee may be made of rubber, as is known in the art, a spring steel blade or may be a simple wiper made of cellulosic or synthetic non-woven material. The squeegee may provide for removal and/or spreading of the liquid applied to the target surface.

The head 14 may comprise one or more contact surfaces 13. The one or more contact surfaces 13 are the portion(s) of the head 14 which contacts the target surface during use. For example, a head 14 may have a single contact surface 13 comprising a squeegee, and applicator, etc. Alternatively, the head 14 may have plural contact surfaces 13 including a squeegee, an applicator and a frame or housing for the head 14. The contact surfaces 13 may include the squeegee, a roller, applicator, wiper, etc.

The contact surfaces 13 of the head 14 may extend in a predominantly width-wise direction, as shown. If plural contact surfaces 13 are utilized, the contact surfaces 13 may define a stance therebetween. The stance is orthogonal to the widthwise direction and may be parallel to the longitudinal direction of the handle 12. The stance is measured from outside edge to outside edge of the contact surface 13 elements. The stance, and related dimensions, may be measured in an at rest condition, i.e. without considering deformation due to compression against the target surface.

If the contact surfaces 13 are not straight or parallel as shown, the stance is measured as the greatest distance between these elements. The stance for a device 10 described and claimed herein may be at least 2, 3, 4, or 5 cm and less than 12, 10, 8, or 6 cm. The stance is labeled D3 in the relevant figures.

If desired a longitudinally movable sheet may be used to cover either or both of the outwardly facing contact surfaces 13. The sheet may be pre-wetted, to apply a cleanser or other liquid to the window or other target surface. Alternatively or additionally, the sheet may be used to protect and provide a renewable surface for the squeegee or other outwardly facing contact surface 13. Such a device 10 may be made according to the teachings of commonly assigned U.S. application Ser. No. 13/091,297 filed Apr. 21, 2011.

The handle 12 may comprise a closed loop. A portion of the loop may be generally parallel to the direction of movement of the device 10 on the target surface. Alternatively, the handle 12 may comprise a single spindle, as occurs with a common paint roller or may be a T-shape.

Figure 3B:
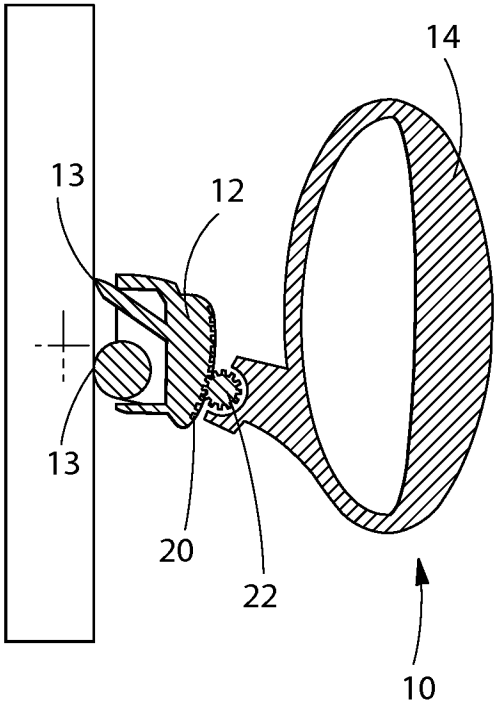
FIG. 3B is vertical sectional view of the device of FIGS. 1-2 disposed against a target surface, taken along lines 3-3 of FIG. 1 and showing the convex rack gear.
Figure 3A:
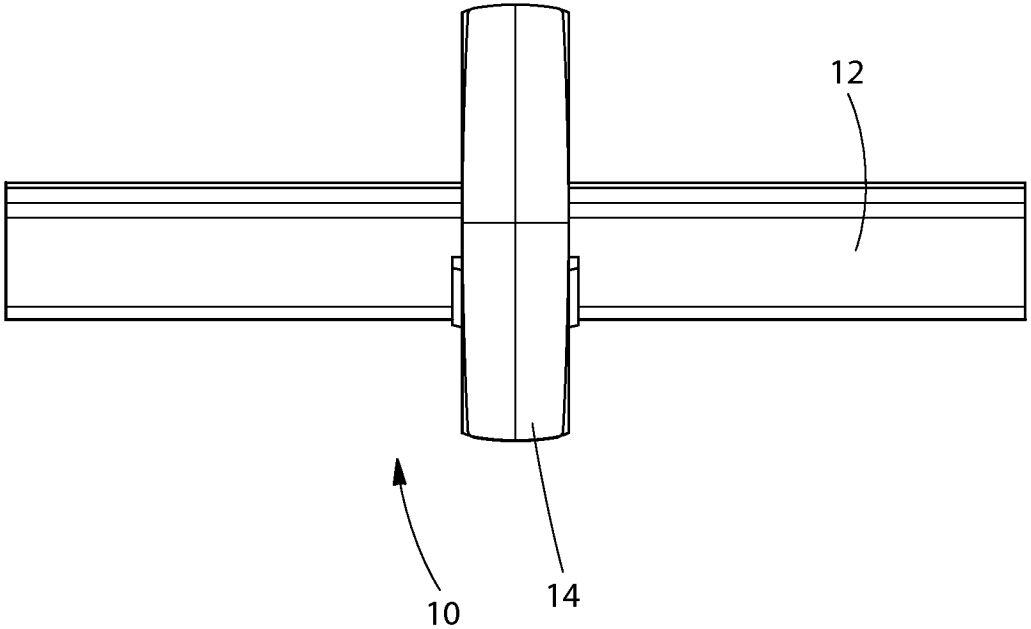
FIG. 3A is a rear elevational view of the device of FIGS. 1-2.

Referring particularly to FIGS. 1, 3A and 3B, the pivot mechanism provides the moving interface between the head 14 and the handle 12. Either the head 14 or the handle 12 can be held stationary, and the other articulated relative thereto. For example, the head 14 may be moved along a target surface. During such motion, the handle 12 may articulate to different angular relationships with the head 14.

The pivot mechanism may comprise complementary convex and concave portions. The convex portion may comprise one or more grooves disposed on the head 14 and be oriented convexly away from the target surface. The concave portion may comprise one or more sliders 26 which ride in the grooves and may be oriented concavely towards the target surface.

The groove/slider 26 interface allows for articulation between the head 14 and handle 12, while, at the same time, preventing separation thereof. The effective radius of the groove determines the center of the pivot motion, i.e. the axis about which the head 14 and handle 12 rotate during the pivot motion of the articulation.

The effective radius of the groove should be great enough that the center of rotation, i.e. the pivot axis, is disposed in the direction of the concavity outboard of the head 14 and it components. This geometry provides for an axis of rotation disposed behind the plane of the target surface. It is to be understood that if the target surface has appreciable thickness, i.e. a relatively thick pane of glass, reinforced wall, etc. that only the surface as presented to the user is considered. The thickness of the glass, wall, etc. behind the surface contacted by the device 10 claimed herein is not considered.

By increasing the radius of curvature of the pivot mechanism, the axis about which the handle 12/head 14 rotate relative to one another is moved further from the pivot mechanism. Thus, the arc subtended by the handle 12 during articulation has a relatively greater radius of curvature. By increasing the radius of curvature of the arc subtended by the handle 12, the length of the radius can be increased until the center of rotation is beyond and outboard of the head 14.

This arrangement advantageously provides for the center of rotation to be disposed outwardly of and beyond the portion of the head 14 which contacts the target surface. By disposing the axis of rotation outwardly of the contact surface 13 of the head 14, unpredicted stability during use of the device 10 results.

The pivot mechanism may further comprise a rack 20 and pinion gear 22 system. A convex rack gear 20 may be disposed on the head 14. A complementary pinion gear 22 may be disposed on the handle 12. The rack and pinion gear 22 may provide for improved articulation while the user is treating the target surface.

The pinion gear 22 may reduce binding between the head 14 and handle 12 as the head 14 and handle 12 move relative to each other during the stroke. This embodiment may further have a return spring disposed intermediate the head 14 and handle 12. The return spring assists the device 10 in achieving the entire range of the stroke, without removing the contact surface 13 of the head 14 from the target surface being treated.

Figure 2:
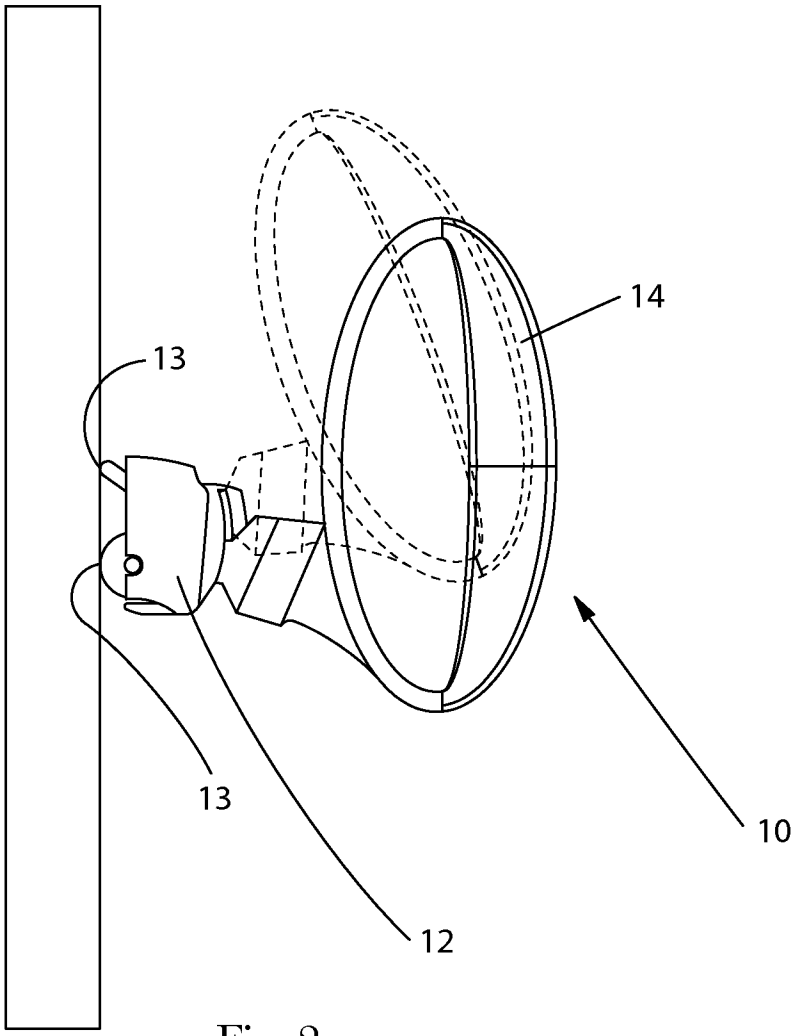
FIG. 2 is a side elevation overview of the device of FIG. 1 disposed against a target surface showing a first position of the handle in solid lines and a later, second position of the handle in dashed lines.

The embodiment of FIGS. 1-3 provides the benefit that if a modular construction is desired, the handle 12 may be relatively less expensive, due to the absence of the rack. Likewise, The embodiment of FIG. 4, below, provides the benefit that if a modular construction is desired, the head 14 may be relatively less expensive, due to the absence of the rack. In either embodiment the pinion may be used for the complementary component not having the rack.

Figure 4:
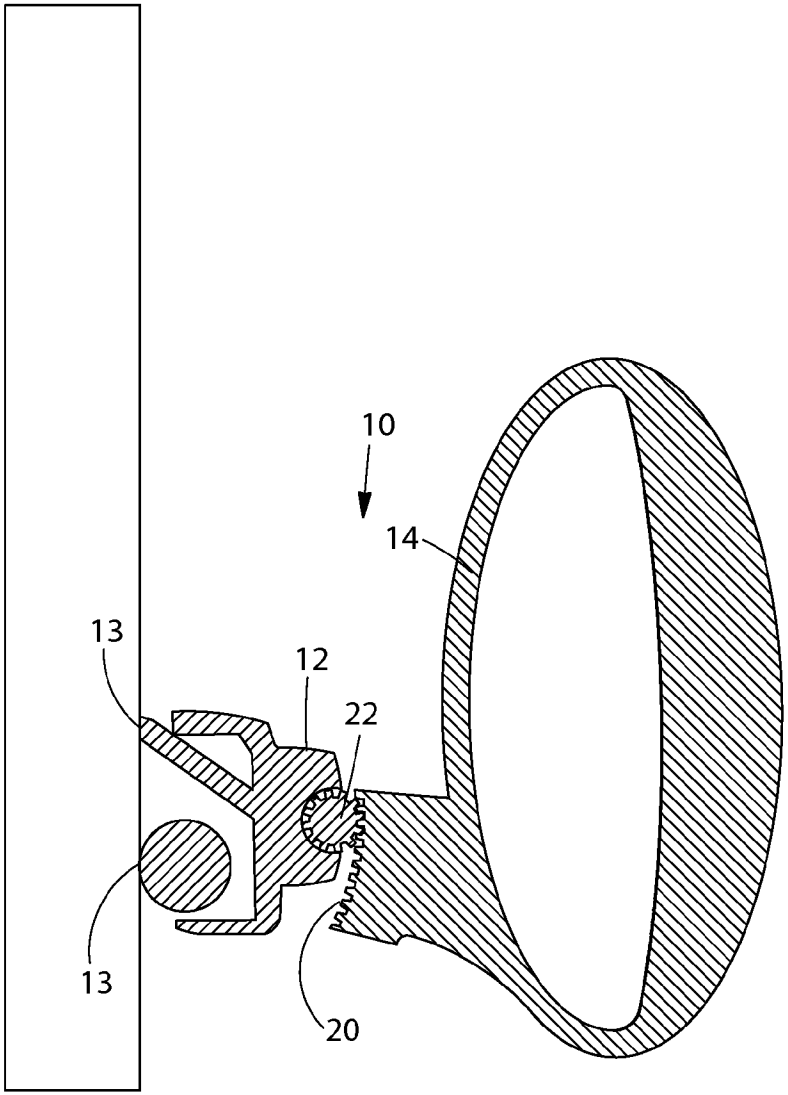
FIG. 4 is a vertical sectional view of an alternative embodiment of a device according to the invention and being disposed against a target surface, showing a concave rack gear.

Referring to FIG. 4, in an alternative embodiment, the device 10 may comprise a pivot mechanism which is generally inverse to that previously described. In this device 10 at least one concave groove and rack gear 20 may be disposed on the handle 12. A complementary pinion gear 22 and slider 26 system may be disposed on the head 14. The complementary groove and slider 26 system may be used, as described above, to prevent separation of head 14 and handle 12.

The groove and slider 26 system and the rack 20 and pinion 22 system may, again be disposed with the groove and track oriented concave outwardly of the head 14 and towards the target surface. If the radius of curvature is large enough with respect to the thickness of the head 14, as taken perpendicular to the widthwise direction, the center of rotation will be behind the target surface. Again, prophetically, disposing the center of rotation behind the target surface would provide the unpredicted result of improved stability during use.

Figure 5:
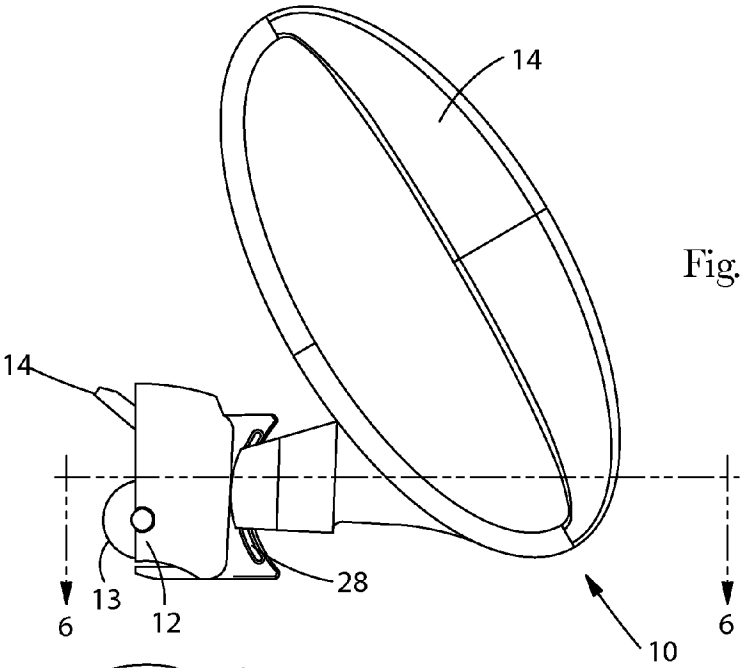
FIG. 5 is a side elevational view of an alternative embodiment device having a roller disposed in the head and the center of curvature behind the head.
Figure 6:
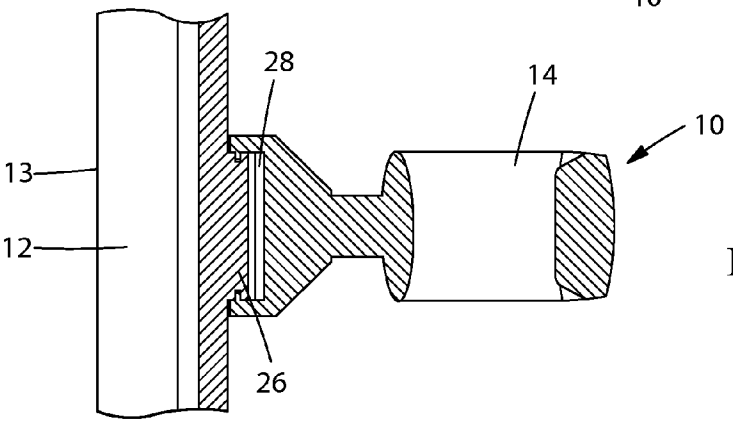
FIG. 6 is a horizontal sectional view of the device of FIG. 5, taken along lines 6-6 of FIG. 5.

Referring to FIGS. 5-6, a device 10 not claimed herein and generally inverse to that shown in FIG. 4 is illustrated. This device 10 has a groove and slider 26 system oriented concave towards the handle 12 and away from the target surface.

This device 10 provides for rotation of the handle 12 relative to the head 14 about an axis which is behind the head 14. I.e. the axis of rotation is not outboard of the contact surface 13 of the head 14. Instead, the axis of rotation occurs somewhat behind the pivot mechanism and within the handle 12 itself.

Figure 7:
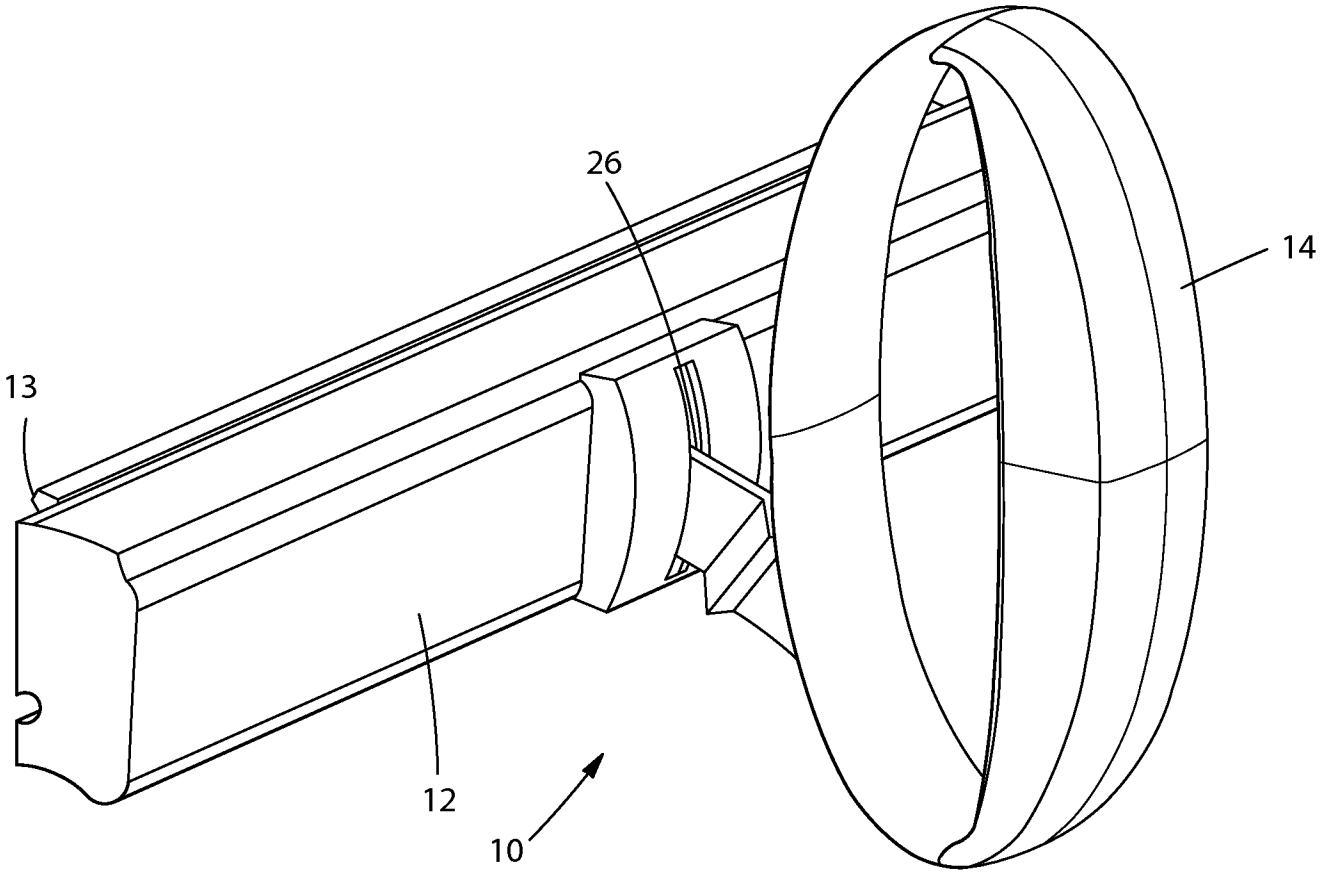
FIG. 7 is a rear perspective view of an alternative embodiment of a device according to the invention and having a convex track disposed on the head.
Figure 8:
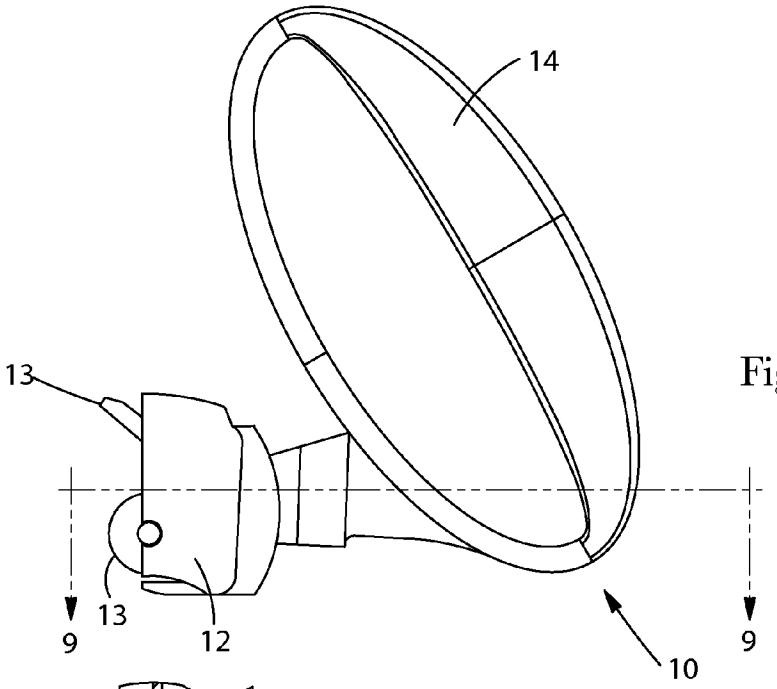
FIG. 8 is a side elevational view of the device of FIG. 7.
Figure 9:
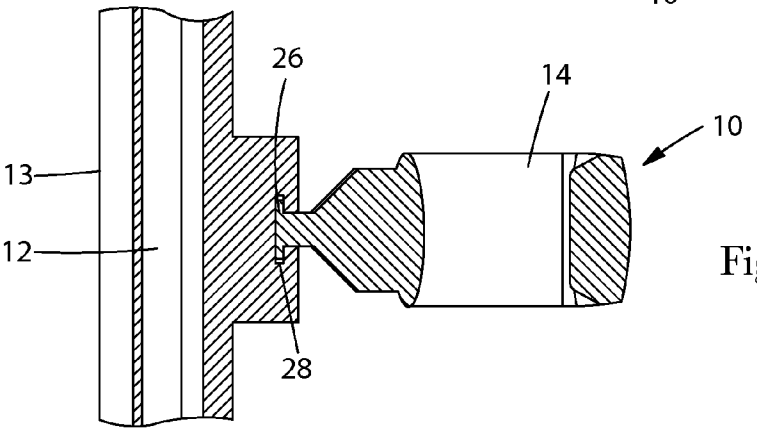
FIG. 9 is a horizontal sectional view taken through lines 9-9 of FIG. 8.

Referring to FIGS. 7-9, in an alternative device 10, a less complex pivot mechanism may be utilized. This pivot mechanism comprises a track 28 and slider 26. The slider 26 is captured in the track 28, again preventing separation of the head 14 and handle 12.

The track 28 may be convex and disposed on the head 14. The track 28 may be oriented convexly towards the handle 12 as described above with respect to FIGS. 1-3. Providing the radius of curvature is sufficient, the center of rotation will be outboard of the contact surface 13 of the head 14 and behind the target surface. Again, prophetically the unpredicted improvement in stability would result.

The embodiment of FIGS. 7-9 provides the benefit of a construction which avoids the cost of the rack and pinion gear 22. The track 28 and slider 26 may snap together in known fashion. Alternatively, the embodiment of FIGS. 7-9 and FIGS. 10-12, below, may be assembled from plastic parts, such as injection molded parts. Polycarbonate, polypropylene, acetal copolymer and ABS plastic may be suitable for a device 10 according to the present invention. The parts may be joined using screws, adhesive, solvent welding, ultra-sonic binding etc., as are known in the art.

Figure 10:
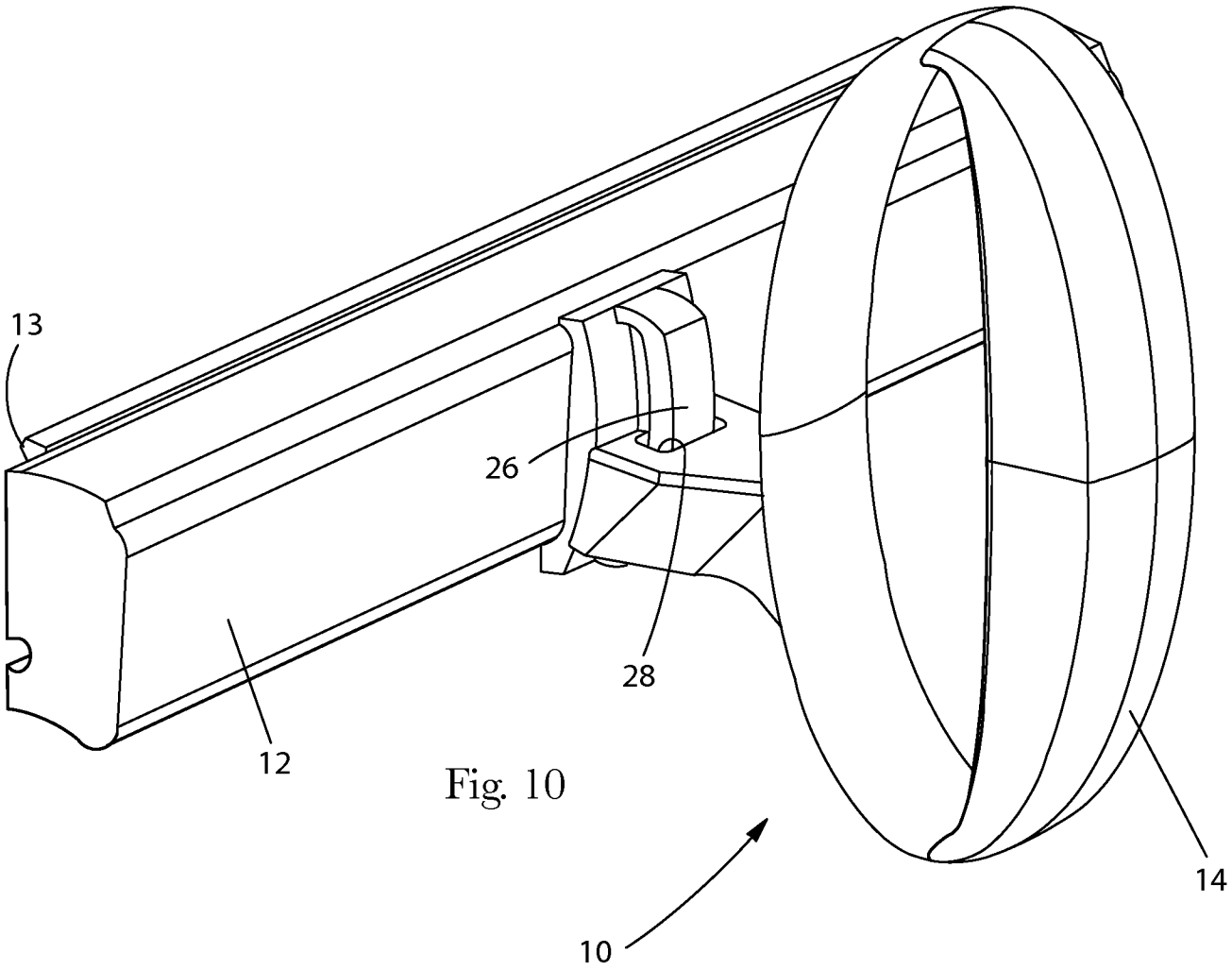
FIG. 10 is a rear perspective view of an alternative embodiment of a device according to the invention and having a concave track disposed on the handle.
Figure 11:
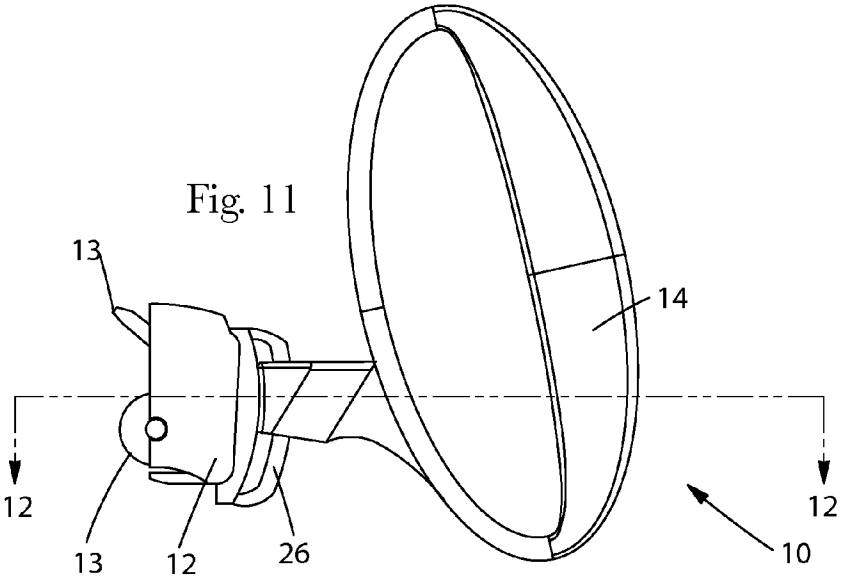
FIG. 11 is a side elevational view of the device of FIG. 10.
Figure 12:
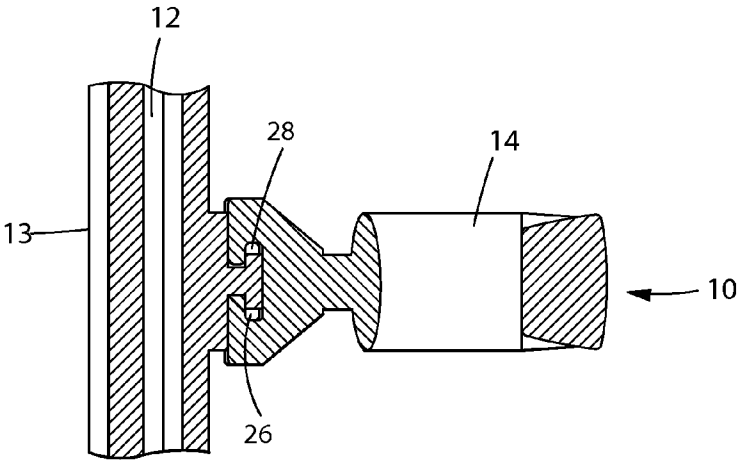
FIG. 12 is a horizontal sectional view taken through lines 12-12 of FIG. 11.

Referring to FIGS. 10-12, in another alternative device 10, the aforementioned less complex pivot mechanism may again be utilized. This pivot mechanism also comprises a track 28 and slider 26. The slider 26 is likewise captured in the track 28, again preventing separation of the head 14 and handle 12. This embodiment may be thought of as taking select features from the embodiment of FIG. 4 and FIGS. 7-9.

The embodiment of FIGS. 10-12 has as a concave track 28 disposed on the handle 12. A convex slider 26 complementary to this track 28 is disposed on the head 14. This arrangement allows the head 14 and handle 12 to articulate relative to one another without separation, as described above. Providing that the effective radius of curvature of the track 28/slider 26 system is great enough again, the center of such curvature will be outside of the device 10, particularly the head 14, and behind any target surface contacted by the contact surface 13 of the head 14.

Figure 13:
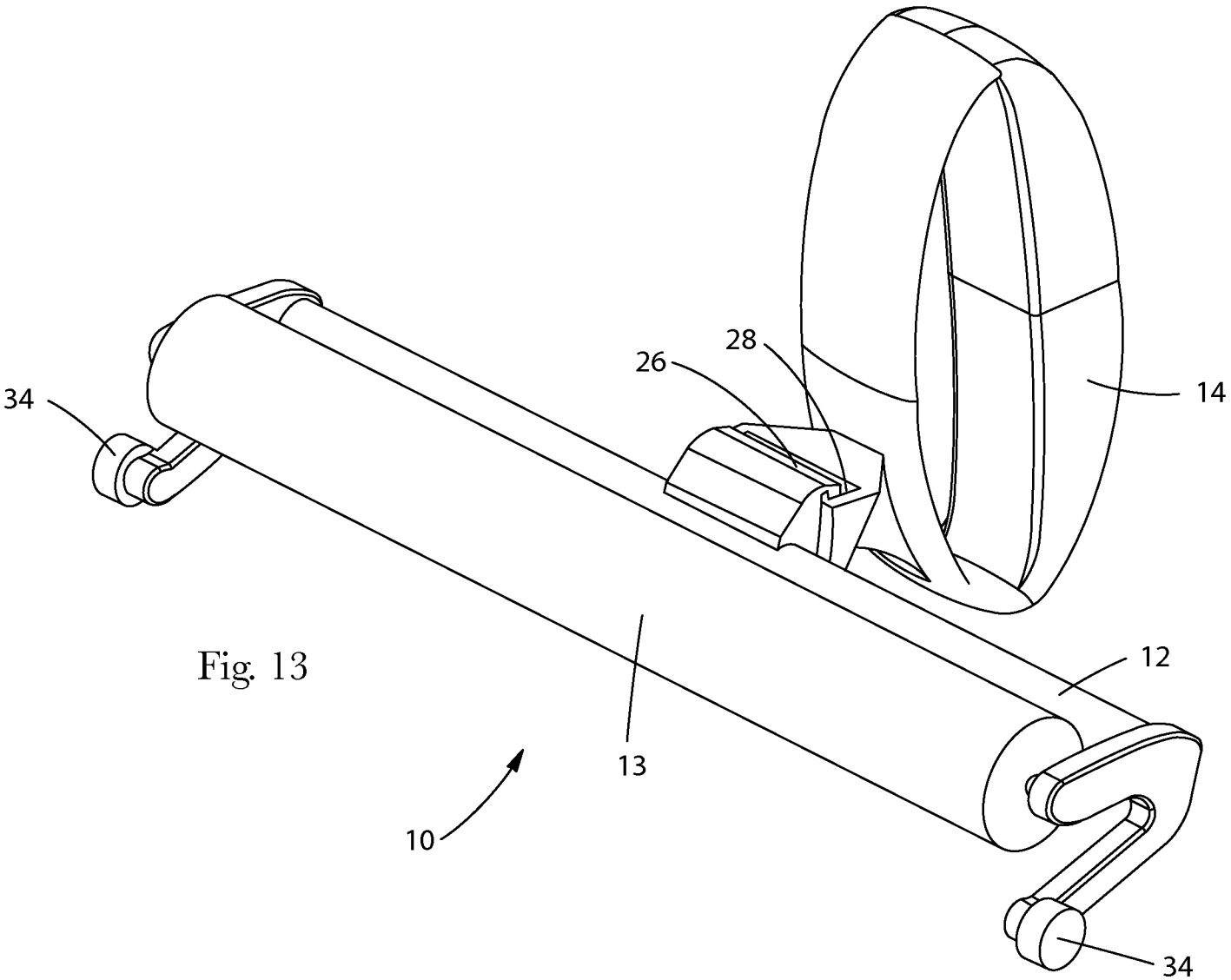
FIG. 13 is a front perspective view of an alternative embodiment of a device according to the present invention having tracking wheels and a roller in the head.

Referring to FIG. 13, if desired, the head 14 may further comprise one or more tracking wheels 34. Each tracking wheel 34 may be disposed on a post. The post may extend from a proximal end juxtaposed with the head 14 to a distal end remote therefrom. The distal ends of each arm may have an axle about which the tracking wheel 34 rotates. The axles may be: colinear and generally parallel to the widthwise direction.

The tracking wheels 34 provide the benefit of having multiple contact points on the contact surface 13 of the head 14. Also, the tracking wheels 34 may provide more linear, straight tracking when the device 10 is in use.

Referring to FIGS. 14, 14A, 15 and 16, the entirety or majority of the handle 12 may be curvilinear. In a particular case the curvilinear handle 12 may be circular. Such a handle 12 has a sliding component and a fixed component. The curved handle 12 may have a fixed length, with a slider 26 thereon. The user may grip the slider 26 with one hand in use. In use, the slider 26 travels up the fixed portion of the curved handle 12 from a position juxtaposed with the distal end, i.e. free end, of the handle 12 to a position juxtaposed with the proximal end of the handle 12, near the head 14.

Figure 16:
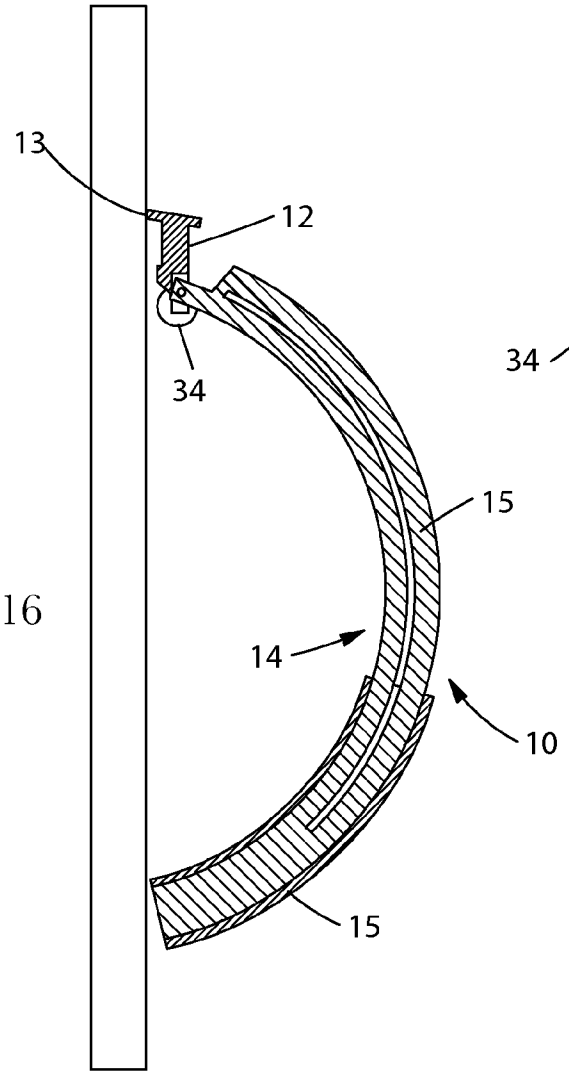
FIG. 16 is a vertical sectional view of the device of FIG. 15 taken along lines 16-16.
Figure 16A:
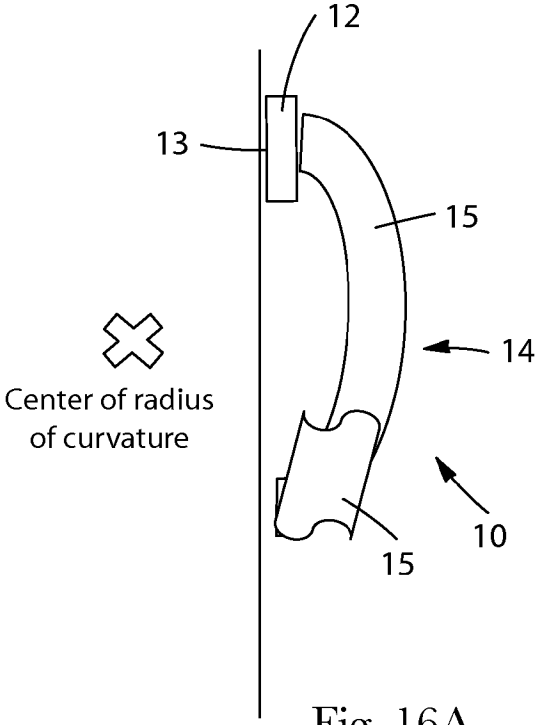
FIGS. 16A, 16B and 16C are side elevational views of an alternative embodiment of a device having an arcuate, fixed length handle with a variable radius of curvature, showing the center of radius of curvature move from behind to the target surface, onto the target surface and to the user side of the target surface, respectively.
Figure 16B:
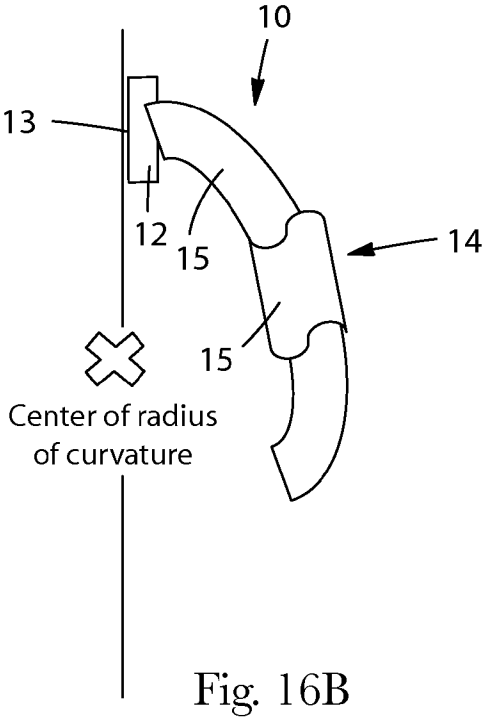
Figure 16C:
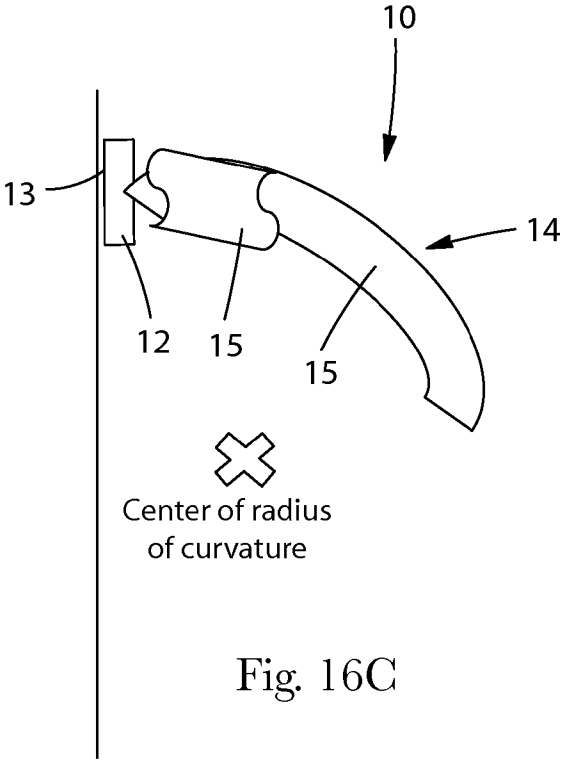
Figure 16E:
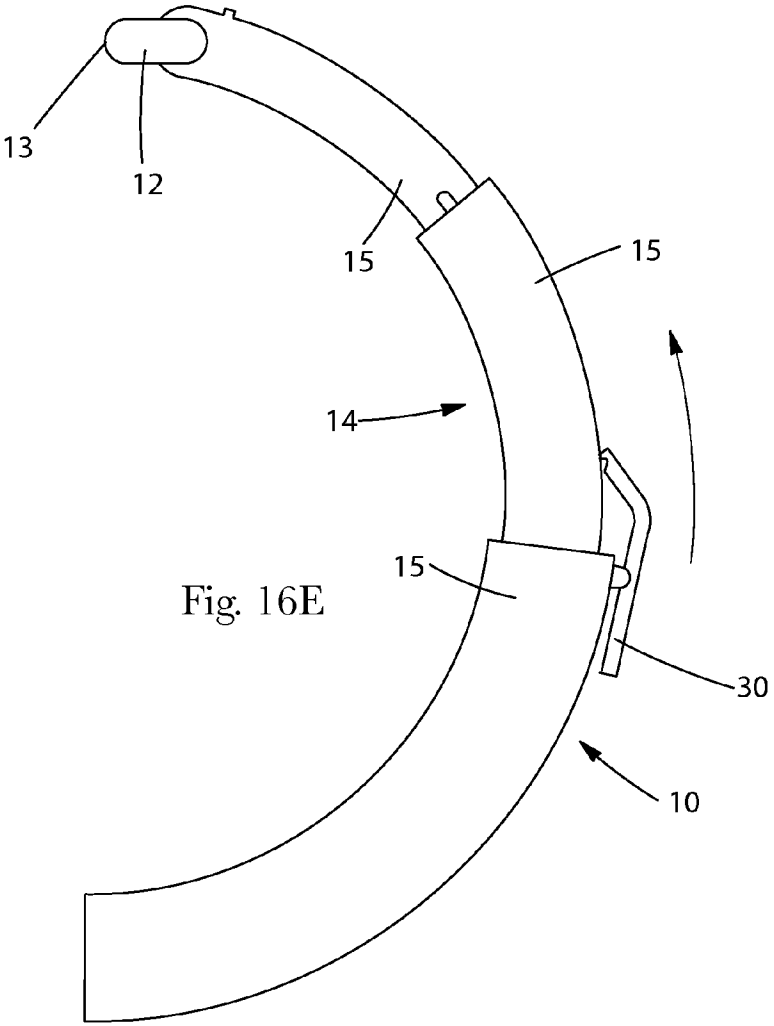
FIG. 16E is a side elevational view of the device of FIG. 16D, shown in the extended position.
Figure 16D:
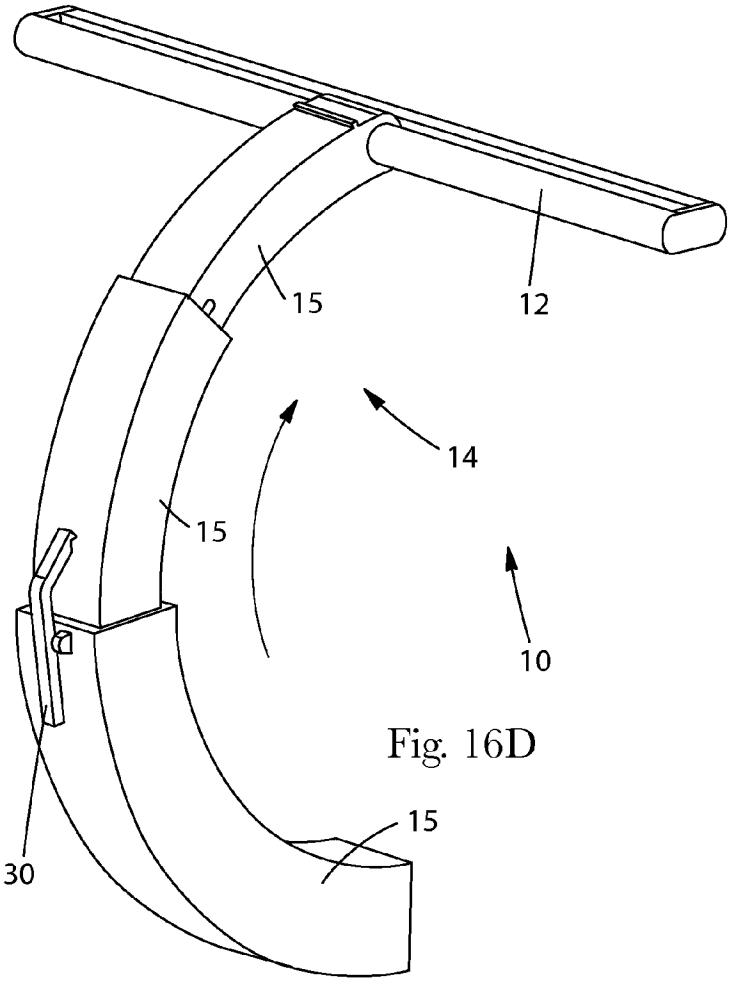
FIG. 16D is a perspective view of an alternative device having an arcuate telescoping handle, shown in the extended position, as may occur at the beginning of a stroke.
Figure 16G:
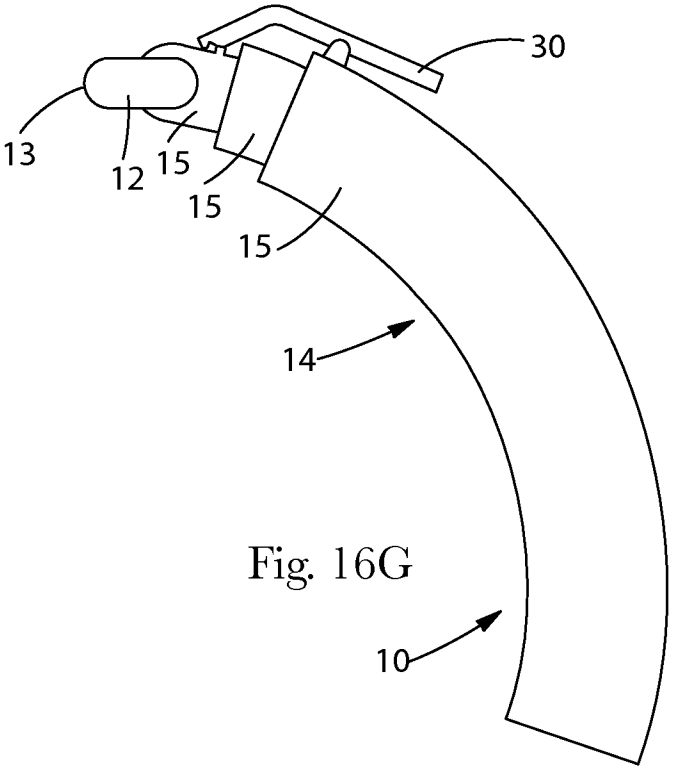
FIG. 16G is a side elevational view of the device of FIG. 16F, shown in the retracted position.
Figure 16F:
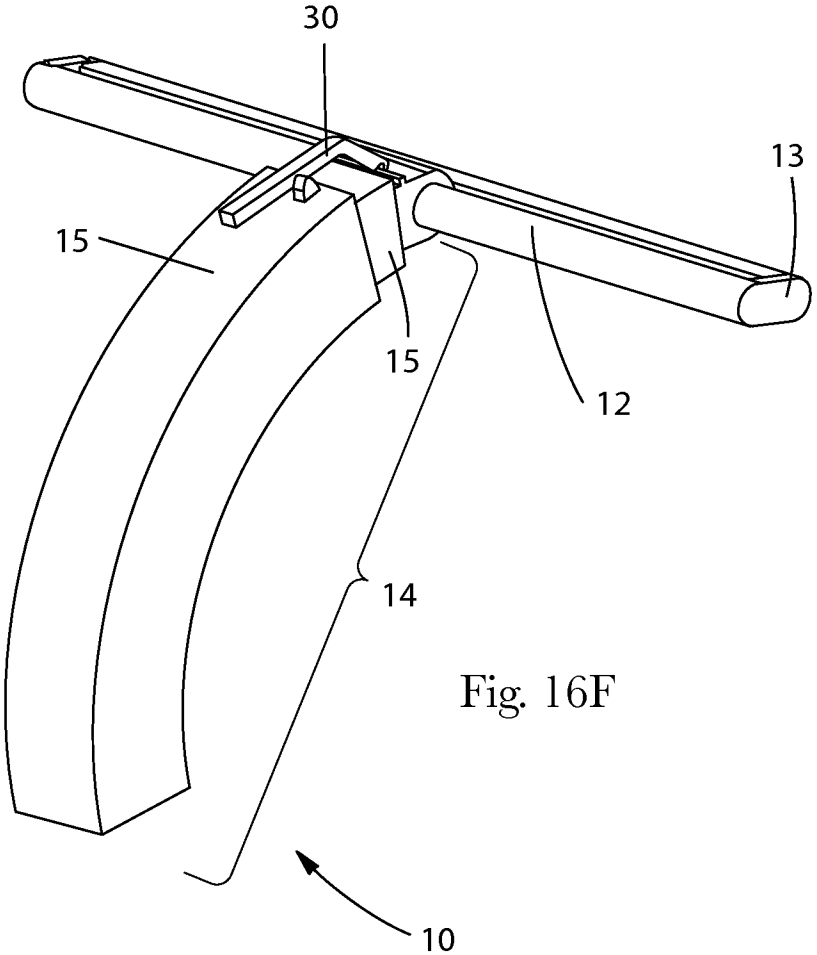
FIG. 16F is a perspective view of the device of FIG. 16D, shown in the retracted position, as may occur near the end of a stroke.

Referring to FIGS. 16A, 16B and 16C, if desired, the arcuate handle 12 may have a variable radius of curvature. This arrangement provides the benefit that binding of the gripper is reduced as the radius of curvature increases.

Referring back to FIGS. 14-16, the curvature of the sliding component and, more particularly the fixed component, may be great enough that, again, the center of the radius of the curvature occurs outboard of the head 14 and, even outboard of the entire device 10. The center of curvature or this embodiment occurs, again, behind the target surface.

Alternatively, as shown in FIGS. 16A, 16B and 16C, the center of the radius may be behind the target surface as the user begins the stroke, and move onto the user side of the target surface as the stroke occurs. This arrangement provides the benefit of a smooth transition throughout the range of the stroke.

The radius of curvature may range from a few cm to a few meters, particularly at least 2, 5 or 15 cm but less than 3 meters, 2 meters or 30 cm. If a longer arcuate handle 12 is desired, such handle 12 may, for example, prophetically be used to clean second story windows while the user is safely on the ground.

The sliding component and fixed component may be joined together in known fashion using a track 28 and groove, as discussed above. Particularly, plural tracks disposed 180° apart on different sides of the stationary component of the handle 12 may be utilized.

This device 10 may also have tracking wheels 34 forming part of the contact surface 13 as described above with respect to the embodiment of FIG. 13. However, in this device 10, the axle of each tracking wheel 34 may be disposed directly on the head 14, without the use of the aforementioned arms. This arrangement provides a less complex construction than a device 10 having separate arms dedicated to mounting the tracking wheels 34.

Referring to FIGS. 16D, 16E, 16F and 16G, and examining this embodiment in more detail, it can be seen that the handle 12 may be comprised of plural segments 15. The segments 15 may telescope. Two, three or more telescoping handle 12 segments 15 may be utilized, so long as the radii and fit allow for telescoping to occur. If a telescoping, curved handle 12 is selected, the distal segment 15 of the handle 12 may telescope over the next handle 12 segment 15 and so on, until the handle 12 segment 15 proximal to the head 14 is reached. If desired, the handle 12 may be spring biased to return to an extended starting position.

This arrangement provides the benefit that at the start of an overhead 14 stroke, a relatively longer handle 12 is provided, improving reach. During the stroke, the handle 12 may collapse upon itself. This collapse allows the user's hand to approach the target surface during the stroke. By approaching the target surface, control may be improved. This phenomenon is further discussed below with respect to graphs included in the figures.

If desired, this embodiment may have an optional latch 30 to fix the handle 12 segments 15 in a stationary position. The latch 30 may be spring loaded, as is well known, to prevent sliding of one handle 12 segment 15 relative to another, providing the user with the convenience of a fixed length handle 12. The fixed length can be relatively longer or shorter, to suit the task at hand. Also, the latch 30 can fix the segments 15 in position, so that the user does not have to overcome the spring force during all or part of the stroke.

Example 1

Figure 17:
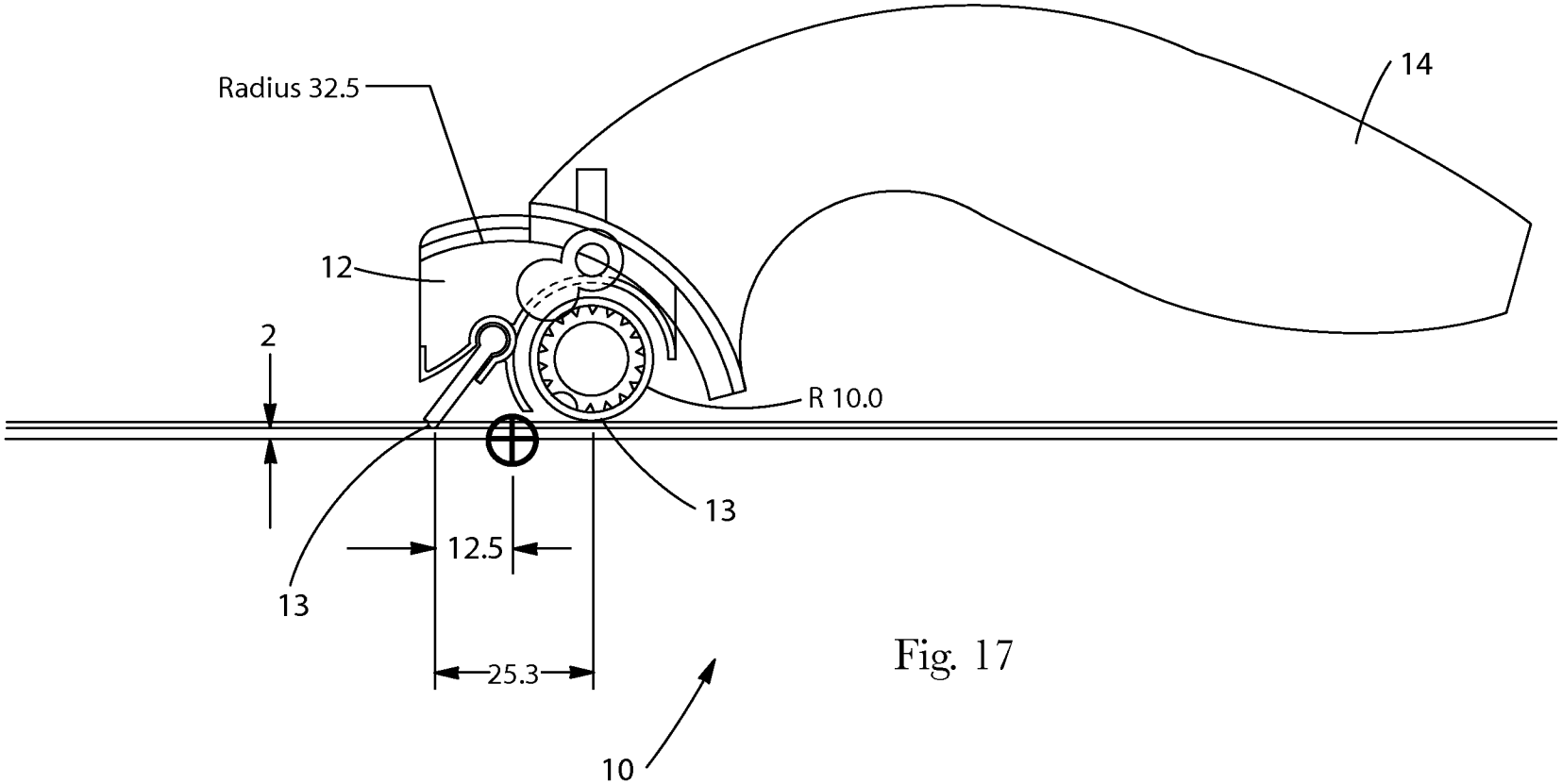
FIG. 17 is a sectional view of an alternative embodiment of a device according to the present invention having a roller and squeegee in the head and a convex track in the head.
Figures 17B, 17C, 17D, 17E:
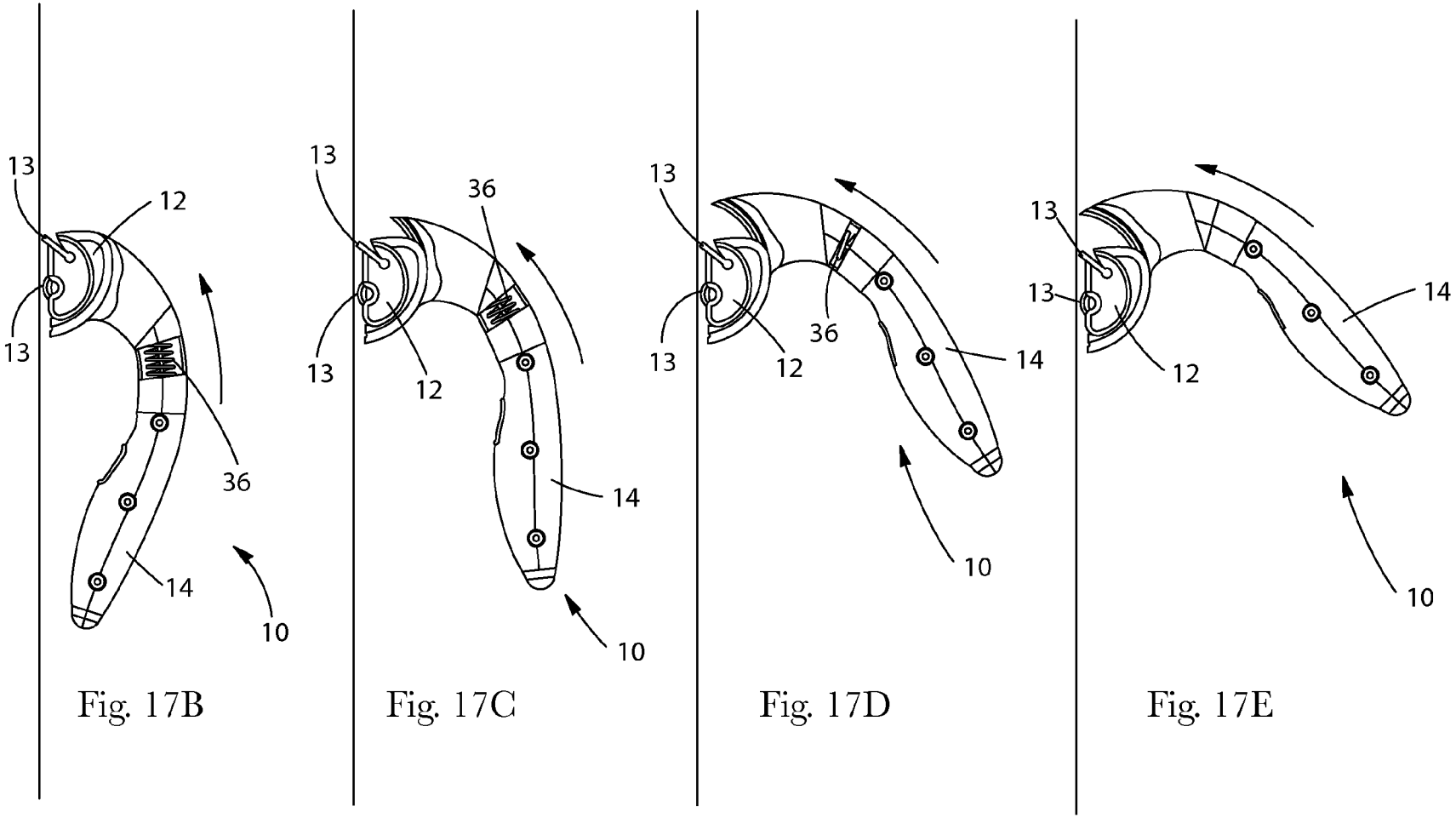
FIGS. 17B, 17C, 17D and 17E are sequential side elevational views of a variant embodiment of the device of FIG. 17, having a compressible spring in the handle, and showing compression of that spring during the stroke.

Referring to FIGS. 17 and 17A, an exemplary device 10 according to the present invention is shown. This device 10 is shown in use on a horizontal target service, although the invention is not limited to horizontal and vertical target surfaces.

This device 10 has two components which make up the contact surface 13 of the head 14. One component is a substrate roller having a radius of approximately 9.98 mm. The other component is a squeegee located above the substrate roller when the devices 10 used in a vertical position. This device 10 has a convex track 28 in head 14 and a complementary slider 26 in the handle 12. The convex track 28 and slider 26 have an effective radius of curvature of 32.5 mm.

This geometry provides a pivot axis located approximately 2 mm behind the target surface. The pivot axis is located approximately 12.5 mm from the squeegee portion of the contact surface 13 forward the substrate roller. Plus, the pivot axis is located approximately halfway between the two components which make up the contact surface 13 of the head 14.

Referring to FIGS. 17B-17E, if desired, a compression spring 36 may be installed in the handle 12 of the device 10. Compression of this spring 36 allows the handle 12 to shorten during use. Particularly the effective distance from the effective midpoint of the handle 12 to the point on the target surface disposed midway between the contact surfaces 13 of the head 14, may shorten during a single stroke. Such stroke may be taken downward on a vertical target surface or may be made towards the user on a horizontal target surface.

Figure 18:
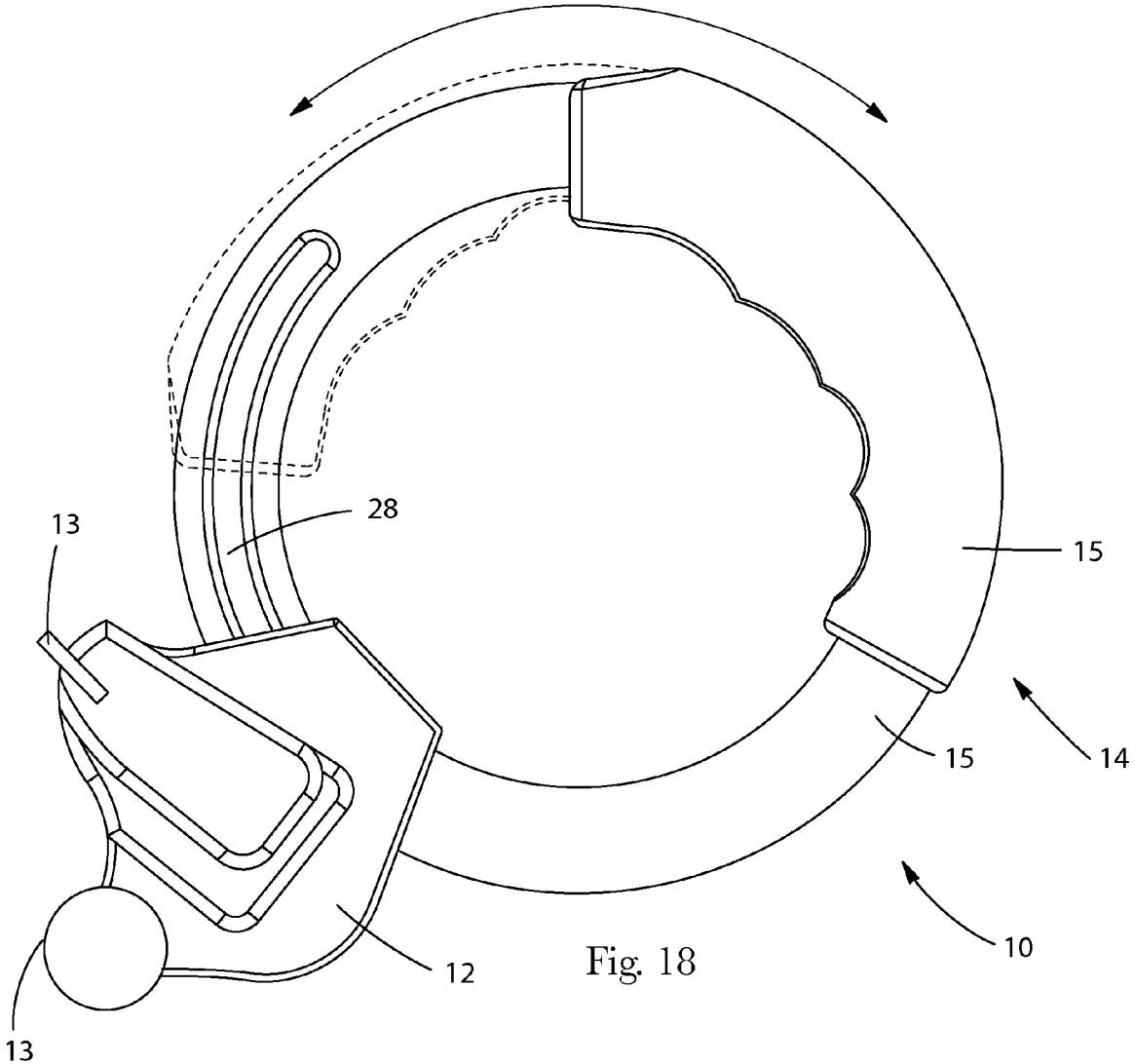
FIG. 18 is a side elevational view of an alternative embodiment of a device having a generally curvilinear handle, forming a closed loop and showing a first position of the handle in solid lines, and a later, second position in dashed lines.

Referring to FIG. 18 an alternative device 10 is shown and not claimed herein. This device 10 also has a curvilinear telescoping handle 12. The handle 12 forms a closed loop and, in a particular case, a circle. The center of curvature of this device 10 is disposed within the loop of the handle 12. This device 10 provides the benefit that the grip of the handle 12 may be disposed above the contact surface 13 of the head 14. By disposing the grip of the handle 12 above the head 14 the device 10 may be used in various positions and configurations as may be ergonomically desirable.

Figure 18C:
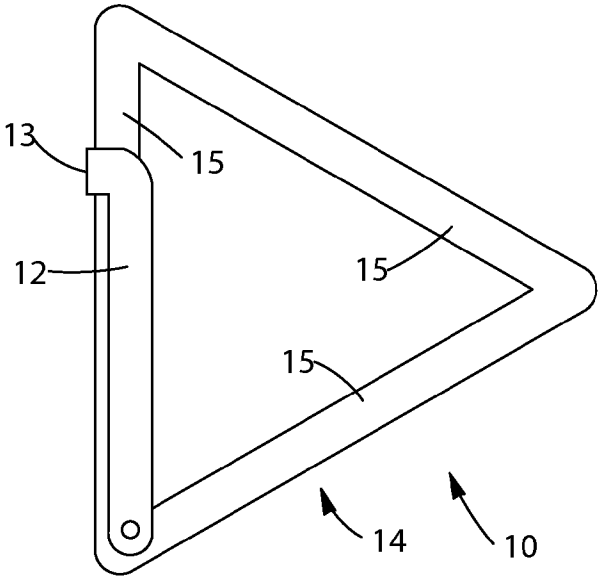
FIGS. 18A, 18B and 18C are side elevational views of an alternative embodiment having a closed loop handle and a head pivotally joined thereto, showing the beginning of the stroke, a later portion of the stroke and a still later portion of the stroke having the head collapsed against the handle, respectively.
Figure 18B:
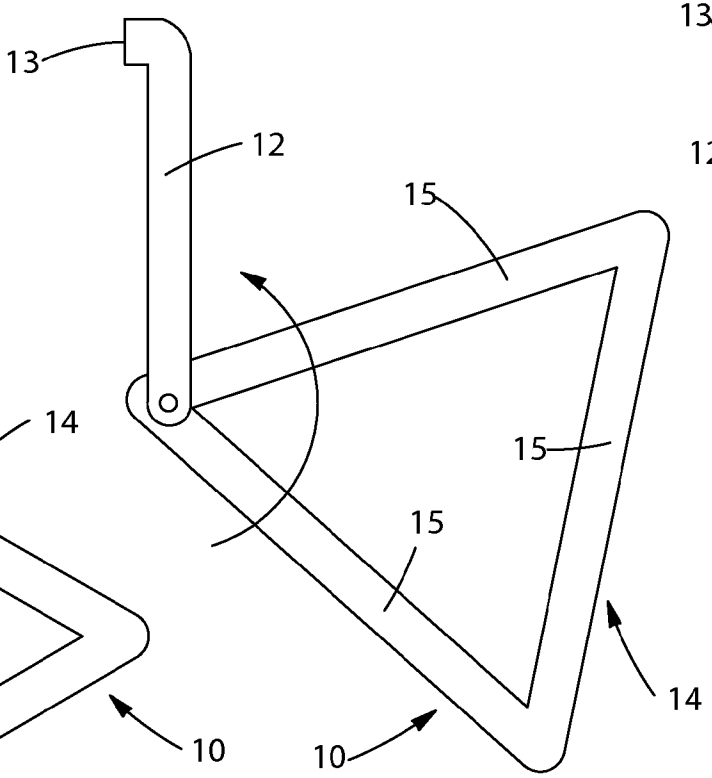
Figure 18A:
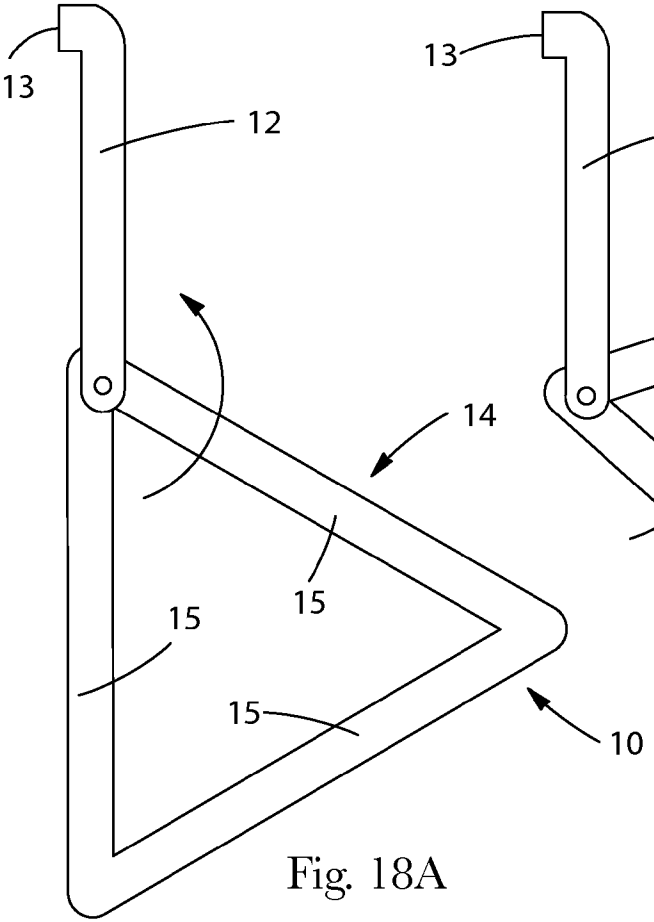

Referring to FIGS. 18A, 18B and 18C, an alternative device 10 may have a closed loop handle 12, with a head 14 pivotally attached thereto. While an equilaterally triangular handle 12 having three vertices is shown, one of skill will recognize the invention is not so limited. Any closed loop having a fixed handle 12 may be used. An isosceles triangle, may be used or a closed loop having four or more sides may be used.

This geometry provides the benefit that as the contact surface 13 of the head 14 traces the target surface during the stroke, the grip of the handle 12 more rapidly approaches the window, decreasing the moment arm and increasing control.

Figure 19:
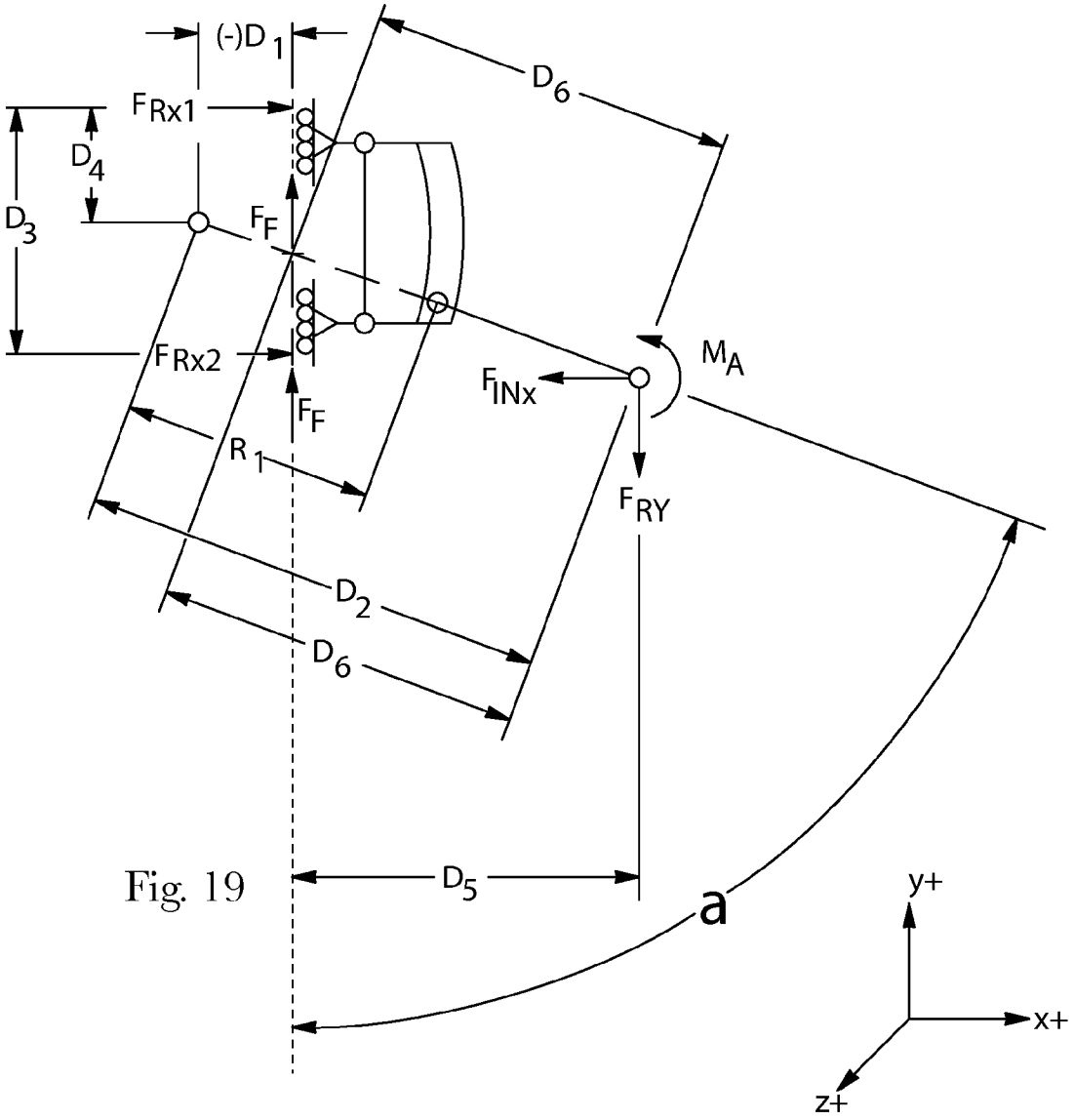
FIG. 19 is a free body diagram of the device of FIGS. 1-3.

Referring to FIG. 19, a free body diagram of the device 10 of FIGS. 1-3 is shown. This device 10 has the horizontal reaction forces at the two points on the contact surface 13 labeled as FRX1 and FRX2.

Figure 19A:
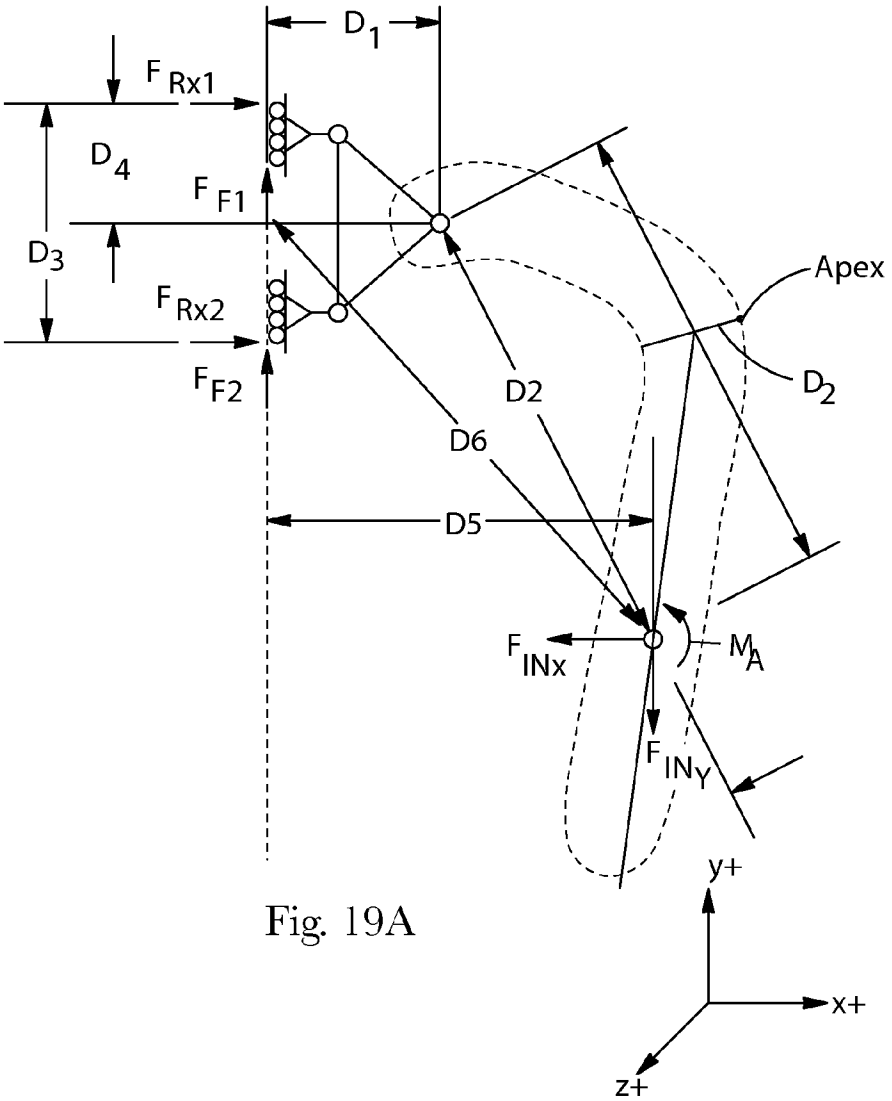
FIG. 19A is a generalized free body diagram, usable for analysis of the devices described and claimed herein.

Referring to FIG. 19A, a generalized free body diagram is shown, as usable for the representation of FIG. 19 and the other devices 10 described herein. Since all of the horizontal and vertical forces sum to zero, these forces are not shown. But since an applied moment is necessary to keep the head 14 in contact with the target surface, the applied moment is shown.

The dimensions and determinations of the device 10 geometry described and claimed herein are illustrated as being used with a device 10 being used against a flat and planar target surface. One of skill will recognize the invention is not so limited. The device 10 described and claimed herein can be used with a curvilinear target surface. While some of the dimensions described below are referenced to a target surface, e.g. parallel or perpendicular thereto, the device 10 is independent of the target surface and any placement thereagainst or use therewith.

The distances below are considered in profile, or perpendicular to an axis of rotation between the head 14 and handle 12. With reference to the Tables set forth in the figures, one of skill will recognize that angle alpha, D2, D5 and D6 change throughout the stroke. Conversely, D1, D3, D4 remain constant throughout the stroke.

As used herein, D1 is the distance from the pivot point between the head 14 and handle 12 and the contact surface 13 of the head 14, taken perpendicular to a target surface. If the center of rotation is behind the target surface, D1 is taken as the distance through and perpendicular the target surface to the contact surface 13 of the head 14. If the head 14 has two contact surfaces 13, the contact surfaces 13 are aligned so that both contact the target surface.

The D2 value is determined from this configuration. If the head 14 has three or more contact surfaces 13, and such contact surfaces 13 are not co-planar, the contact surface 13 which yields the greatest D2 value is considered.

No deformation of the contact surface 13 due to compression against the target surface is considered, as different users may apply different amounts of force against the target surface. The same user may apply different amounts of force at different portions of the same stroke and/or may apply different amounts of force on different strokes. Such different levels of force result in different amounts and degrees of deformation. Thus, for consistency, the distances considered herein are taken with the device 10 in its free state, and not under compressive forces.

D2 is taken as the distance from the pivot between the head 14 and handle 12 to the point on the handle 12 at which the moment is deemed to be applied. The point on the handle 12 at which the moment is deemed to be applied is called the effective midpoint of the handle 12, as set forth below.

D3 is the distance taken along a plane parallel to the target surface between the outer-most edges of the contact surface 13. If the head 14 has plural contact surfaces 13, D3 is taken as the greatest distance from between the outer-most edges of the outlying contact surfaces 13.

D4 is the distance taken along a plane parallel to the target surface between the outer-most edge of the contact surface 13 to the pivot between the head 14 and handle 12. If the head 14 has plural contact surfaces 13, D4 is taken as the greatest distance from between the outer-most edge of the outlying contact surface 13 furthest from the handle 12 taken towards the top of the device 10.

D5 is the distance from the effective midpoint on the handle 12 (at which point the moment is deemed to be applied) to the outermost edge of the contact surface 13. This distance is taken perpendicular to the target surface.

D6 is the distance from the effective midpoint on the handle 12 (at which point the moment is deemed to be applied) to the point on a target surface halfway between the contact surfaces 13 of the head 14. If the head 14 has only a single contact surface 13, this point is taken as the center of that contact surface 13.

Angle Alpha is the arc through which the handle 12 swings during a single stroke. This angle is measured from the portion of the target surface in the direction in which the device 10 is moved towards during use. For a typical user cleaning a vertical window, it will be assumed the user starts at the top of the window and moves the device 10 downward during a stroke. Thus, angle Alpha is the angle between two lines. The first line is between the pivot or center of rotation between the head 14 and handle 12 and the point on the handle 12 at which the moment is deemed to be applied by the user. The second line is the plane formed by target surface. One of skill will recognize two supplementary angles are potentially defined by the target surface. Angle Alpha is chosen as the angle which increases during the stroke.

The moment applied by the user's hand is taken as counterclockwise in the figures and labeled MA. A unit force input at the position of, and taken in the direction towards the target surface at FX, is utilized for this disclosure. The moment is deemed to be applied at the effective midpoint of the handle 12.

The effective midpoint of the handle 12 is taken as the point on the handle 12 halfway between the apex of the handle 12 and the distal end of the handle 12. If the handle 12 has multiple curves, and therefore multiple apices, the apex closest to the head 14 is considered for determining this distance.

All kinematic analyses described hereunder were performed using Excel® to automate the calculations. Commercially available software, such as COSMOS® software, available from SolidWorks® Corporation of Concord, Mass. may also be utilized. All kinematic analyses hereunder were subject to the following boundary conditions, unless specifically stated otherwise: rigid body motion, constant head 14 velocity during the stroke, constant horizontal input force of 1 unit throughout the stroke, and a frictionless pivot between the handle 12 and head 14.

Figure 20D:
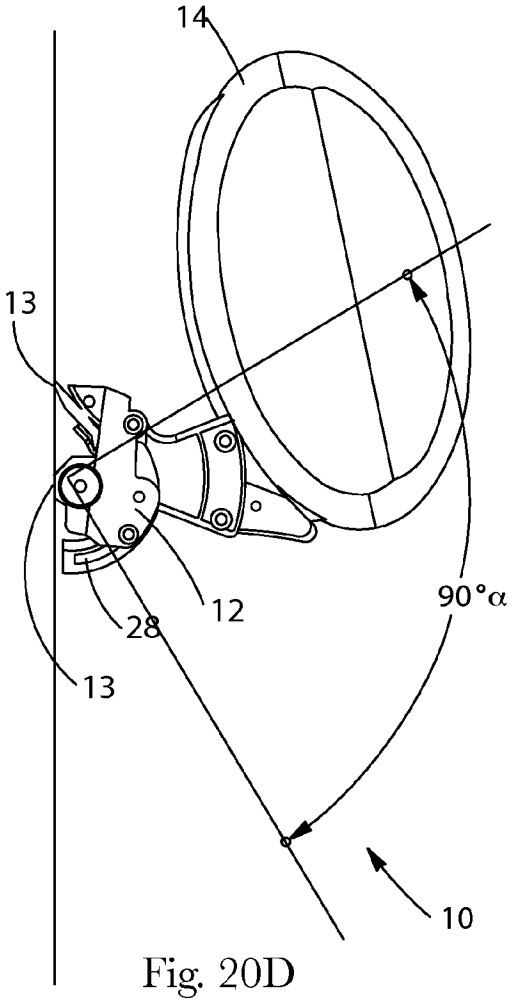
FIG. 20D is a side elevational view of the device of FIG. 20A, showing an illustrative 90 degree subtended device angle without encountering forearm instability.
Figure 20C:
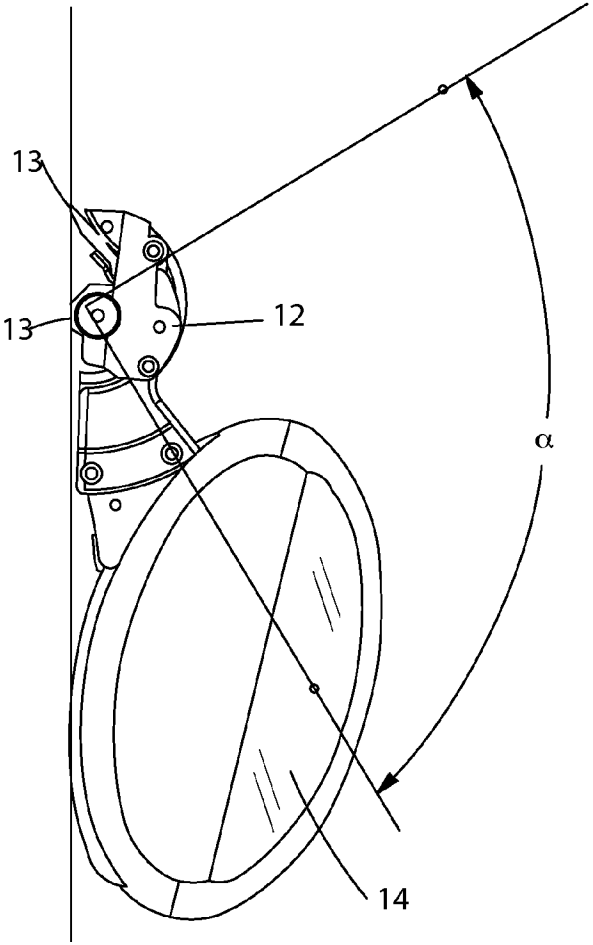
FIG. 20C is a side elevational view of the device of FIGS. 20A-20B, shown in an illustrative starting position near the top of a vertically oriented target surface.

Referring to FIGS. 20A-20B, the device 10 is shown in its initial position and final position, respectively. The initial position starts with the handle 12 at an angle of 39° degrees relative to the lower portion of the target surface towards which the device 10 is moved during use. The final position has the handle 12 in an angle of 141° measured the same way. Thus, in a single stroke the handle 12 swings through an arc of 102° from the point of contact below the head 14 to a different point of contact above the head 14.

Referring to FIGS. 20A, 20B, 20C, 20D, 21A, 21B, 21C, 21D, 21E, 21F and 21G, if desired, a gear train 24 may be interposed between the head 14 and handle 12 of a device 10 having a rack gear 20 on one of these components. The second rack gear 20 may be disposed on the other component and in complementary and operative relationship therewith. Such a system may have two convex complementary rack gears 20, disposed in facing relationship with one or gears therebetween. The first rack gear 20 may be disposed on the head 14 and the second rack gear 20 may be disposed on the handle 12.

The gear train 24 may comprise plural gears, as shown. Alternatively, the gear train 24 may comprise a single gear. In either case, the gear train 24 serves as a transmission 25 between the first rack gear 20 and the second rack gear 20. The transmission 25 allows the head 14 and handle 12 of the device 10 to move further in relationship to one another than would occur if a single rack gear 20 or a single track 28/slider 26 arrangement were used. Particularly, the transmission 25 allows the handle 12 and head 14 to change in angular relationship to one another as the handle 12 moves through the arc on the head 14.

Thus two angular relationships change during the stroke of this device 10. The absolute position of the handle 12 and head 14 change relative to each other. And the angular position of the handle 12 and head 14 change relative to each other change as the absolute position changes.

This arrangement provides for controlled slippage in the relative movement between the head 14 and handle 12. The interposed gear train 24 provides the benefit that compound relative movement between the head 14 and handle 12 allows a greater range of motion during the stroke.

The greater range of motion provides for the device 10 angle to subtend more than 30, 35, 40, 50, 60, 70, 80, 90, 100, 120, 130 or 140 degrees before forearm instability is reached. The range of motion for the device 10 angle before forearm instability is reached may be less than 180, 170, 160 or 150 degrees. As the range of motion prior to forearm instability increases, the amount of user control improves. A longer stroke may occur without passing through a region of instability. As the stroke length increases, a greater surface area may be cleaned without passing through a region of instability. By not having instability occur during the stroke, the cleaning, or other treatment, of the target surface improves throughout the area under consideration.

Figure 21A:
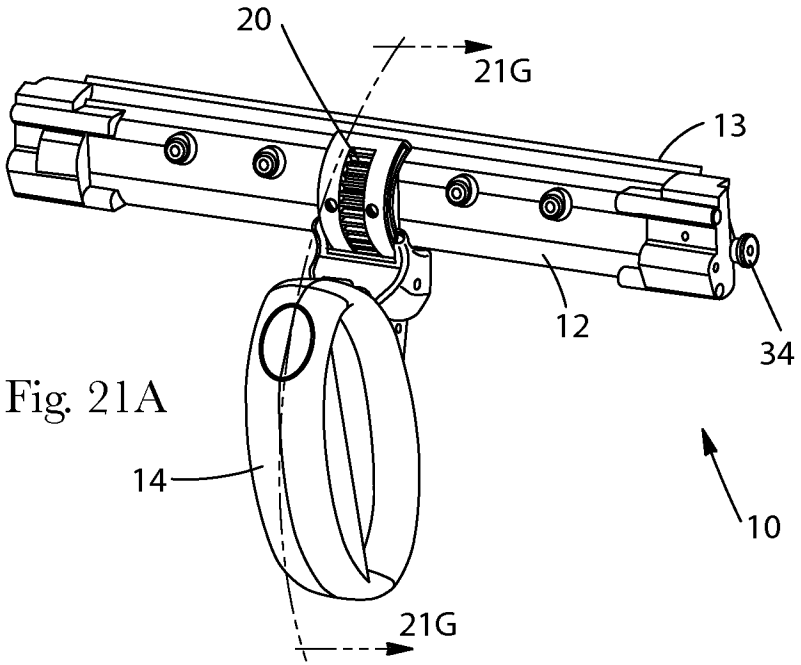
FIG. 21A is a rear perspective view of the device of FIGS. 20A-20D.
Figure 21B:
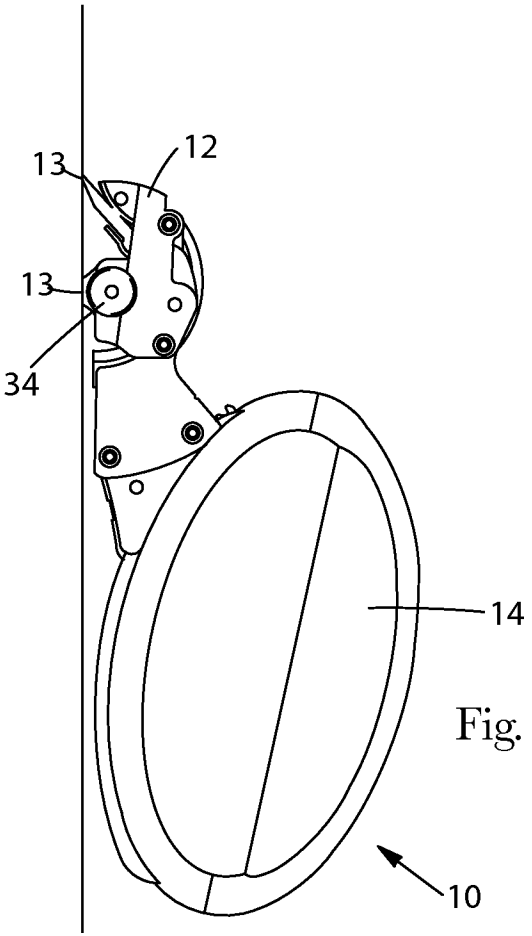
FIG. 21B is a side elevational view of the device of FIG. 21A.
Figure 21C:
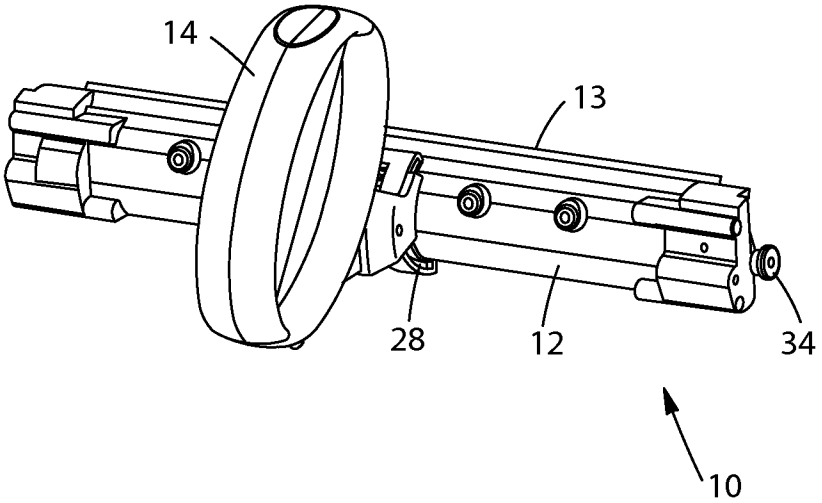
FIG. 21C is a rear perspective view of the device of FIG. 21A, having the handle and head in an intermediate position relative to each other.
Figure 21D:
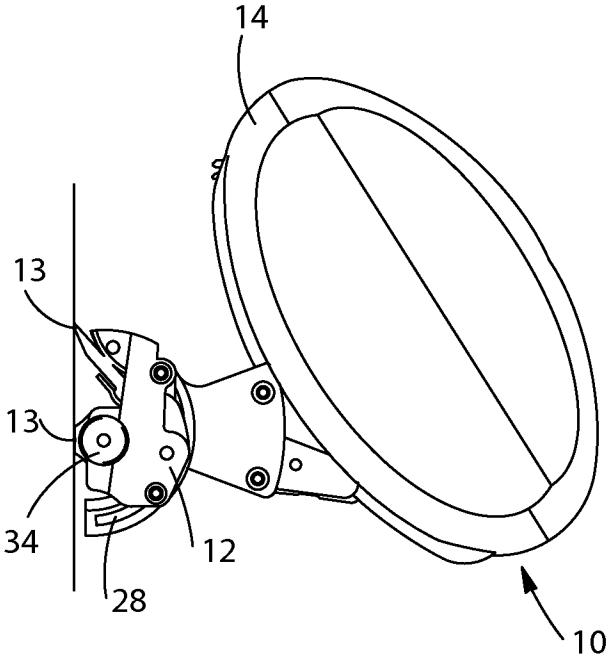
FIG. 21D is a side elevational view of the device of FIG. 21C.
Figure 21E:
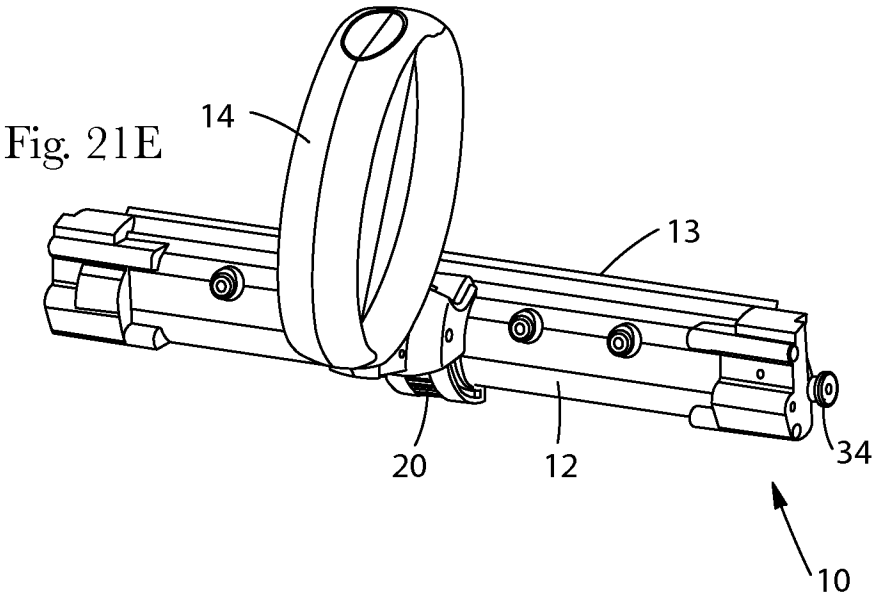
FIG. 21E is a rear perspective view of the device of FIG. 21A, having the handle and head in a more advanced position relative to each other.
Figure 21F:
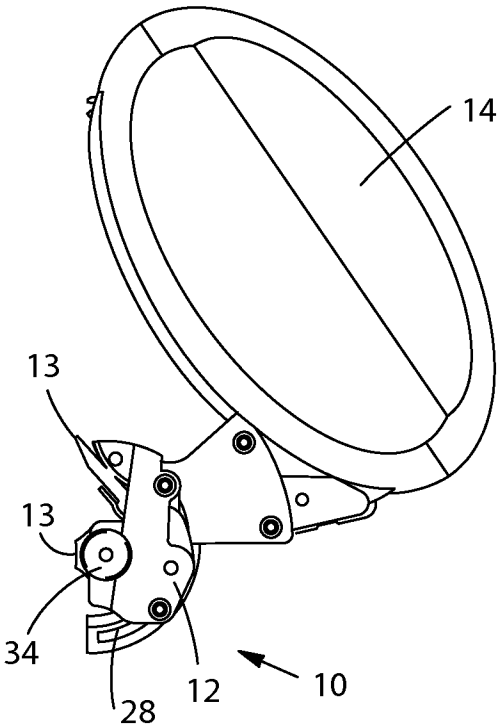
FIG. 21F is a side elevational view of the device of FIG. 21E.
Figure 21H:
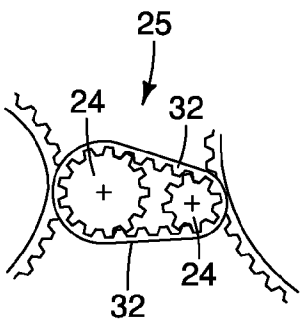
FIG. 21H a fragmentary side elevational view of an alternative transmission, usable with the device of FIGS. 21A-G.
Figure 21G:
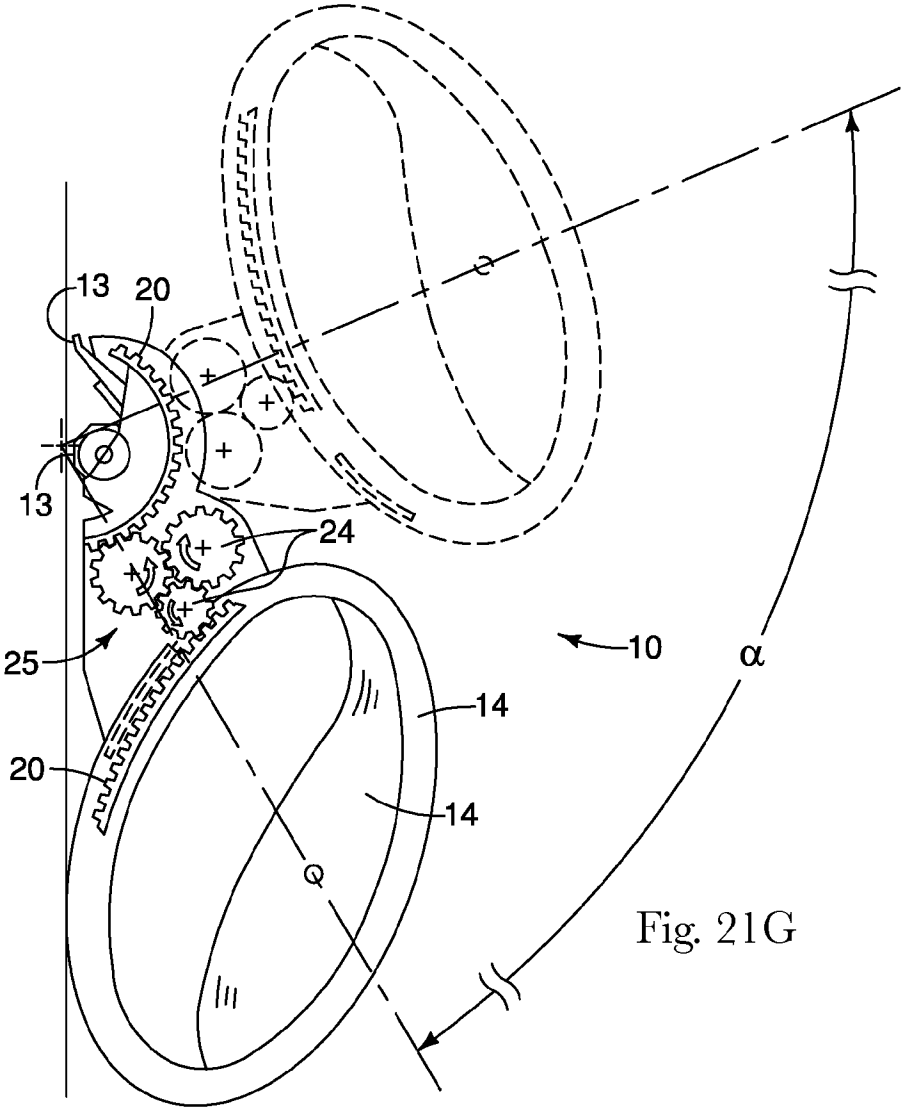
FIG. 21G is a vertical sectional view of the device of FIGS. 21A-21F, showing the head/handle relationship of FIG. 21B in solid lines and the head/handle relationship of FIG. 21F in dashed lines, taken along lines 21G-21G of FIG. 21A.

Referring to FIG. 21H, if desired the transmission 25 may comprise a belt drive 32. The belt drive 32 provides for compound differential movement between the head 14 and handle 12. I.e. the head 14 and handle 12 can move in absolute position and in angular relationship to each other with such a transmission 25 intermediate the head 14 and handle 12.

Figure 22:
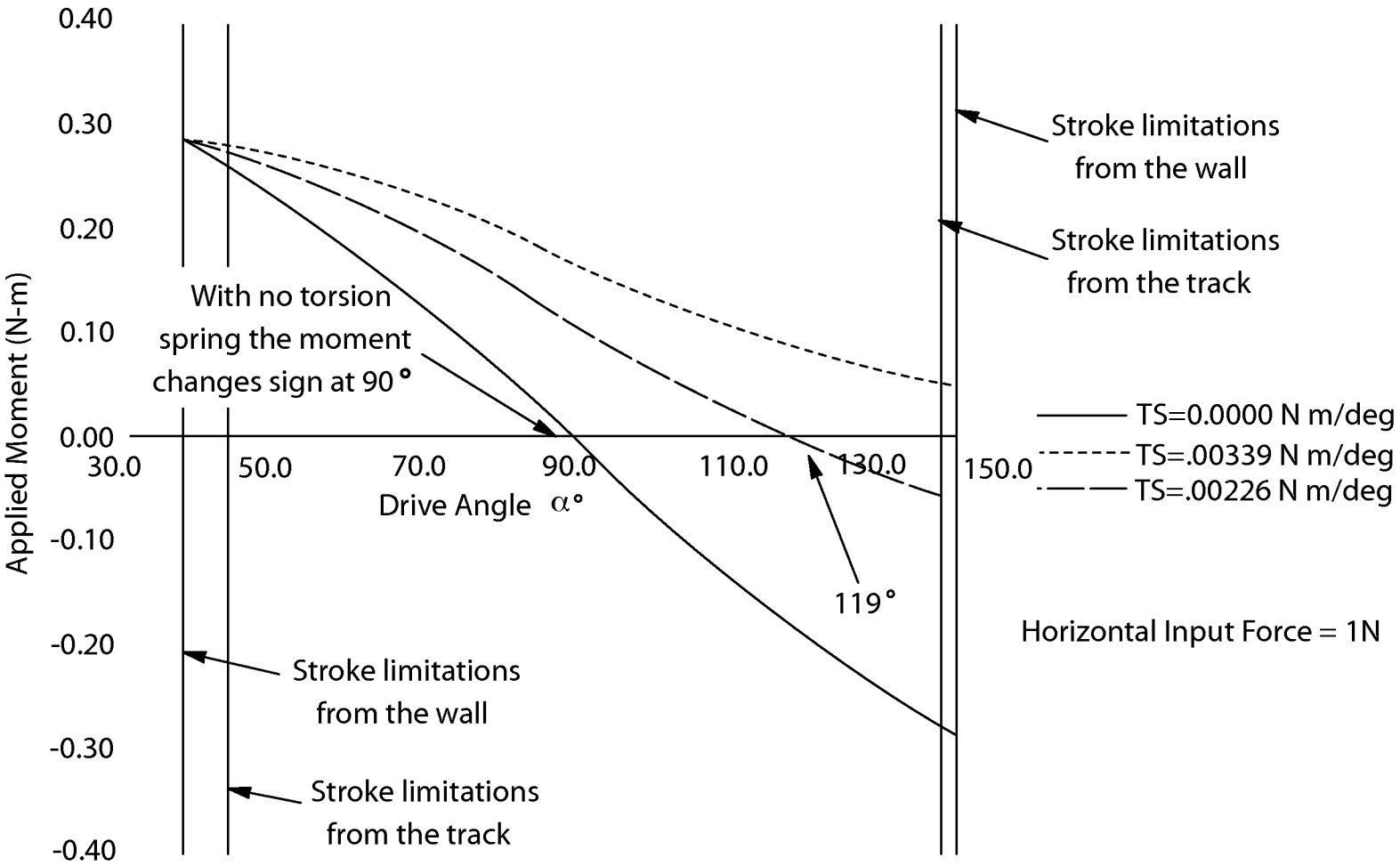
FIG. 22 is a graphical relationship of the applied moment for a unit force input normal to the target surface of the device of FIGS. 20-21 showing the influence of a torsional spring between the handle and the head, assuming no friction against the target surface.
Figure 23:
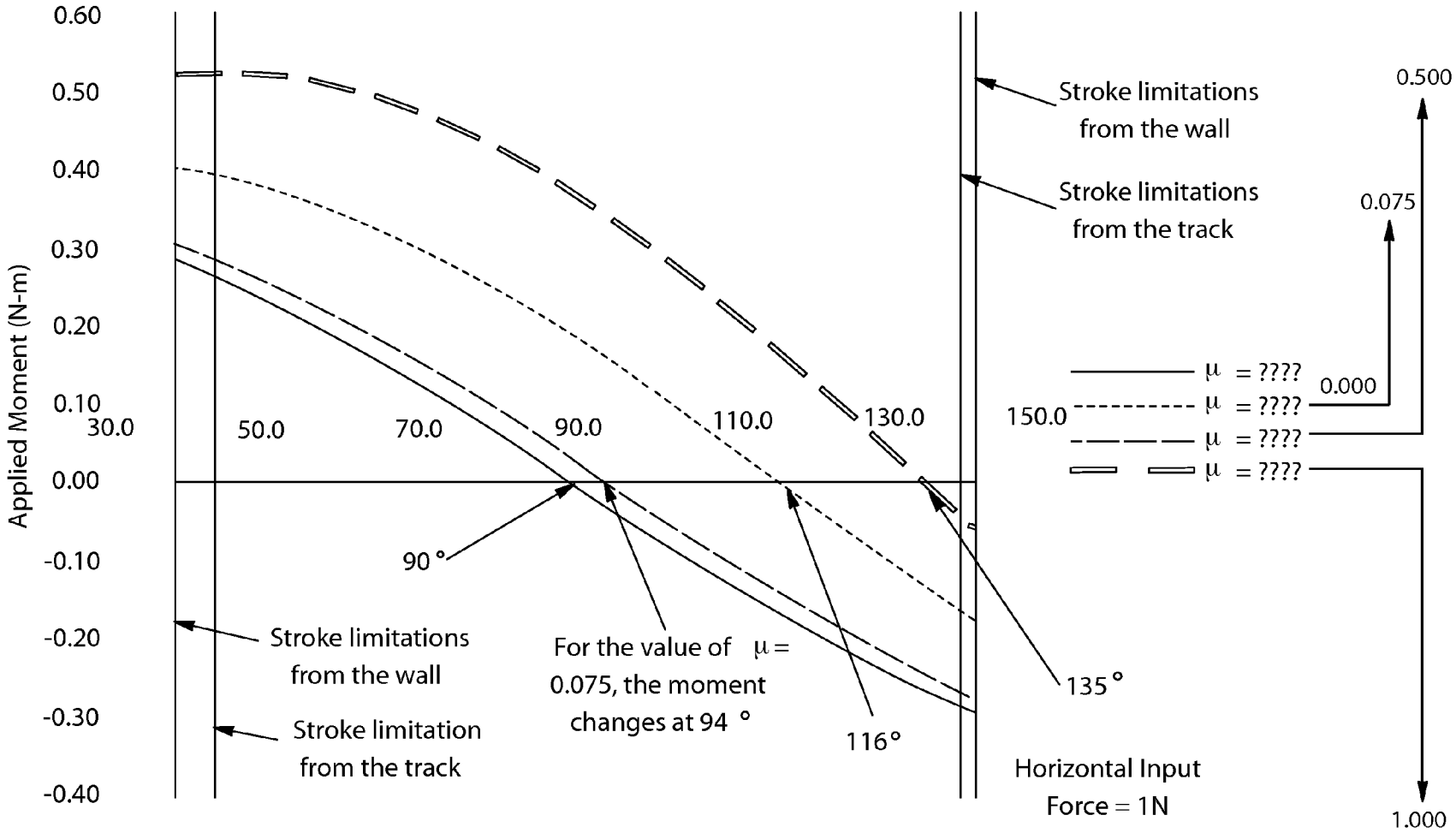
FIG. 23 is a graphical relationship of the applied moment for a unit force input normal to the target surface of the device of FIGS. 20-21 showing the influence of a friction between the head and the target surface, assuming no torsional spring.

Referring to FIGS. 22-23, the device 10 represented in FIG. 19 is analyzed using the commercially available kinematic simulation software. This analysis assumed no friction for the simulation of FIG. 22 and no spring force for the simulation of FIG. 23.

Referring to FIG. 22, three different moment curves showing the resulting moment, taken at MA are shown. The three curves show the effect of an optional torsional spring inserted between the handle 12 and head 14 to provide a force resisting the rotation of the handle 12 relative to the head 14 during use.

The first, or upper, curve is a control showing no added spring forth between the handle 12 and head 14. The moment is always positive, taken as occurring in the counterclockwise direction. The moment decreases from 0.28 to 0.5 in use over the 102° stroke.

In the first trial, adding a torsional spring of 0.0023 Newton×meters per degree does not change the moment at the starting point. However, the moment does inflect from positive to negative at 119°. In the second trial. increasing the spring force to 0.0034 Newton×meters per degree likewise does not change the moment at the starting point. However, the moment does inflect from positive to negative at 90°. The magnitude of the negative moment, unpredictably, increases by a factor of more than five relative to the first trial.

Thus, it can be seen there is a trade-off between the amount of stroke the user can encounter before the moment inflects from positive to negative and the magnitude of the final moment. If the user desires to maintain a moment which does not inflect that is also possible. However, a device 10 which inflects the moment from positive to negative earlier in the stroke will result in a greater moment applied by the user at the end of the stroke.

Referring to FIG. 23, the analysis is repeated assuming different frictional resistances between the head 14 and the target surface. The lowermost curve is the control, and run at zero friction. This curve shows a starting moment of approximately 0.28 and a final moment of approximately −0.30 Newton×meters. The inflection between positive and negative moment occurs at 90°. However, a device 10 with zero friction is probably unrealistic.

The first trial assumed a frictional resistance of 0.075. The initial applied moment increased to 0.31 and the final applied moment decreased to approximately −0.27 Newton×meters with inflection at 94°. Thus, the frictional effect on moment was not significant.

The second trial increased the frictional resistance to 0.500. Not surprisingly, the initial applied moment increased to 0.4 but the final moment decreased to approximately 0.16

Newton×meters with inflection at 116°. Thus, the effect of friction can be seen to increase the starting force and therefore starting moment necessary to move the device 10 relative to the target surface however, the increased friction the delays inflection of the sense (sign) of the moment from positive to negative.

The third trial confirms the trend seen between the first and second trials. The third trial increases the frictional force to 1.000. The initial moment increases to approximately 0.53 and remains at approximately that level for approximately 10° before declining, and inflecting to negative at 135°. The final moment is approximately −0.04. Thus, it can be seen there is a trade-off between the magnitude of the starting moment and the amount of stroke the user can encounter before inversion of the sense of the moment from positive to negative.

Figure 25:
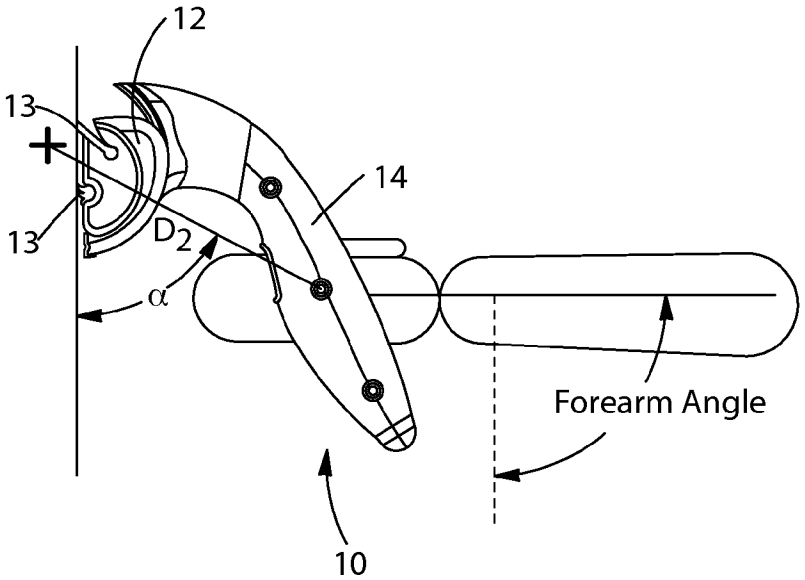
FIG. 25 is a side elevational view of the device, wrist and grip of FIG. 24 with the force applied to through the user's wrist and forearm being perpendicular to the target surface.
Figure 24:
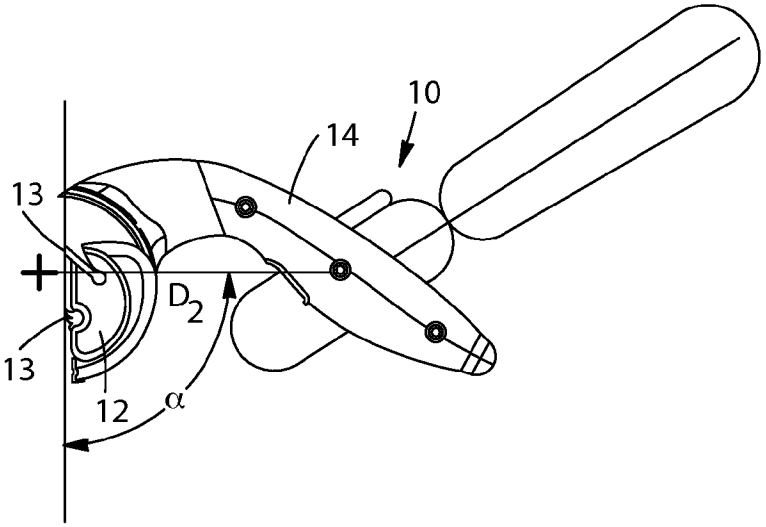
FIG. 24 is a side elevational view of the device of FIG. 17 and a schematic wrist and grip of a user with the force applied through the handle being perpendicular to the target surface.

Referring to FIGS. 24-25, it has been found that the device 10 may not identically match the forearm angle of the user. The forearm angle is the angle the forearm makes relative to the handle 12. The forearm angle is significant to the performance of the devices 10 described and claimed herein, as it has been unexpectedly found that instability results as the forearm angle passes through a line perpendicular to the target surface.

I.e. when the forearm angle is normal to the target surface, unexpectedly the device 10 may chatter and encounter instability in use. Thus, as discussed below, it would be advantageous to have a device 10 providing a relatively long stroke, before the forearm angle reaches the perpendicular.

Forearm angle is determined for a particular device 10 as follows. The Department of Defense Handbook for Human Engineering Guidelines, MIL-HDBK-759C, 1991, pp. 139-140, shows that a human typically grips a device 10 such as described and claimed herein at a grip angle ranging from 95 to 109 degrees, with 102 degrees being average and used herein unless otherwise specified.

Referring to FIGS. 24-29, the forearm angle is determined as follows. A line is drawn between the effective midpoint of the handle 12 and the distal end of the handle 12. A line subtending an angle of 102 degrees towards the bottom of the device 10 is drawn from this line and is called the forearm line in the associated figures. Articulation of the forearm line subtends the forearm angle.

FIG. 24 shows that when the device 10 angle is perpendicular to the target surface, the forearm may be above the perpendicular and in acute or obtuse angular relationship relative to the target surface. In this situation, instability in use may result, due to the device 10 angle being normal to the target surface.

FIG. 25 shows a different form of instability. In FIG. 25, the forearm angle is normal to the target surface. But the device 10 angle is acute. Thus, one may wish to coordinate the relationship between the device 10 and the forearm angle during use.

Figure 27:
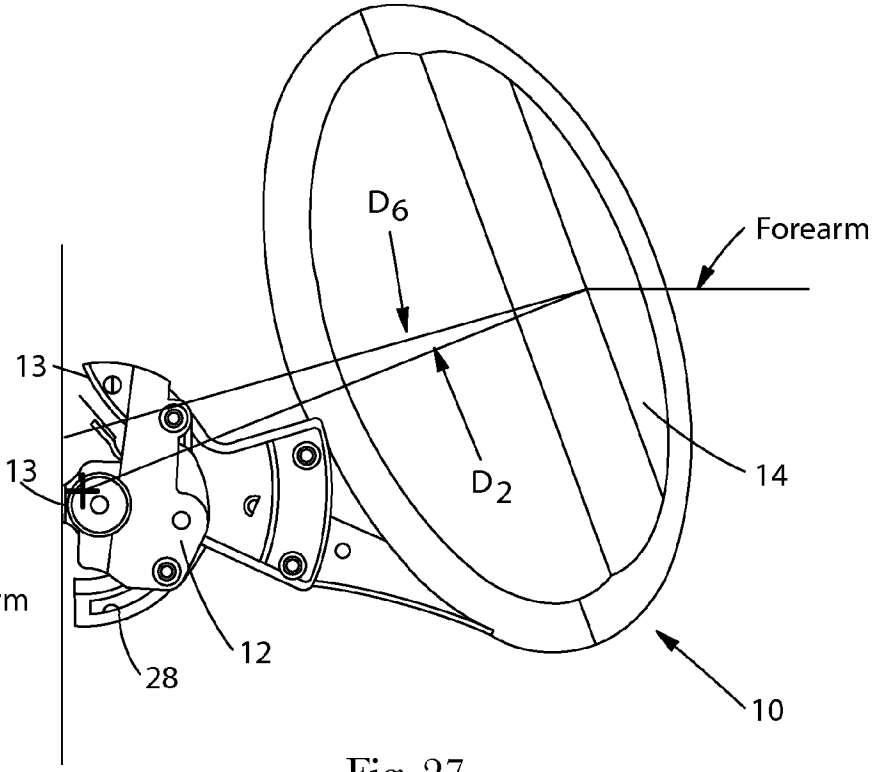
FIG. 27 is a side elevational view of the device of FIGS. 1-3 with the force applied to through the user's wrist being perpendicular to the target surface and showing the effective handle length and the distance from the effective midpoint of the handle to the point on the target surface midway between the two contact points of the device head.
Figure 26:
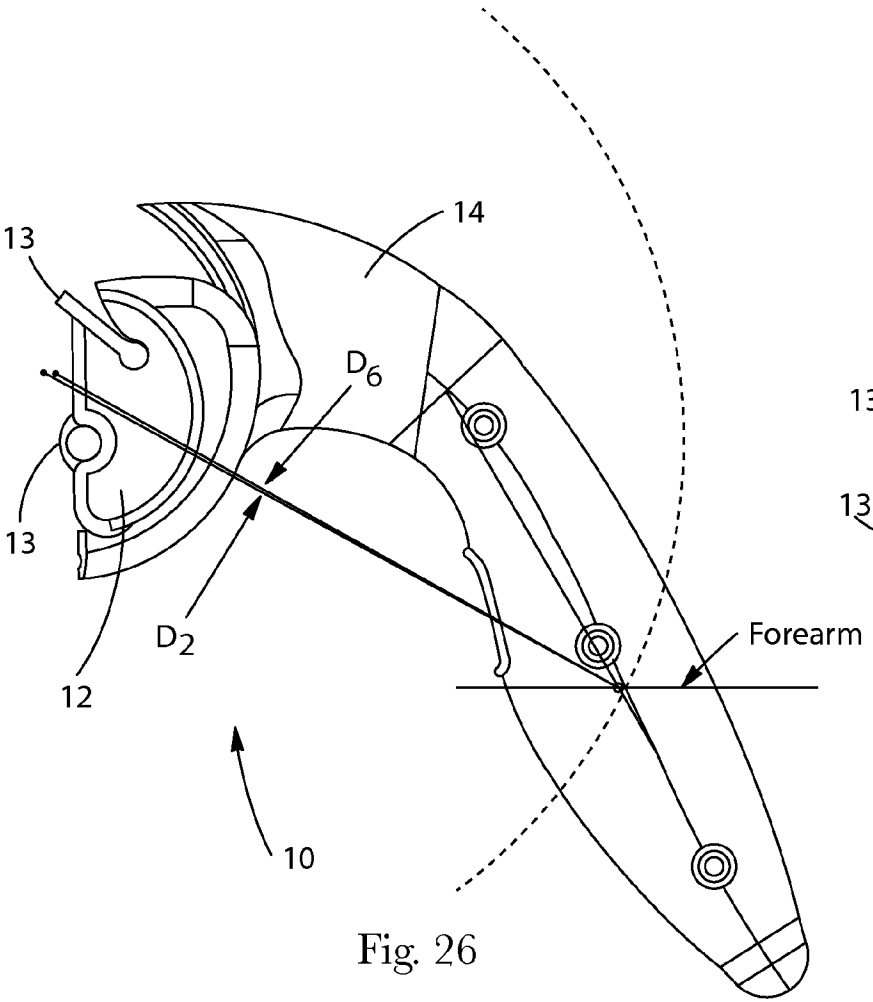
FIG. 26 is a side elevational view of the device of FIGS. 17 and 24-25 with the force applied to through the user's wrist being perpendicular to the target surface and showing the effective handle length and the distance from the effective midpoint of handle to the point on the target surface midway between the two contact points of the device head.
Figure 28:
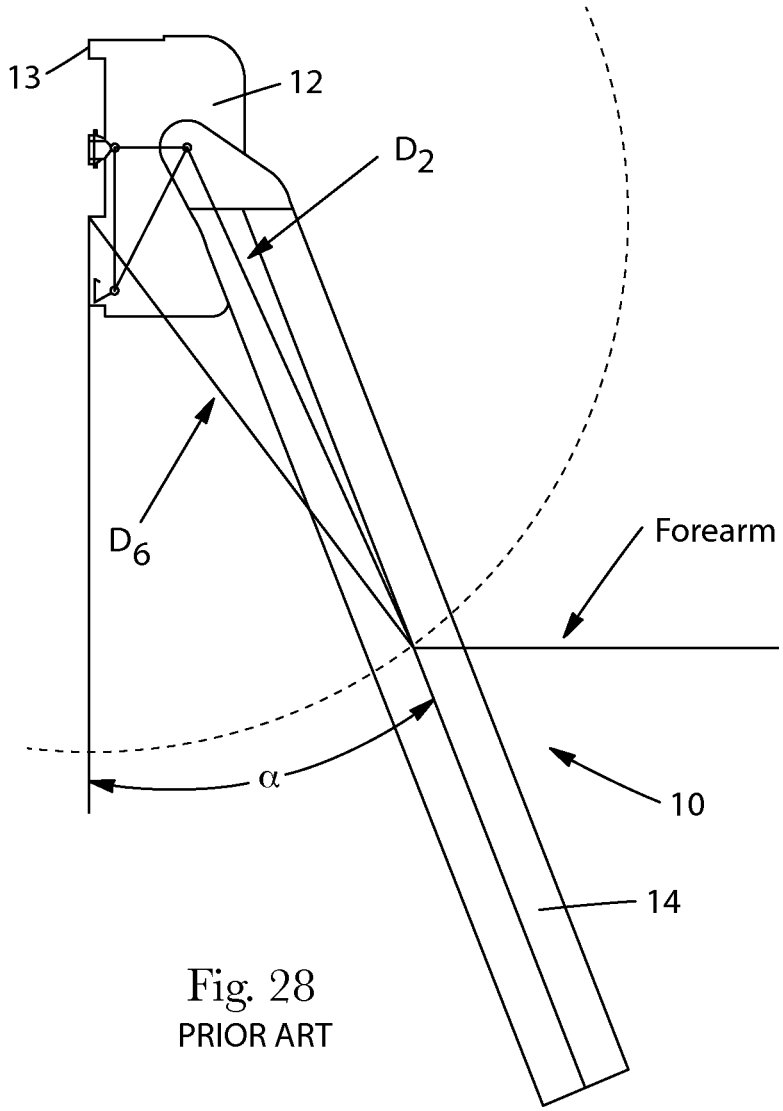
Fig. 28 PRIOR ART
FIG. 28 is a side elevational view of a prior art device, taken from the patent literature, with the force applied to through the user's wrist being perpendicular to the target surface and showing the effective handle length and the distance from the effective midpoint of the handle to the point on the target surface midway between the two contact points of the device head.

FIG. 26 shows that for the device 10 of FIG. 17, when the forearm angle is normal to the target surface, the device 10 angle is acute below the perpendicular. Conversely, FIG. 27 shows that for the device 10 of FIGS. 1-3, when the forearm angle is normal to the target surface, the device 10 angle is acute above the perpendicular.

Figure 29:
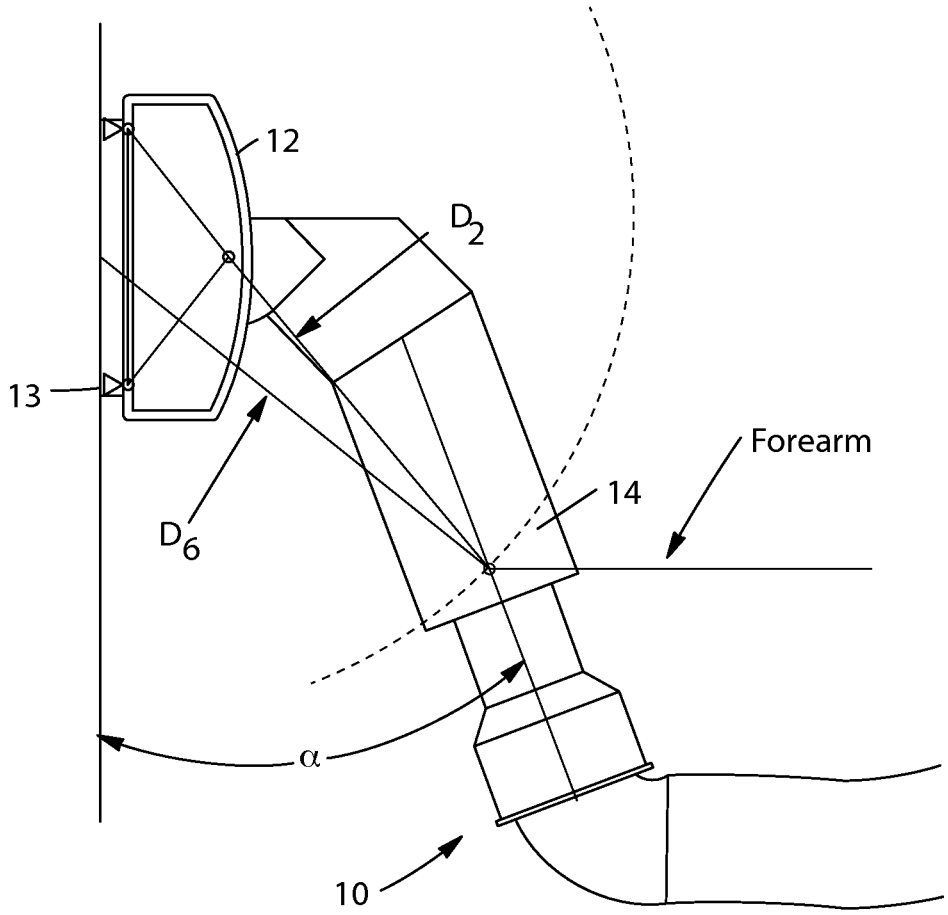
Fig. 29 PRIOR ART
FIG. 29 is a side elevational view of a commercially available prior art vacuum cleaner head device with the force applied to through the user's wrist being perpendicular to the target surface and showing the effective handle length and the distance from the effective midpoint of the handle to the point on the target surface midway between the two contact points of the device head.
Figure 29C:
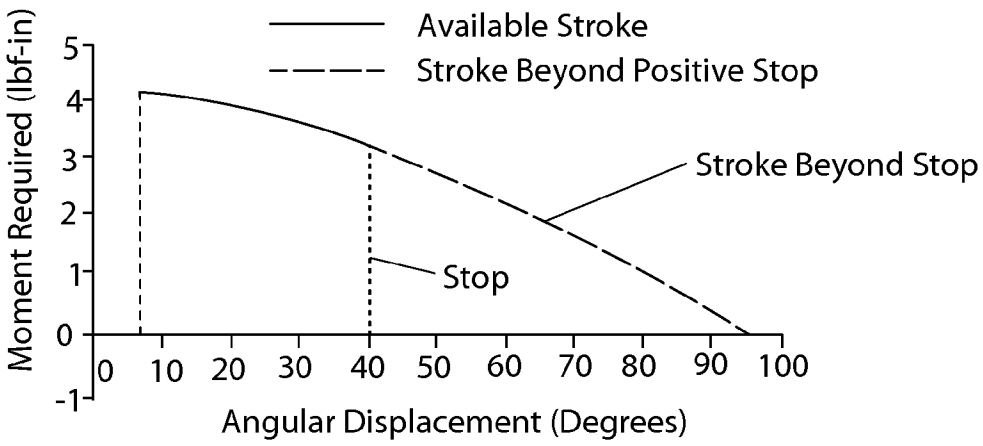
Fig. 29C PRIOR ART
FIG. 29C is a graphical representation of the change in applied moment throughout the stroke of the device of FIG. 29B.
Figure 29B:
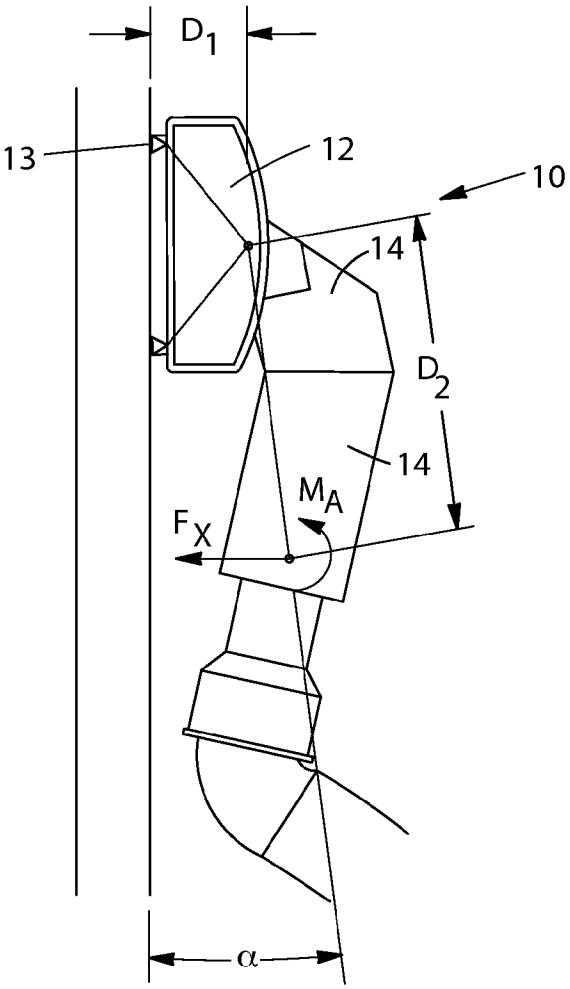
Fig. 29B PRIOR ART
FIG. 29B is a side elevational view of the device of FIG. 29 having a vacuum hose attached thereto, showing the point where the moment is applied to the device by the user.
Figure 29E:
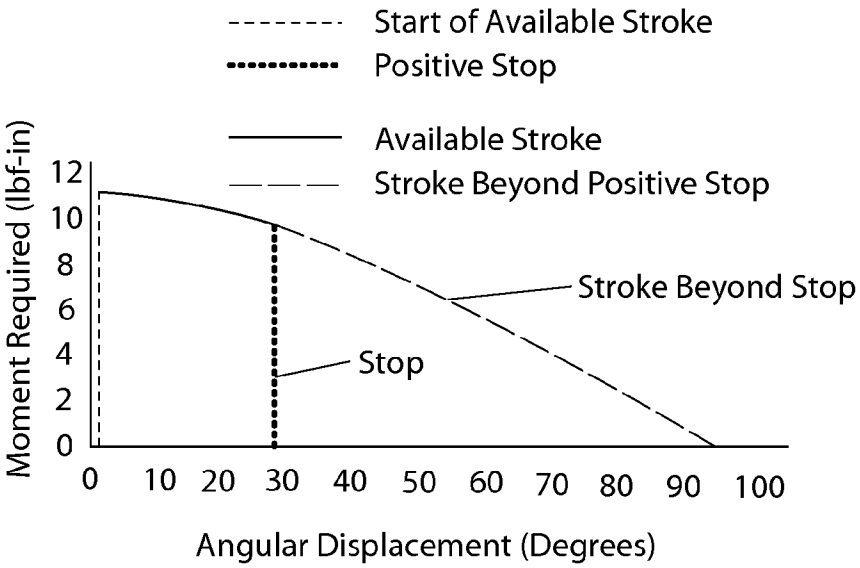
Fig. 29E PRIOR ART
FIG. 29E is a graphical representation of the change in applied moment throughout the stroke of the device of FIG. 29D.
Figure 29D:
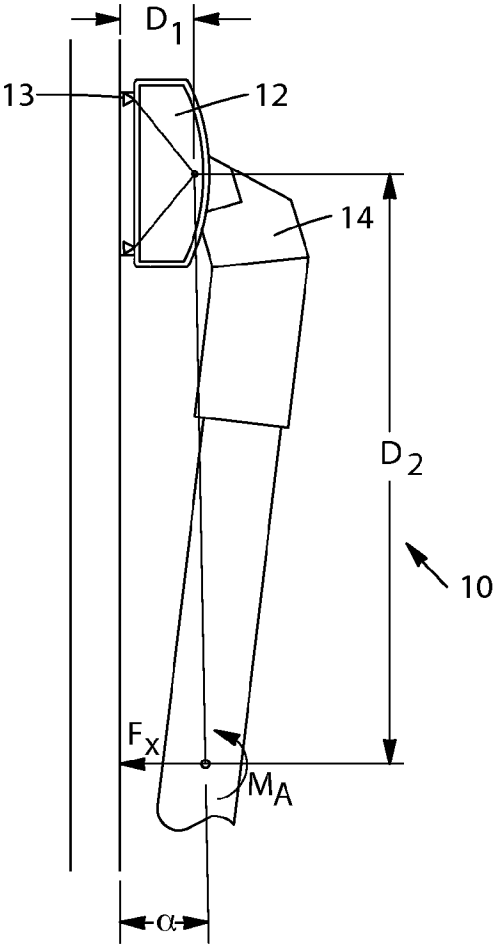
Fig. 29D PRIOR ART
FIG. 29D is a side elevational view of the device of FIG. 29 having an extension wand attached thereto, showing the point where the moment is applied to the device by the user.
Figure 29F:
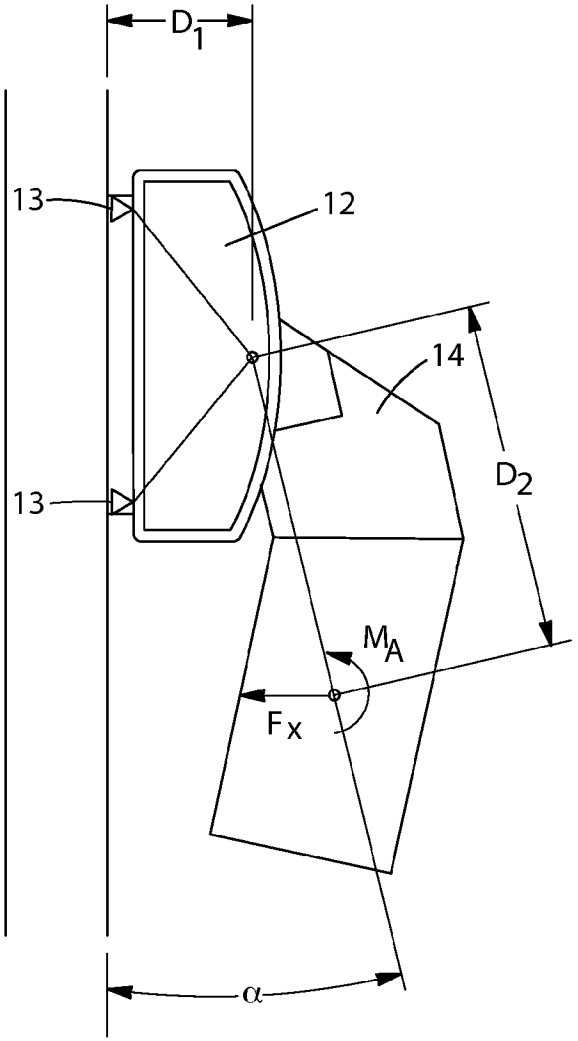
Fig. 29F PRIOR ART
FIG. 29F is a side elevational view of the device of FIG. 29 having no extension handle attached thereto, showing the point where the moment is applied to the device by the user.
Figure 29G:
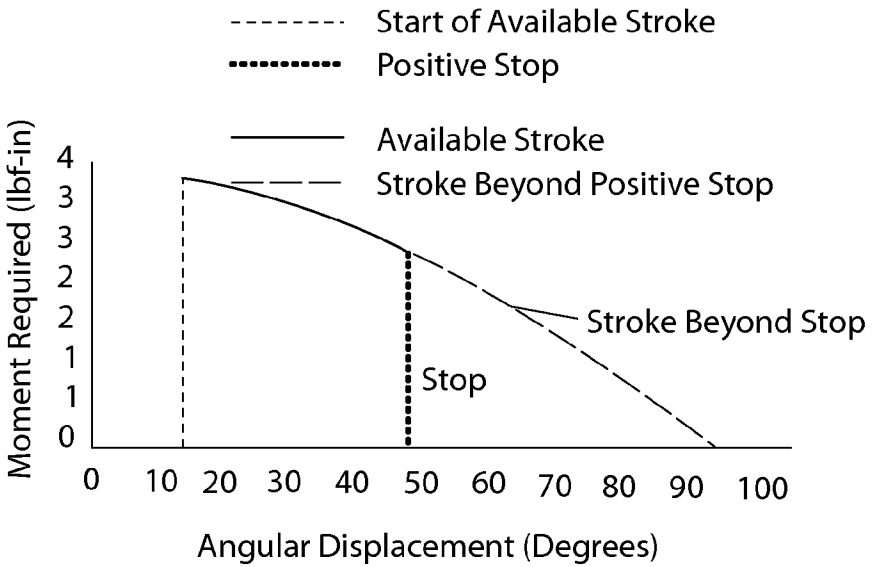
Fig. 29G PRIOR ART
FIG. 29G is a graphical representation of the change in applied moment throughout the stroke of the device of FIG. 29F.

Referring to FIGS. 28, 28A, 29 and 29A, two prior art devices 10 behave similarly to the device 10 of FIG. 26. That is, when the forearm angle is normal to the target surface, the device 10 angle is acute below the perpendicular. FIGS. 29B, 29D and 29F show the effect of various effective handles 12 for the device 10 of FIG. 29 on the free body diagram. FIGS. 29C, 29E and 29G show the effect of the various handles 12 of the devices 10 of FIGS. 29B, 29D and 29F, respectively on the moment applied by the user.

Figure 30:
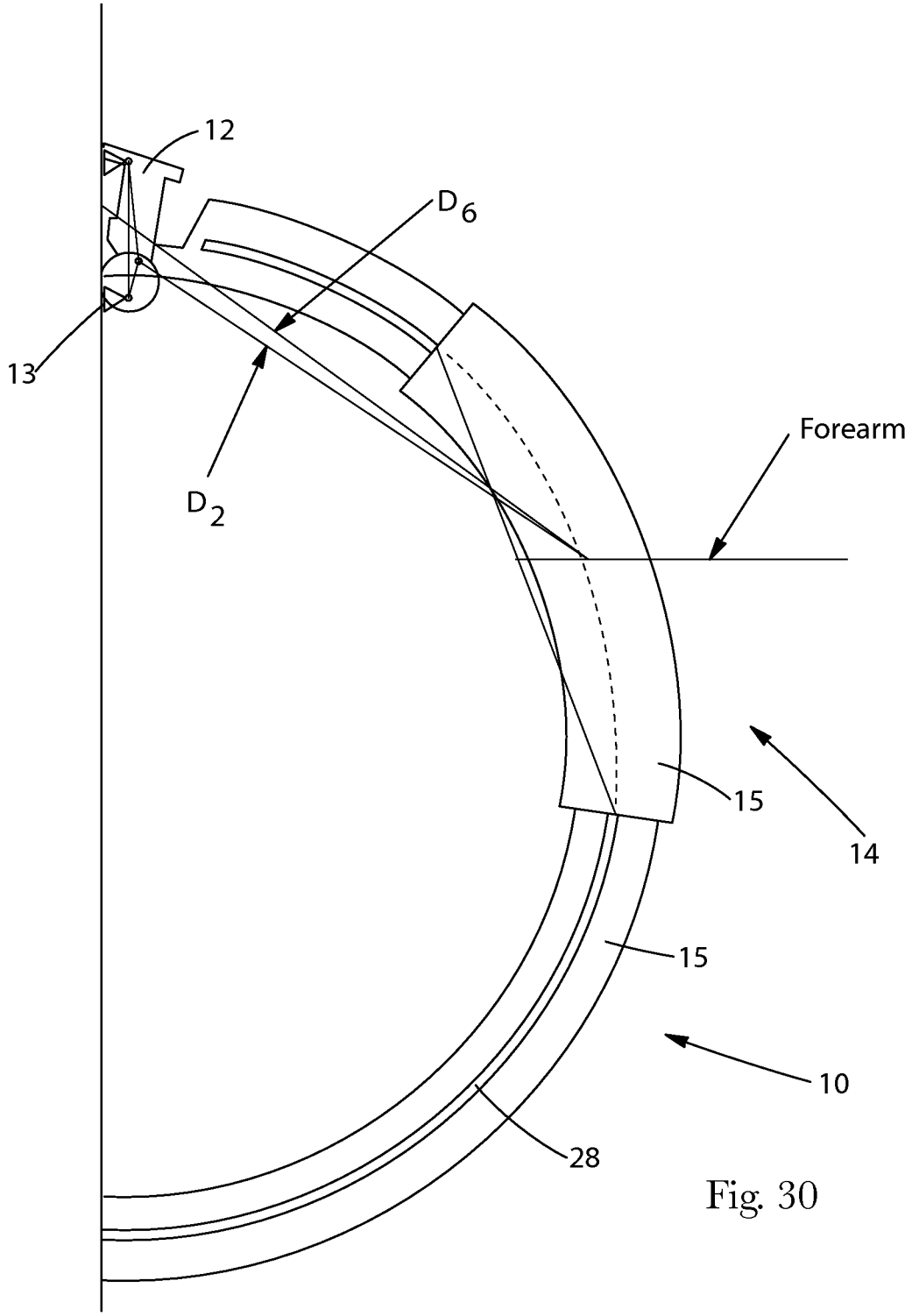
FIG. 30 is a side elevational view of the device of FIGS. 14-16 with the force applied to through the user's wrist being perpendicular to the target surface and showing the effective handle length and the distance from the effective midpoint of the handle to the point on the target surface midway between the two contact points of the device head.
Figure 30B:
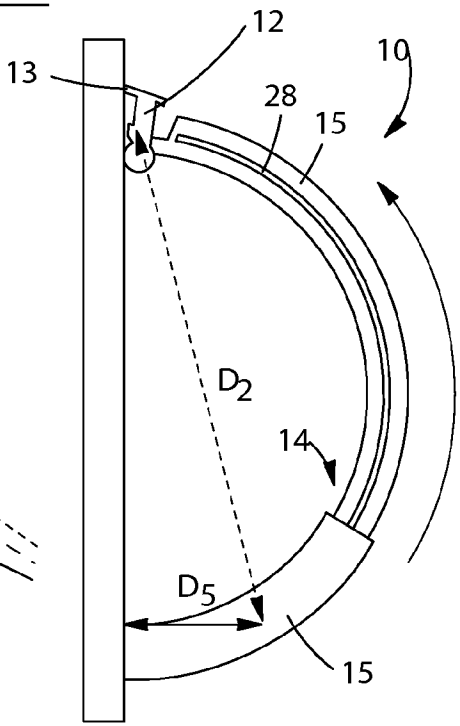
FIG. 30B is a side elevational view of the device analyzed in FIG. 30A, showing the D2 and D5 dimensions.
Figure 30A:
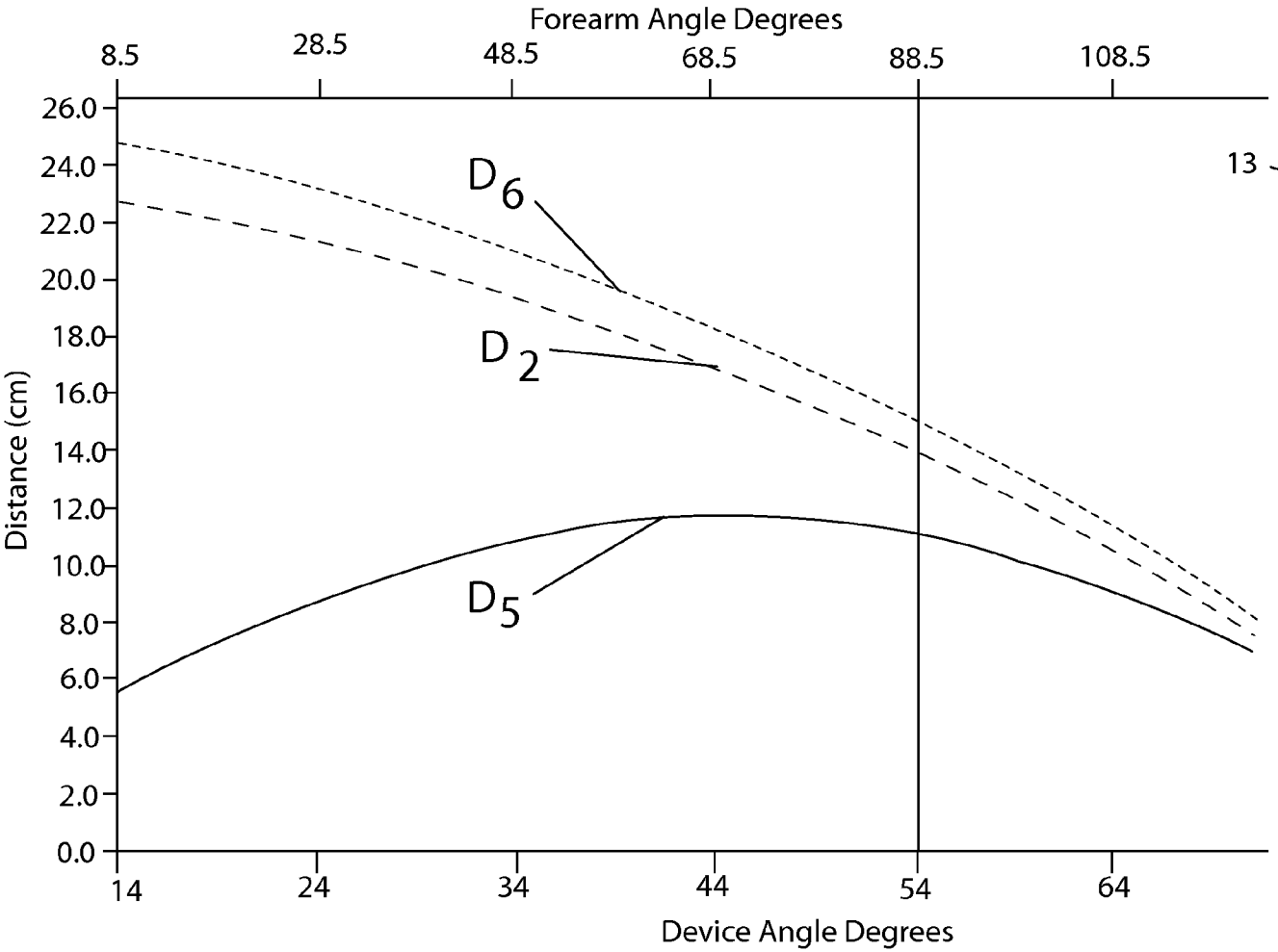
FIG. 30A is a graphical relationship of the effective handle length (D2), the perpendicular distance from the target surface to the effective midpoint of the handle (D5) and the distance from the effective midpoint of the handle to the point on the target surface midway between the two contact points of the device head (D6) as a function of device angle and forearm angle of the device of FIG. 30.

Referring to FIG. 30, when the forearm angle is normal to the target surface, the device 10 angle is acute below the perpendicular. Referring to FIGS. 30A and 30B and examining the device 10 of FIG. 30 more closely, it can be seen that the device 10 angle and forearm do not equally increase throughout the stroke. Further, it can be seen that the effective handle 12 length (D2), and the distance from the effective midpoint of the handle 12 to the point on the target surface midway between the two contact points of the device 10 head 14 (D6) monotonically decrease as a function of both device 10 angle and forearm angle.

The perpendicular distance from the target surface to the effective midpoint of the handle 12 (D5) changes slope during the stroke and as a function of device 10 angle and forearm angle of that device 10. This distance is identical to the distance from the effective midpoint of the handle 12 to the outwardly facing contact surfaces 13 of the head 14 (also D5).

Referring to FIGS. 31A, 31B, 31C and 31D, yet another device 10 is shown. In this device 10, the when the forearm angle is normal to the target surface, the device 10 angle is likewise acute below the perpendicular.

Thus, it can be seen that the device 10 of FIG. 27 unexpectedly exhibits qualitatively different performance than the devices 10 of the prior art. Particularly, the device 10 of FIG. 27 has an acute device 10 angle above the perpendicular when the forearm angle is normal to the surface.

Figure 32:
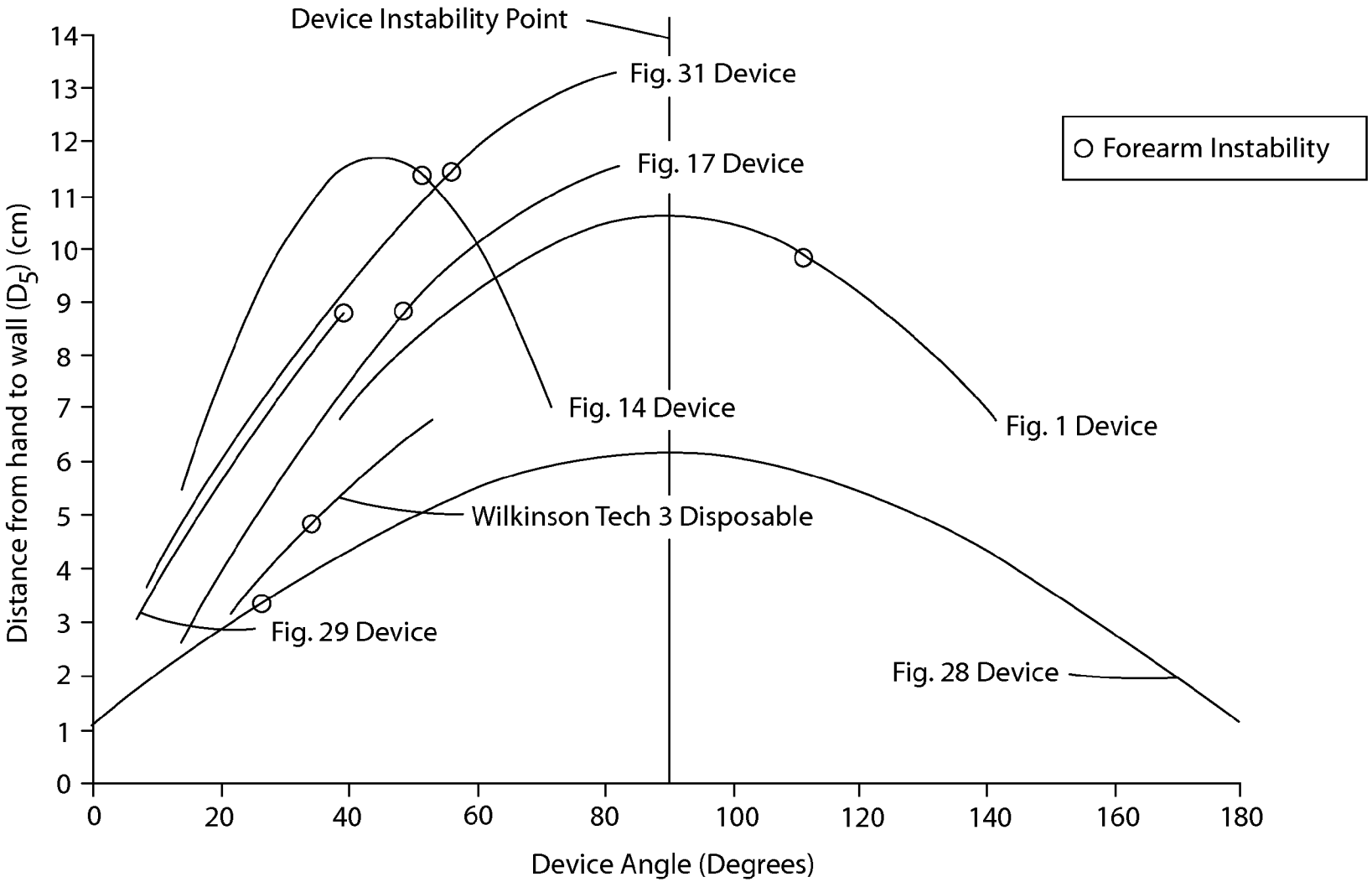
FIG. 32 is a graphical relationship of various devices showing the perpendicular distance from the target surface to the effective midpoint of the handle (D5) as a function of the angle of the handle relative to the target surface (Device Angle).

Referring to FIG. 32, the change in the perpendicular distance from the target surface to the effective midpoint of the handle 12 (D5) during the stroke as a function of device 10 angle is shown Particularly, this distance either monotonically increases or increases, then decreases, at or before the 90 degree angle of device 10 instability.

Figure 31:
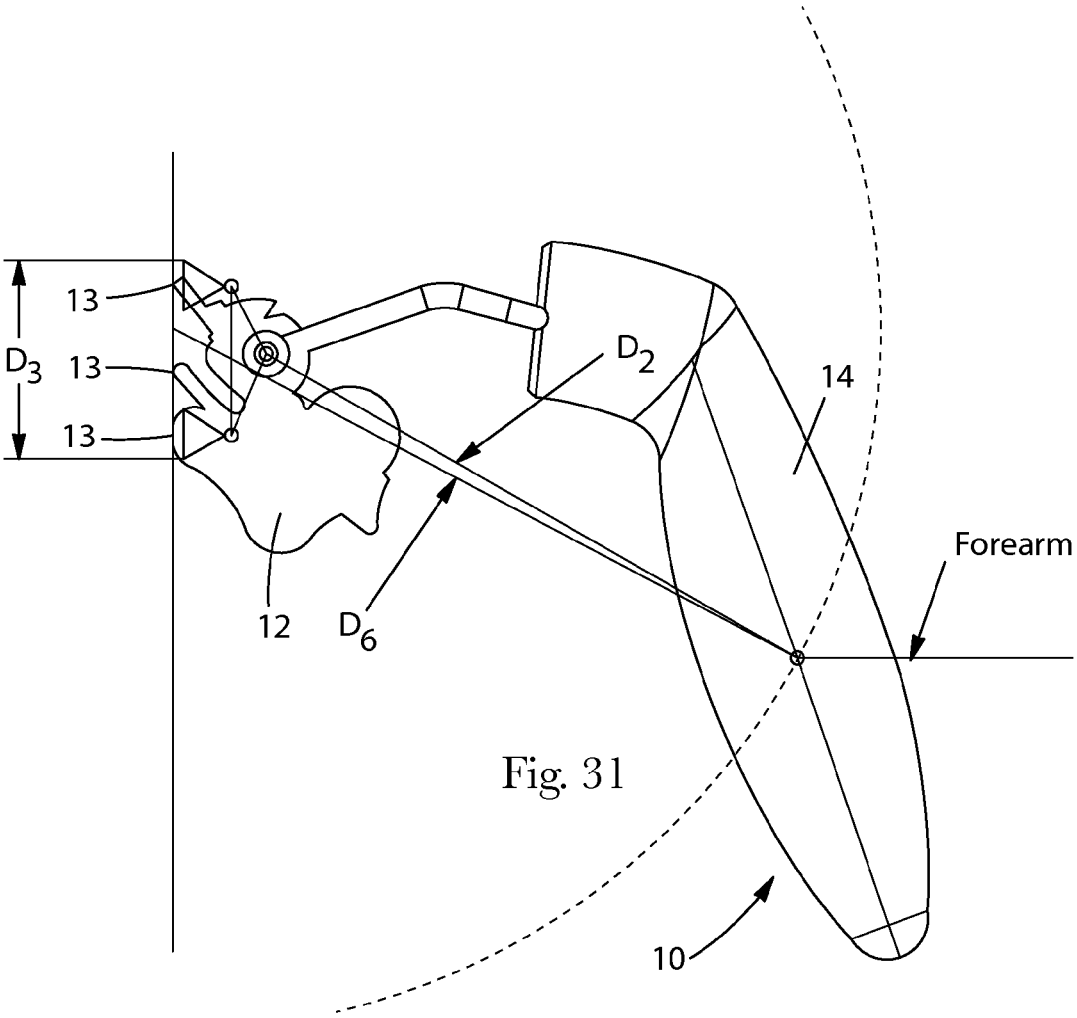
FIG. 31 is a side elevational view of a device of having the force applied to through the user's wrist being perpendicular to the target surface and showing the effective handle length and the distance from the effective midpoint of the handle to the point on the target surface midway between the two contact points of the device head.
Figure 31A:
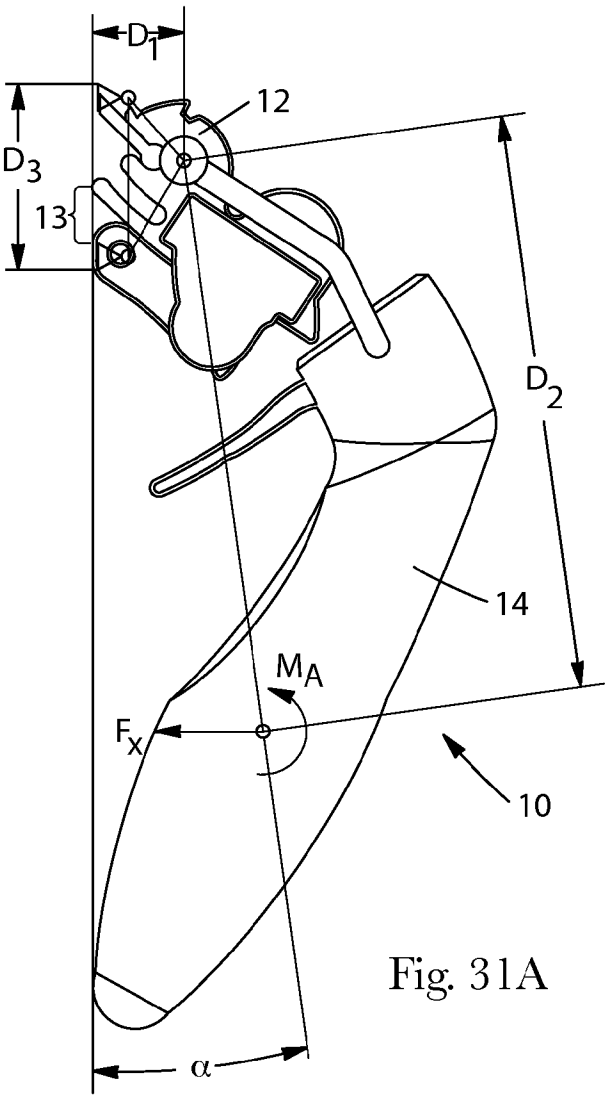
FIG. 31A is a side elevational view of the device of FIG. 31, showing the point where the moment is applied to the device by the user.
Figure 31B:
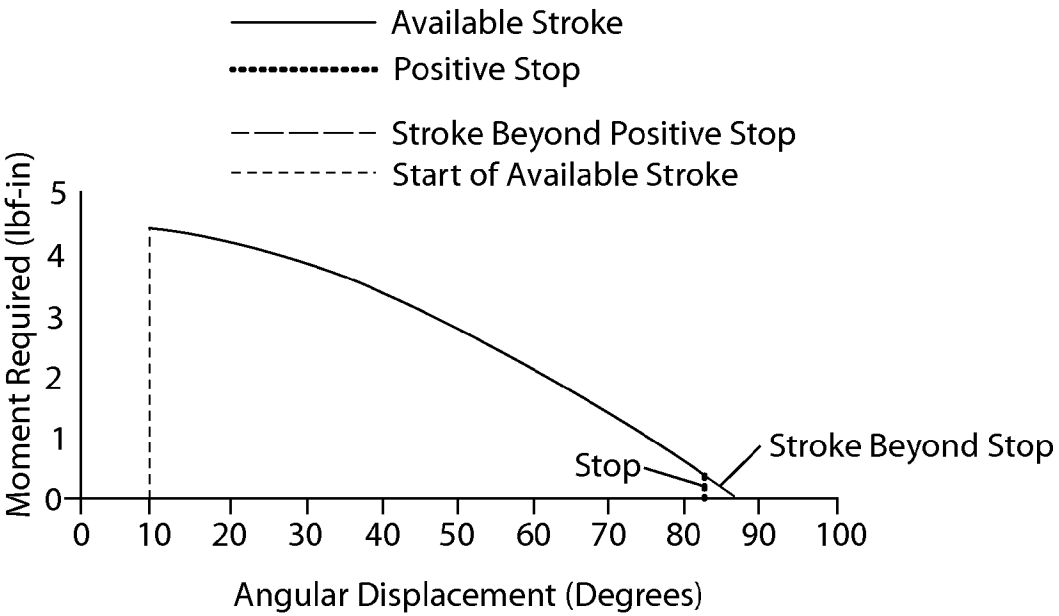
FIG. 31B is a graphical representation of the change in applied moment throughout the stroke of the device of FIG. 31A.
Figure 34:
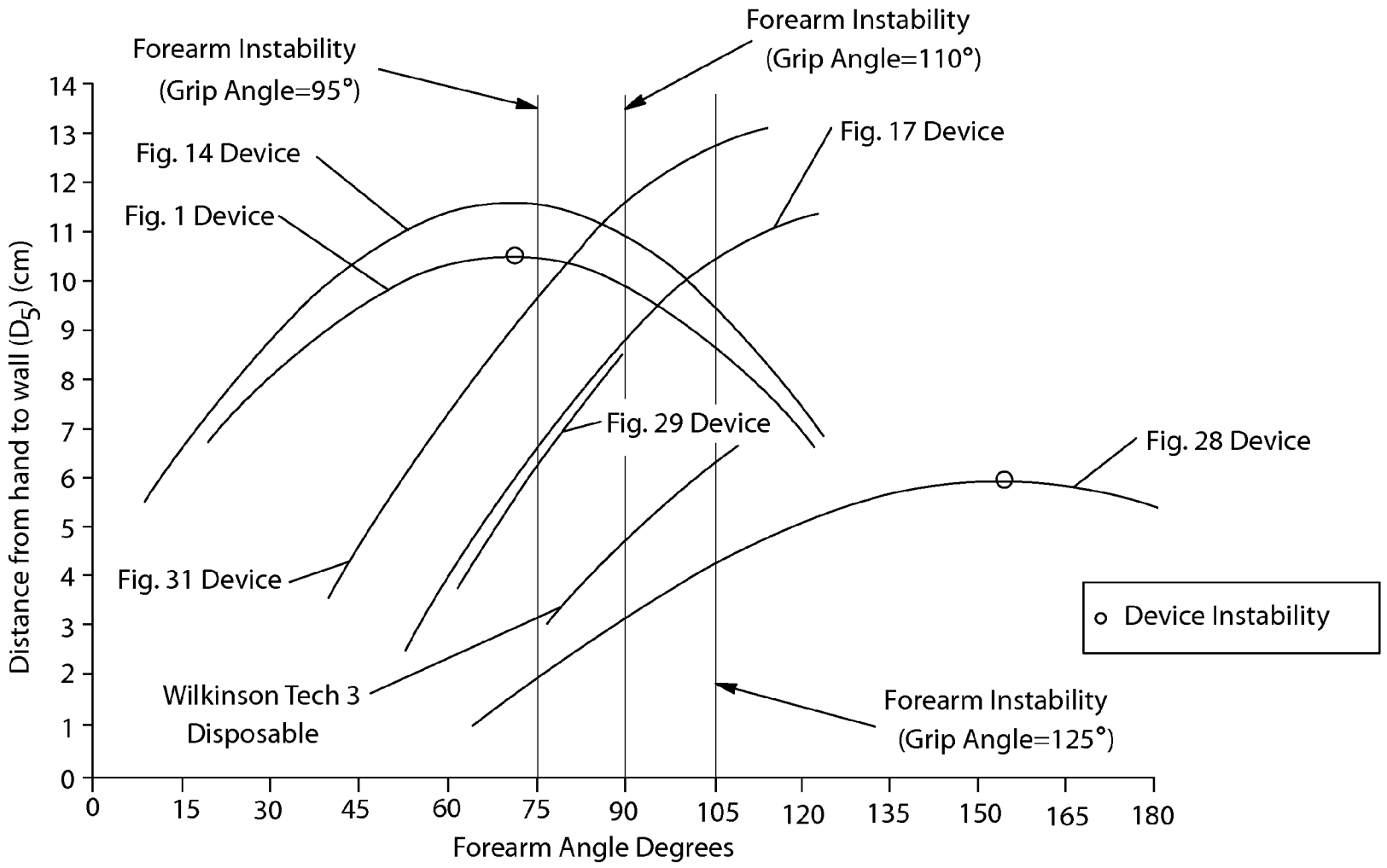
FIG. 34 is a graphical relationship of various devices showing the perpendicular distance from the target surface to the effective midpoint of the handle (D5) as a function of the angle of a user's forearm relative to the target surface (Forearm Angle).

FIG. 32 shows that a device according to FIG. 1 may advantageously and unpredictedly postpone occurrence of the forearm instability past the point of device instability. FIG. 34 also shows that a device according to FIG. 31 shows a monotincially increasing value of D5, and does not encounter forearm instability 30, 35, 40 or 45 degrees of device angle occurs.

Figure 33:
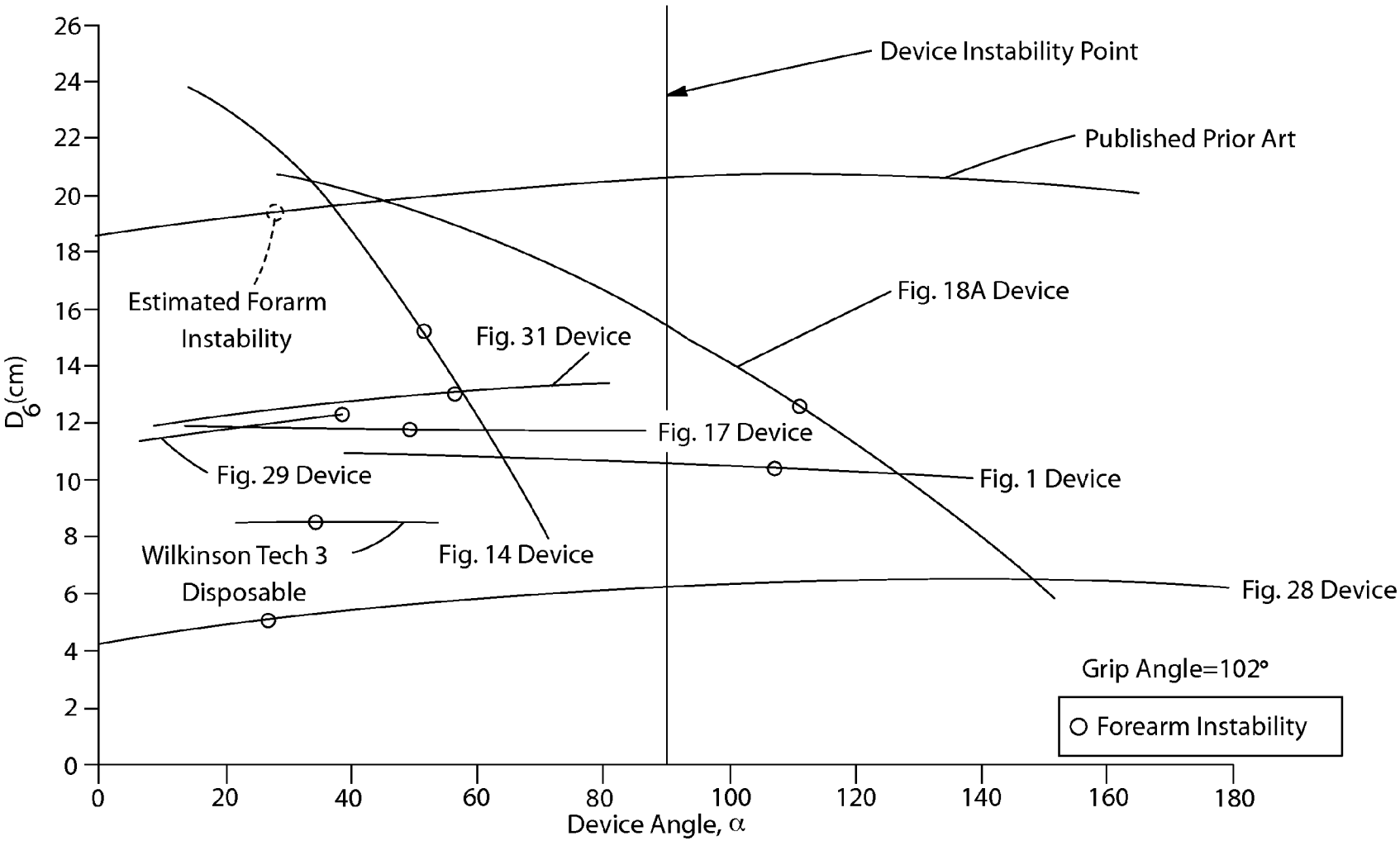
FIG. 33 is a graphical relationship of various devices showing the distance from the effective midpoint of the handle to the point on the target surface midway between the two contact points of the device head (D6) as a function of the angle of the handle relative to the target surface (Device Angle).

Referring to FIG. 33, the distance from the effective midpoint of the handle 12 to the point on the target surface midway between the two contact points of the device 10 head 14 (D6) is shown. Unexpectedly, FIG. 33 shows that for the device 10 of FIGS. 14-16, this distance monotonically decreases throughout the stroke. FIG. 33 also unexpectedly shows that for the device 10 of FIGS. 1-3, the point of forearm instability occurs after the point of device 10 instability. This device 10 is the only one which shows this qualitative difference in kind performance.

Referring to FIG. 34, and examining these devices 10 again with respect to the change in forearm angle, it is seen that some devices 10 show a monotonically increasing difference in the perpendicular distance from the target surface to the effective midpoint of the handle 12 (D5) during the stroke, some increase, then decrease before forearm instability occurs at 90 degrees, and one device 10 shows a slight decrease after the point of forearm instability occurs.

Figure 35:
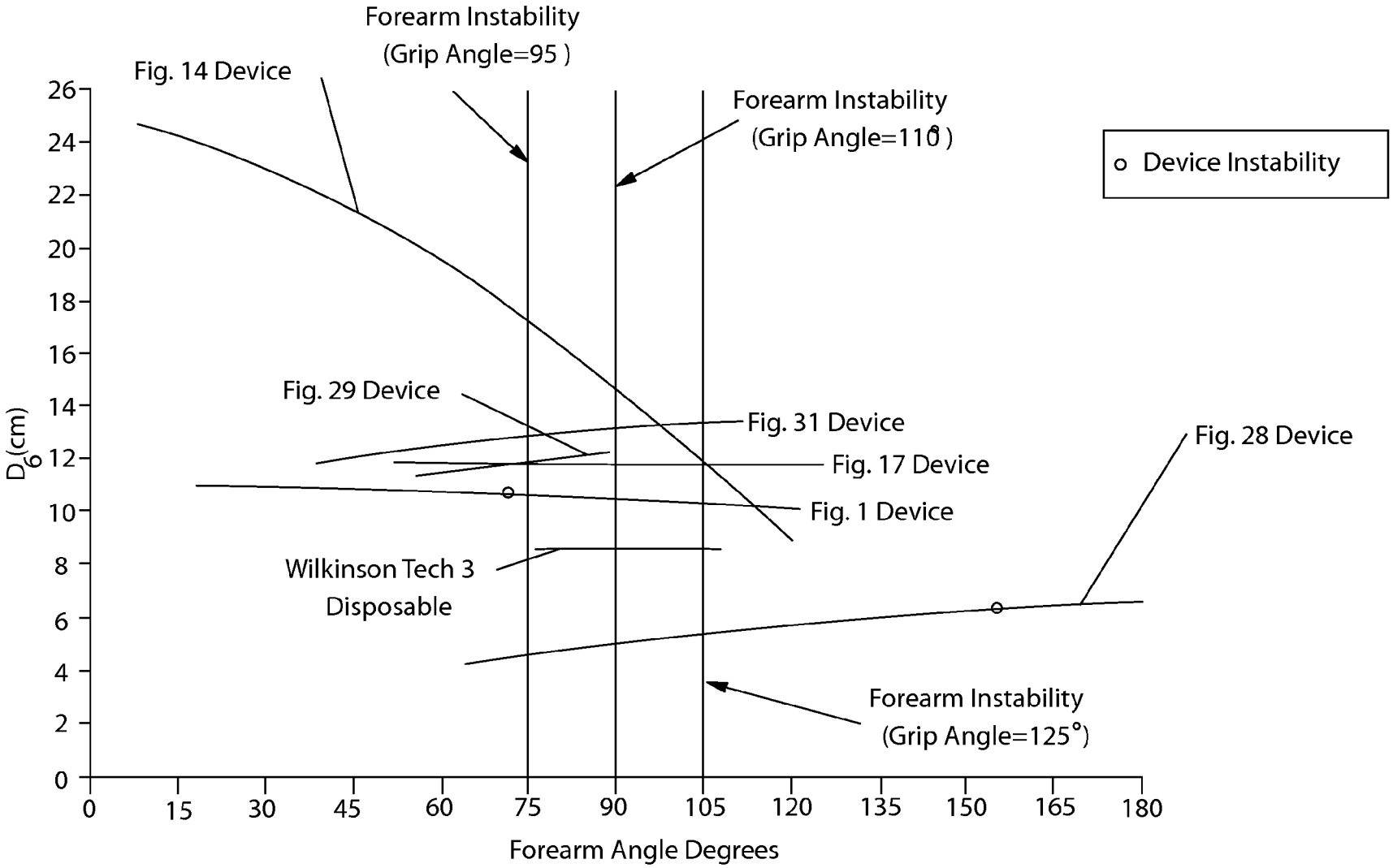
FIG. 35 is a graphical relationship of various devices showing the distance from the effective midpoint of the handle to the point on the target surface midway between the two contact points of the device head (D6) as a function of the angle of a user's forearm relative to the target surface (Forearm Angle).

Device instability is shown for two devices on FIGS. 34-35. Device instability does not occur for the remaining devices, as the device angle does not reach 90 degrees for those devices.

But referring to FIG. 35, and examining these devices 10 again with respect to the change in the distance between the effective midpoint of the handle 12 and the point on the target surface midway between the two contact points of the device 10 head 14 (D6) a clear pattern unexpectedly occurs. The device 10 of FIGS. 14-16 unexpectedly shows a monotonically decreasing value.

Referring jointly to FIGS. 33 and 35, it can be seen that the embodiment having the curvilinear, telescoping handle 12 is the only embodiment having an appreciable slope and further is the only embodiment having an appreciable negative slope. As noted above, the decreasing value of negative slope provides the benefit of improved control.

Figure 36:
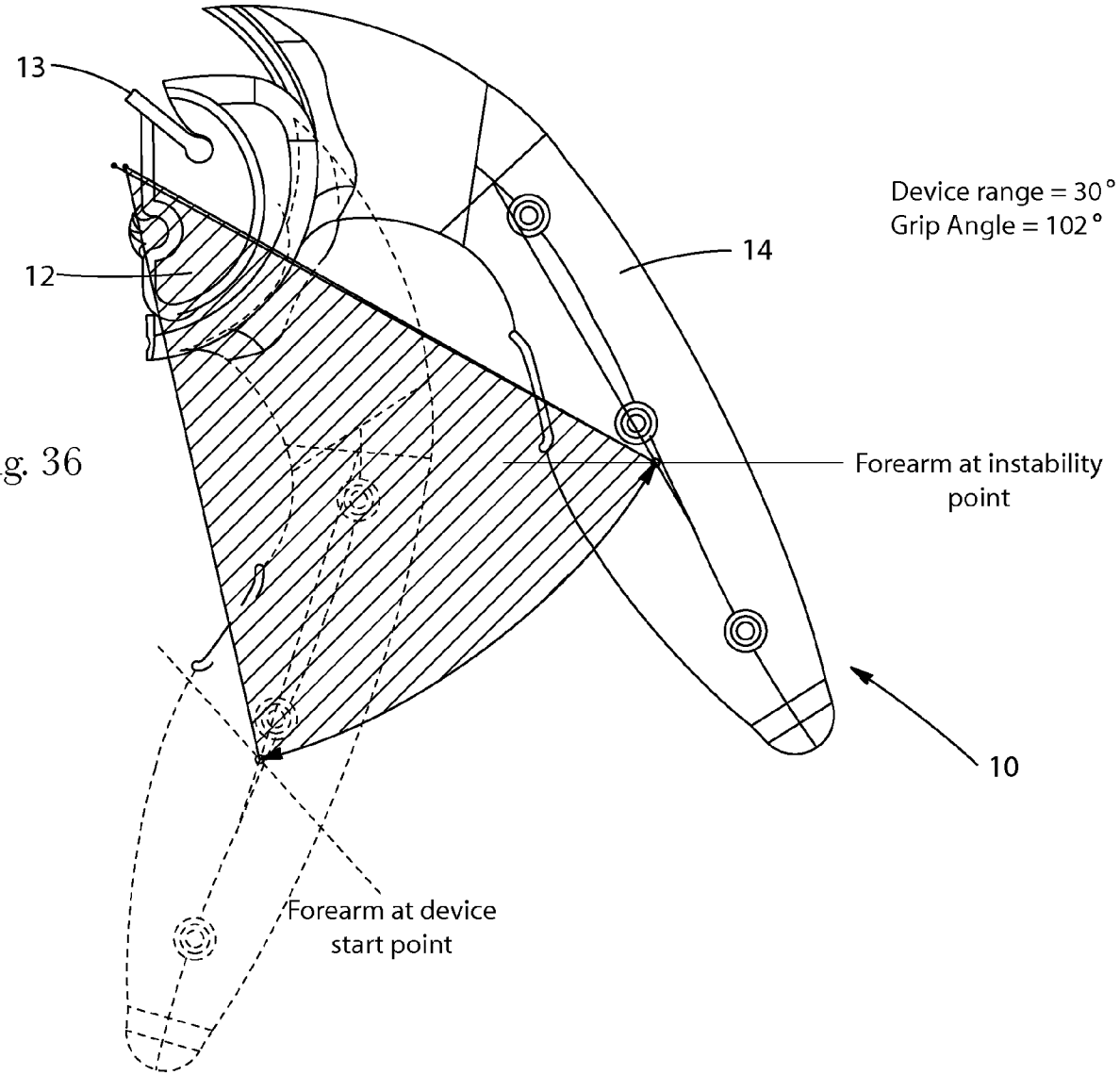
FIG. 36 is a side elevational view of the device of FIGS. 17, 24 and 25 according to the present invention having a roller and squeegee in the head and a convex track in the head showing the angle subtended from the start of the stroke until the point of forearm instability at perpendicularity.
Figure 37:
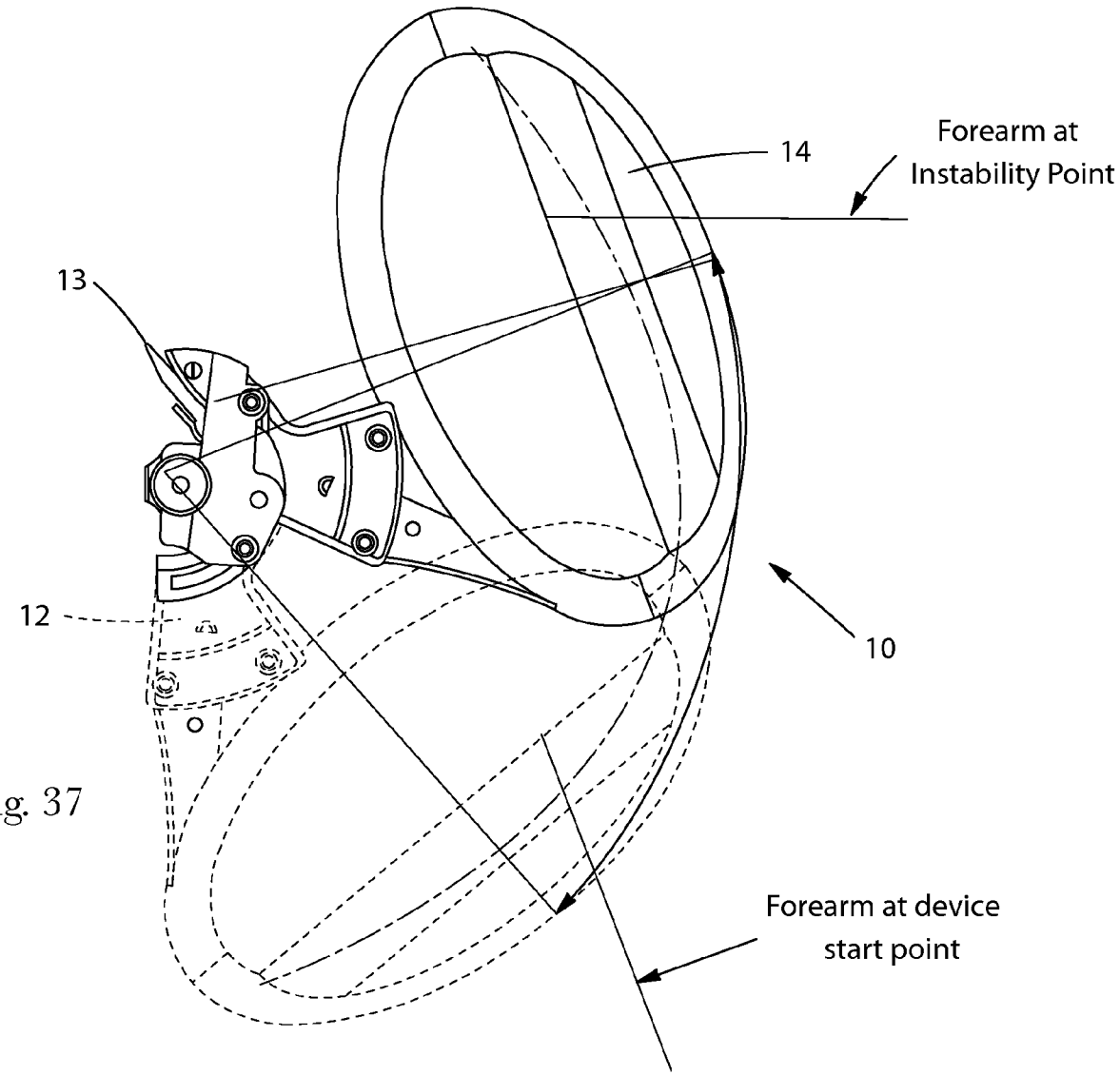
FIG. 37 is a side elevational view of the device of FIGS. 1-3 and 27 having a convex rack gear on the head and showing the angle subtended from the start of the stroke until the point of forearm instability at perpendicularity.

Referring to FIGS. 36-37, it can be seen that the devices 10 according to the present invention unpredictably sweep an angle ranging from 30 to 65 degrees before instability occurs. The relatively large angle provides the benefit that the user can pull the device 10 a greater distance on the target surface, before crossing the point of forearm perpendicularity. Improved performance results over a greater area of the contact surface 13.

Particularly, the device 10 of FIGS. 36-37 is swept through it range of motion, resulting in changes in both device 10 angle and forearm angle. When the device 10 angle crosses perpendicularity to the target surface, device 10 instability results. When the forearm angle crosses perpendicularity to the target surface, for a particular grip angle, forearm instability results. Either form of instability may cause chatter and/or uneven movement of the head 14 relative to the target surface, resulting in degraded performance.

Therefore it is desirable that, as the device 10 angle increases throughout the stroke, and approximates 90 degrees, that the forearm angle not prematurely encounter perpendicularity, and unduly limit or foreshorten the usable device 10 stroke and vice versa. Therefore, a device 10 which provides a greater range of device 10 angle, or forearm angle, prior to reaching forearm instability provides the benefit of increased stroke length, and therefore increased surface area treatment, without encountering degraded performance.

Figure 38:
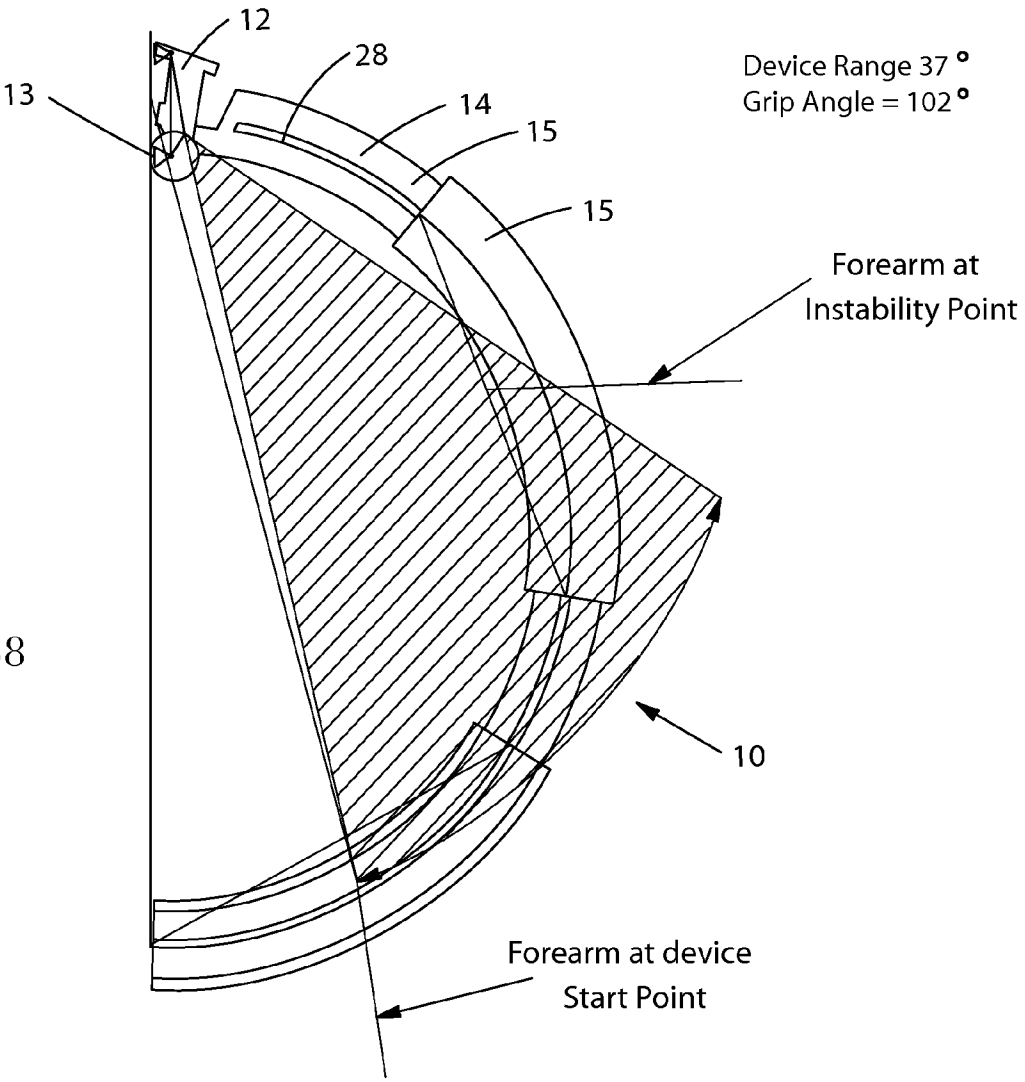
FIG. 38 is a side elevational view of the prior art device of FIGS. 14-16 and 30 having a telescoping, arcuate handle and showing the angle subtended from the start of the stroke until the point of forearm instability at perpendicularity.
Figure 39:
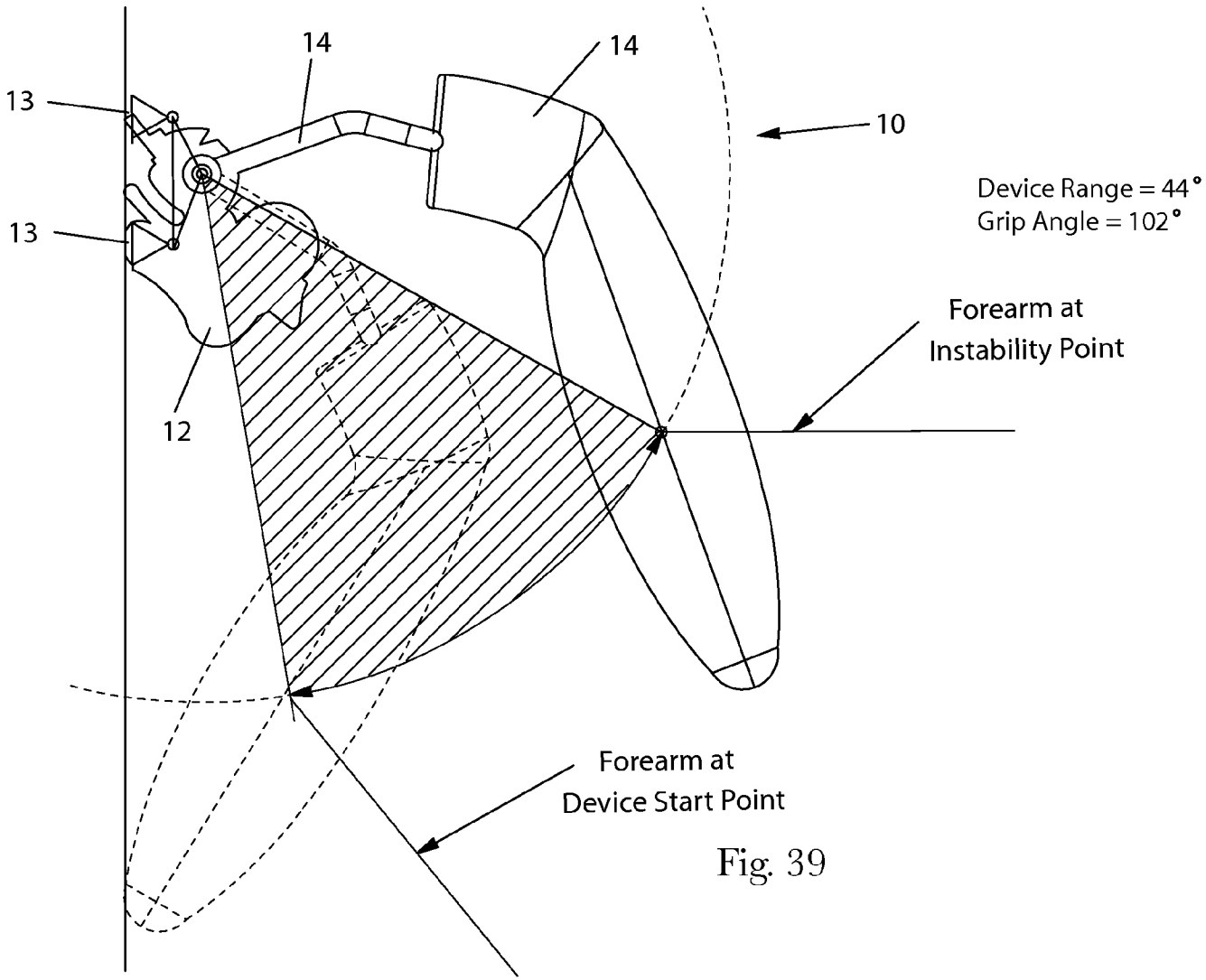
FIG. 39 is a side elevational view of the device of FIG. 31 and showing the angle subtended from the start of the stroke until the point of forearm instability at perpendicularity.

Referring to FIGS. 38-39, if desired, one may tune the performance to provide a swept angle of 37 to 44 degrees. Thus, one of skill will understand that by appropriate geometric adjustments to the device 10 described and claimed herein, a forearm angle of at least 30, 35, 40, 45, 50, 55, 60, 65 or 70 degrees, or less than any of these values, can be subtended without the forearm line crossing a perpendicularity to the target surface.

Figure 40:
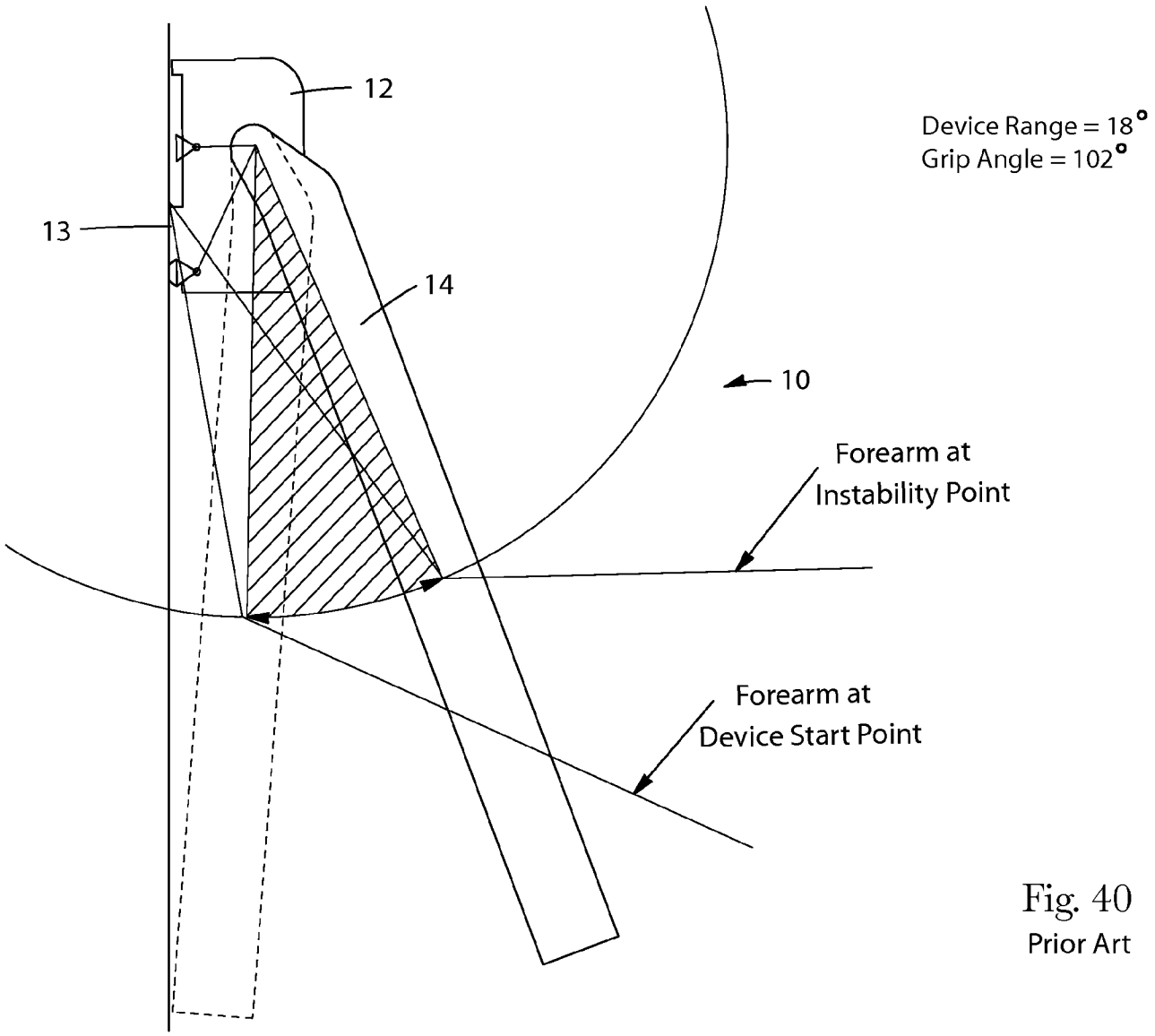
Fig. 40 Prior Art
FIG. 40 is a side elevational view of the device of FIG. 28 taken from the patent literature and showing the angle subtended from the start of the stroke until the point of forearm instability at perpendicularity.
Figure 41:
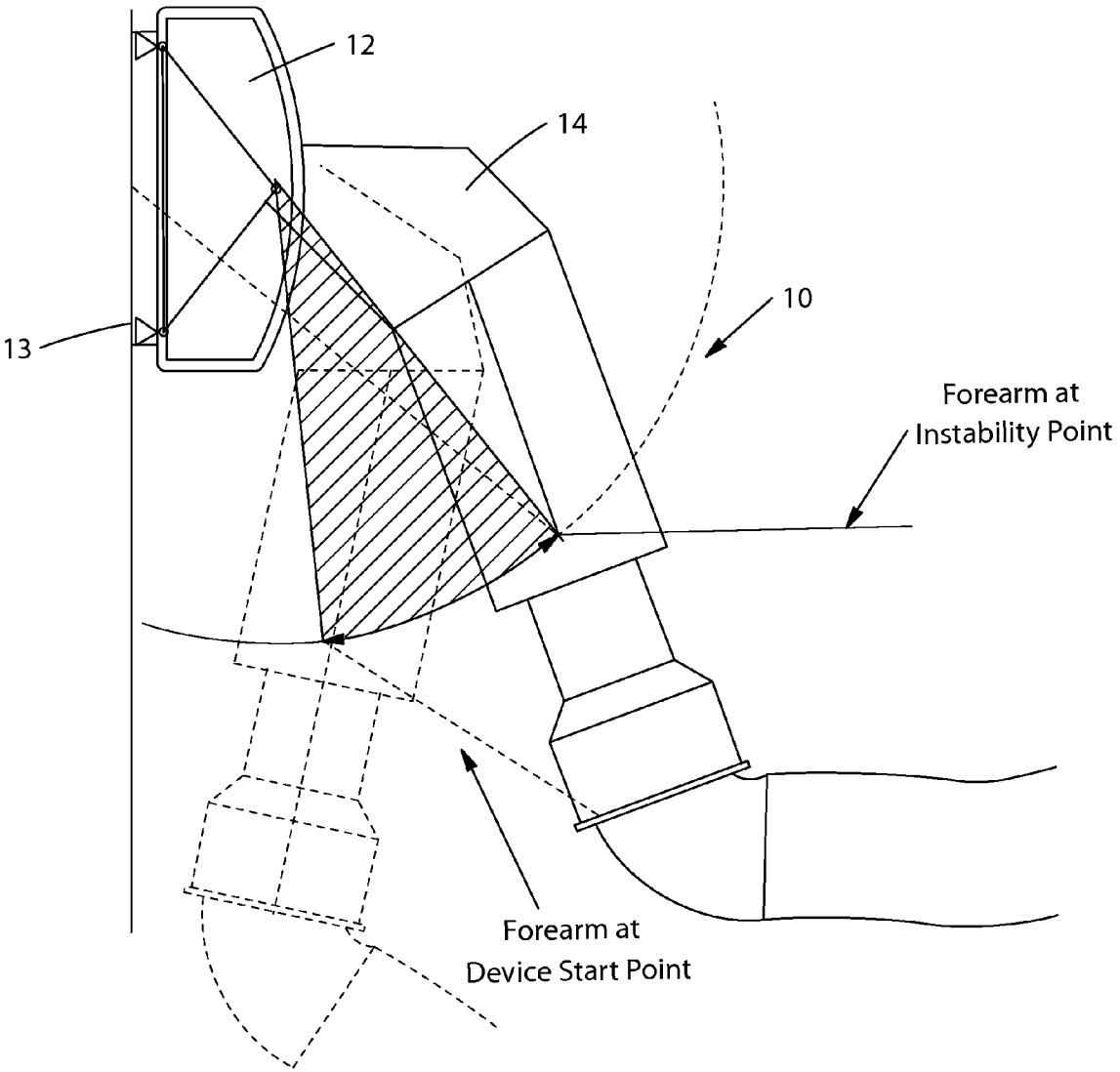
Fig. 41 Prior Art
FIG. 41 is a side elevational view of a commercially available prior art device of FIG. 29 taken from the patent literature and showing the angle subtended from the start of the stroke until the point of forearm instability at perpendicularity.

In contrast, referring to FIGS. 40-41, the prior art devices 10 only subtend an angle ranging from 18 to 25 degrees before forearm perpendicularity occurs. A shorter stroke occurs before the user encounters forearm instability and decreased performance.

Figure 42A:
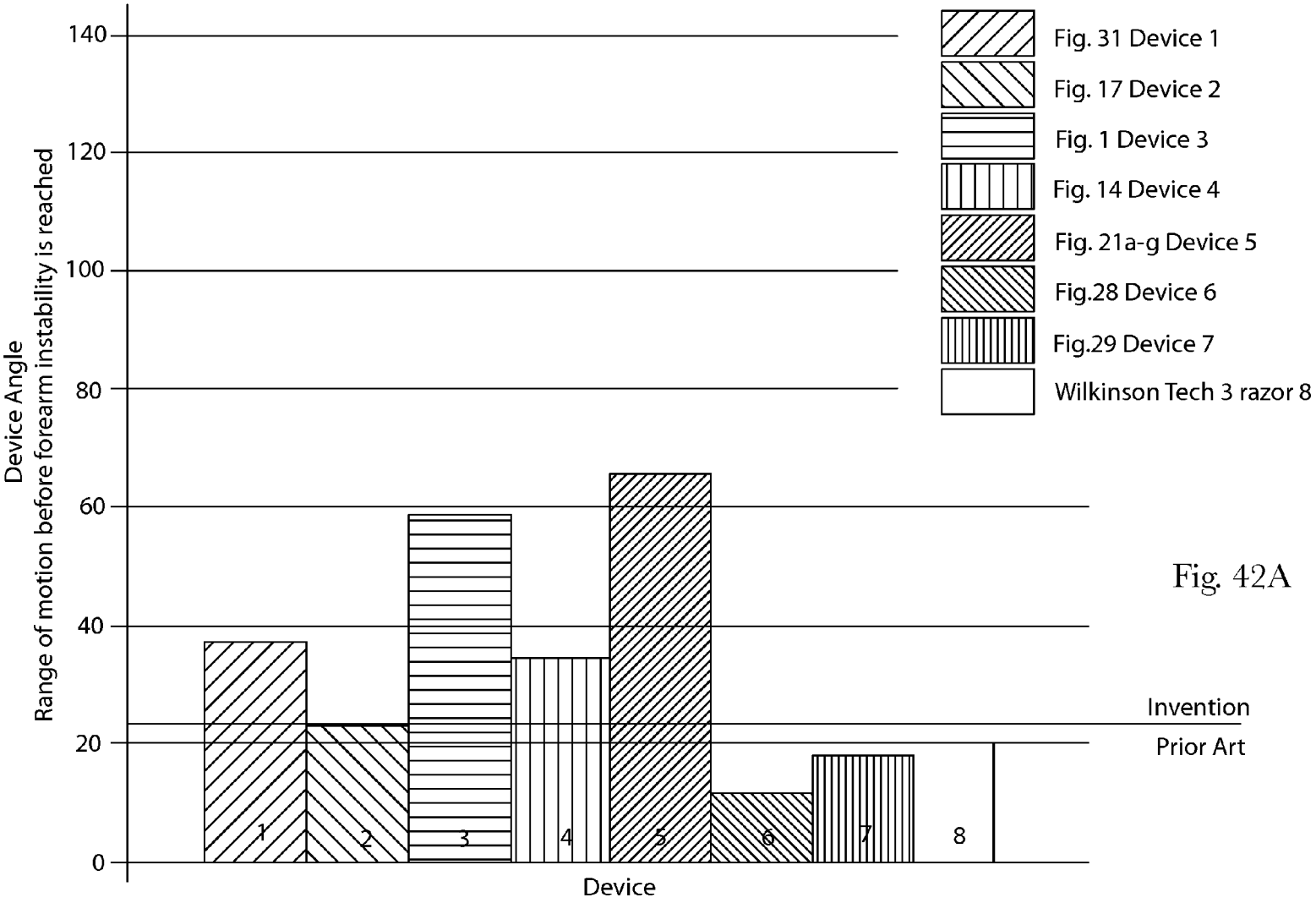
FIGS. 42A, 42B and 42C are bar graphs of the subtended device angles shown in FIGS. 36-41 for grip angles of 95, 102 and 109 degrees, respectively.
Figure 42B:
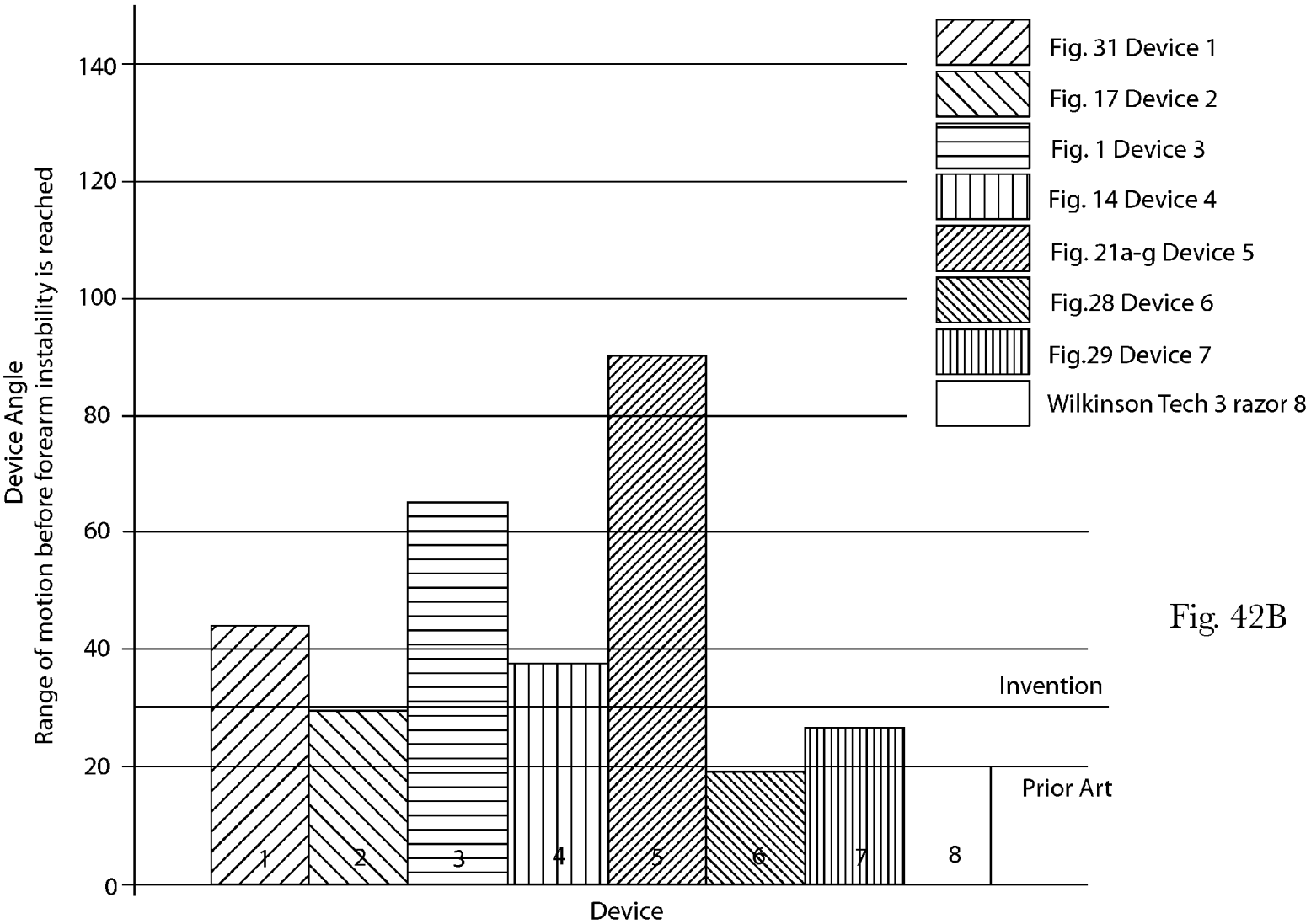
Figure 42C:
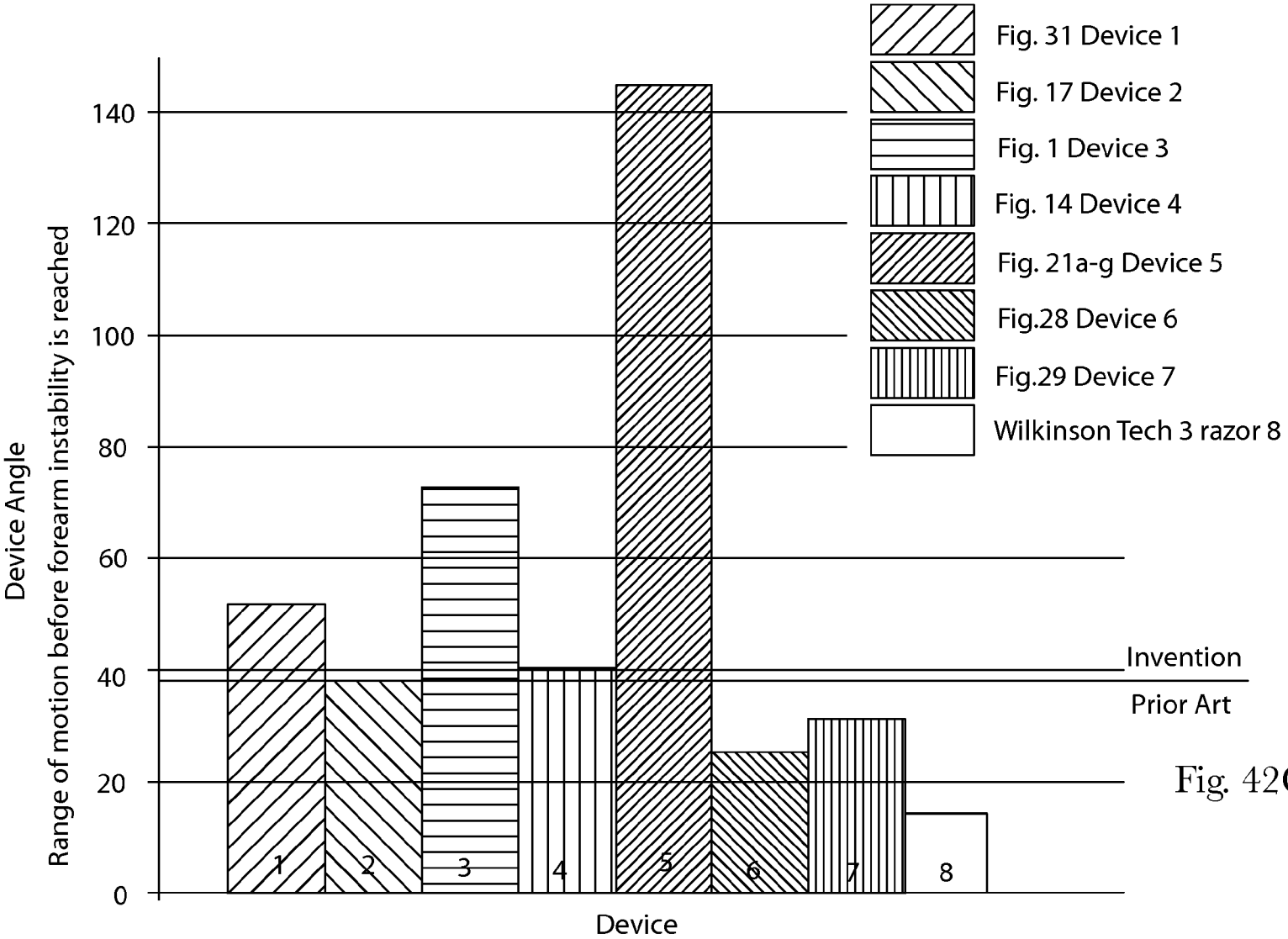

Referring to FIGS. 42A, 42B and 42C, it can be seen that even if variations in the grip angle are assumed, improved range of motion unpredictably occurs with the present invention. Likewise, improved performance unpredictably occurs, even over a variety of grip angles and usage conditions. Thus, a device 10 according to the present invention can accommodate relatively wide variations in user habits, without departure from the benefits of the claimed invention.

More particularly, for the entire range of grip angles specified in the aforementioned Department of Defense Handbook for Human Engineering Guidelines, a device 10 according to the present invention may exhibit an advantageous range of device 10 angles without encountering forearm instability. The results are shown in Table 1 below.

TABLE 1

Approximated Device 10 Angle Swept Before Forearm Instability Occurs (In Degrees)

Figure 14:
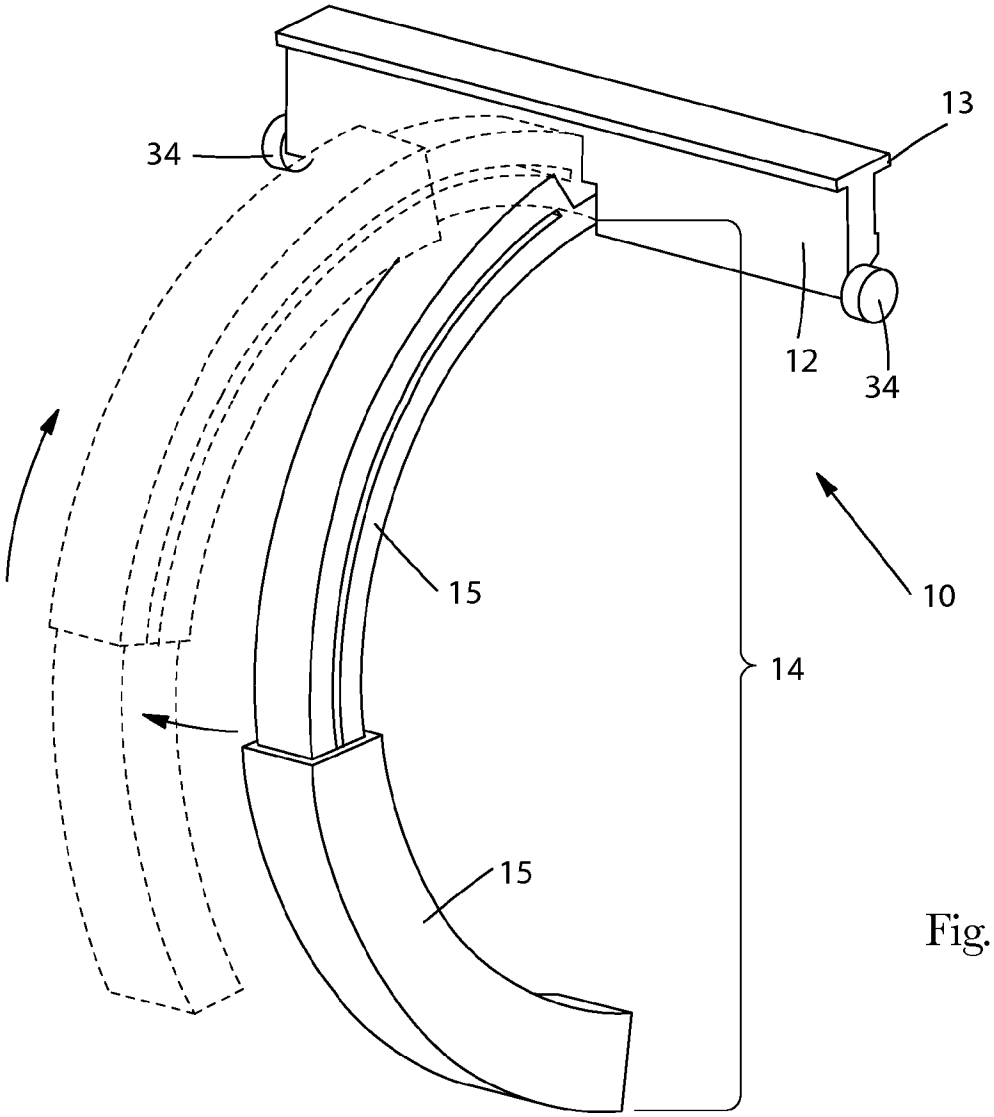
FIG. 14 is a rear perspective view of an alternative embodiment of a device according to the present invention having a curved fixed length handle, showing a first position of the handle in solid lines and a later, second position of the handle in dashed lines.
Figure 15:
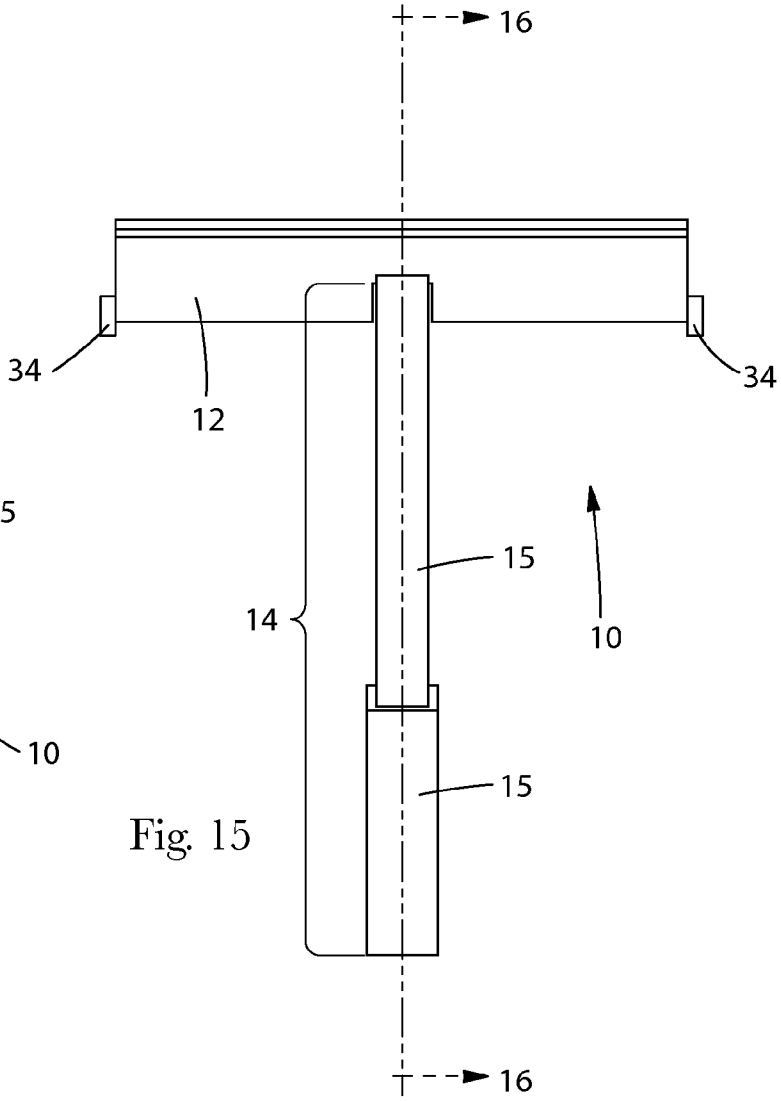
FIG. 15 is a rear elevational view of the device of FIG. 14 disposed against a target surface.

| | Device Figure No. | | | |
|---|---|---|---|---|
| Grip Angle | FIG. 14 Device | FIG. 31 Device | FIG. 1 Device | FIGS. 21A-G |
| 95 degrees | 33 | 37 | 58 | 64 |
| 102 degrees | 37 | 43 | 64 | 91 |
| 109 degrees | 41 | 51 | 72 | 146 |

Table 1 above shows the unpredicted and robust nature of the invention. For the entire range of grip angles specified in the aforementioned Department of Defense Handbook for Human Engineering Guidelines, improved and more useful device 10 angles result than occurs with the prior art.

Thus, a device 10 according to the present invention exhibits a range of motion which allows the device 10 angle to subtend more than 30, 35, 40, 50, 60, 70, 80, 90, 100, 120, 130 or 140 degrees before forearm instability is reached. The range of motion for the device 10 angle before forearm instability is reached may be less than 180, 170, 160 or 150 degrees.

Figure 43:
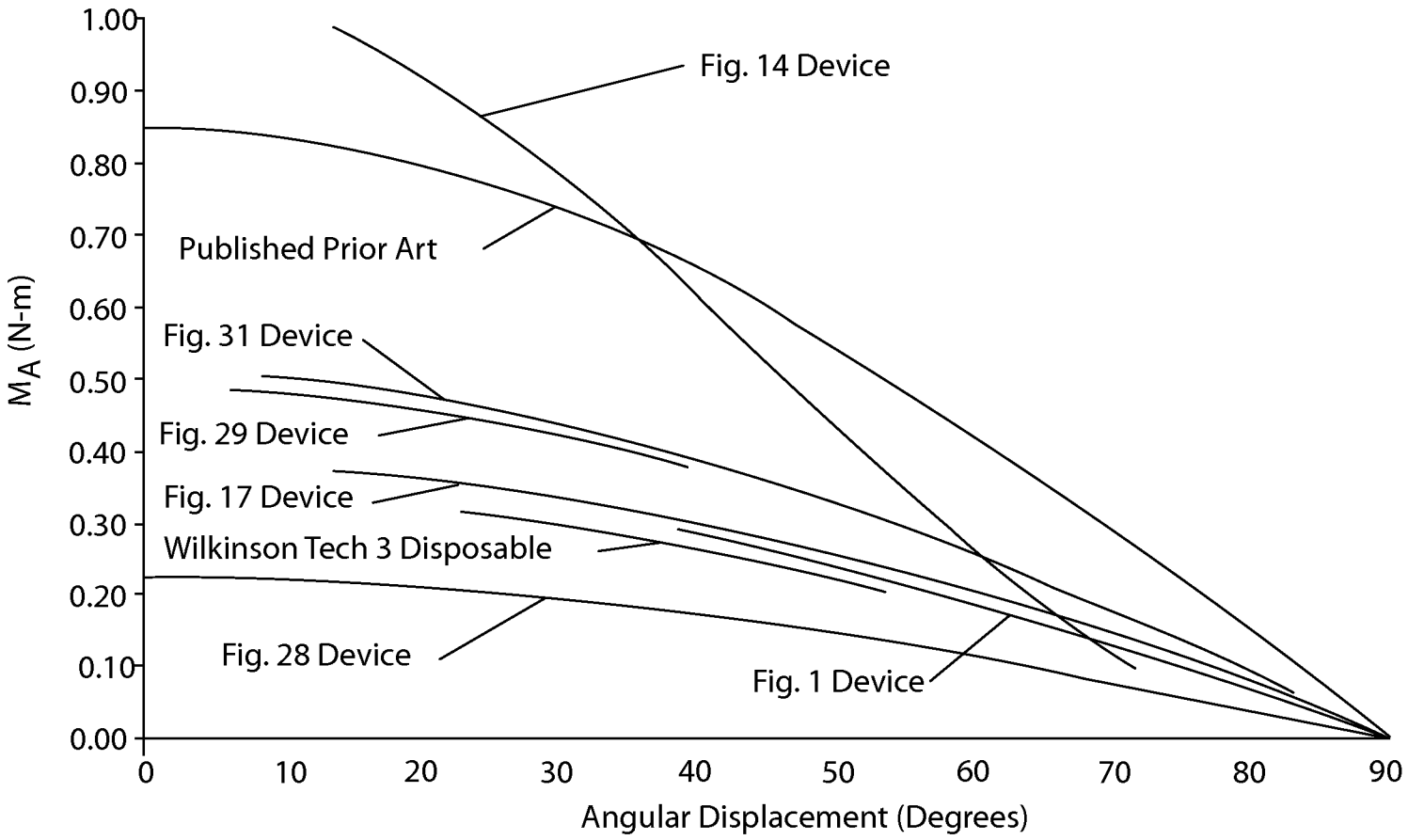
FIG. 43 is a graphical relationship of the applied moment at the effective midpoint of the handle for devices according to the prior art and according to the present invention, as a function the device angle.

Referring to FIG. 43, it can be seen that as the devices 10 considered therein advance through the usable stroke, the applied moment decreases, and vanishes at device 10 perpendicularity. It can be seen that not all of the devices 10 shown in FIG. 43 have a usable angle ranging from 0 to 90 degrees. Some of the devices 10 have mechanical stops, etc. limiting the angular relationship between the head 14 and handle 12.

As the stroke occurs, FIG. 43 shows the moment and effectively the length D6, both diminish. As this distance, and the moment diminish, the applicants believe that improved user control over the device 10 may result.

Figure 44:
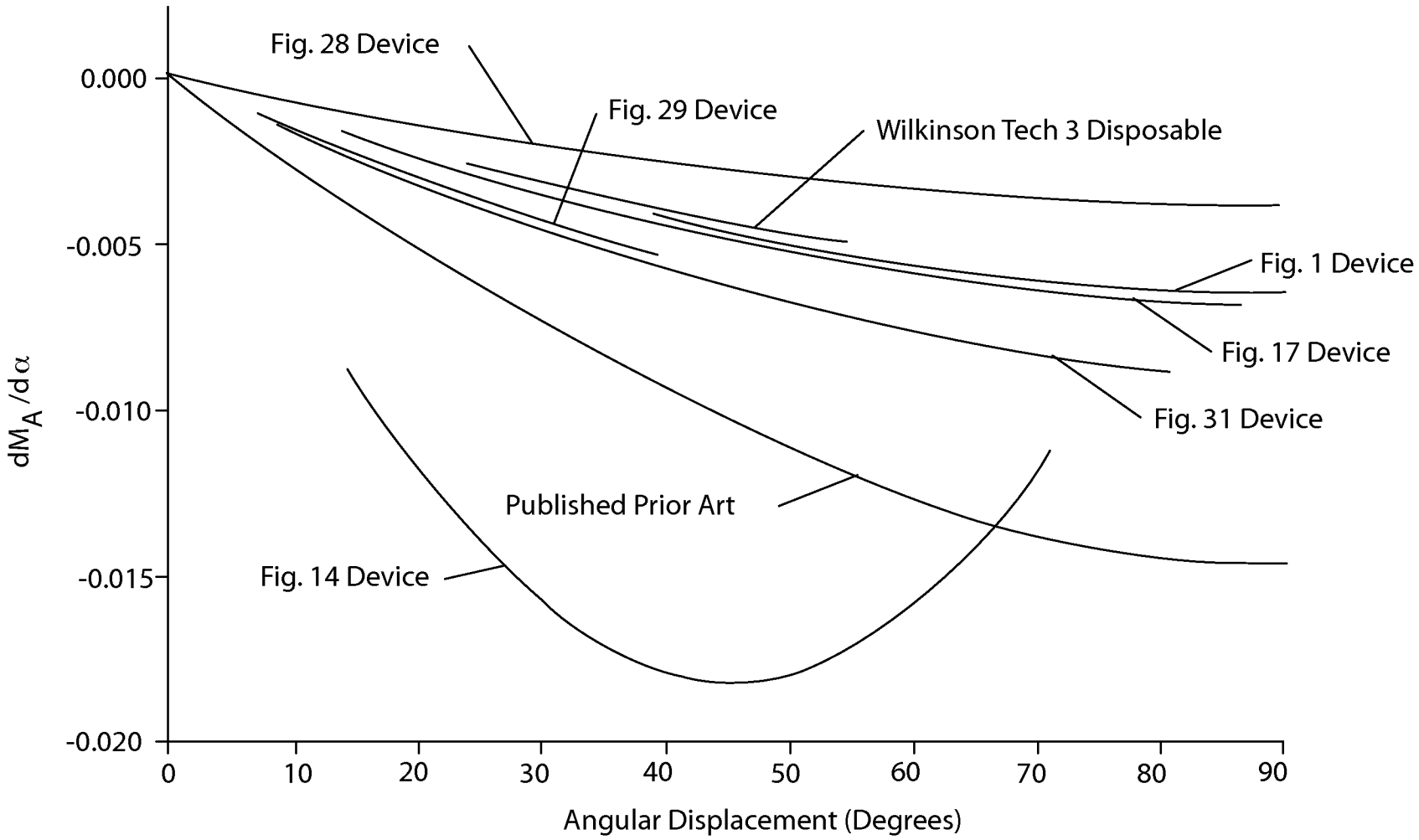
FIG. 44 shows the derivatives with respect to device angle of the curves shown on FIG. 43, illustrating the rate of change of the moment of the devices.

Referring to FIG. 44, as can be seen from the curves therein, a device 10 according to the present invention, and particularly a device 10 according to FIG. 14, shows a relatively steep slope in the decrease of length D6. The performance is believed to be advantageous, as improved control results sooner than with a device 10 having a more gradual slope.

A device 10 according to the present invention may have a negative slope. The slope may be at least −0.010, −0.011, −0.012, −0.013, −0.014, −0.015, −0.016, −0.017 or −0.018 Newton*Meters per degree of device 10 angle articulation but less than −0.20 Newton*Meters per degree of device 10 angle articulation. Importantly, a device 10 according to the present invention can maintain such a slope for a sweep of the device 10 angle encompassing at least 10, 15, 20, 25, 30, 35, 40, 45, or 50, degrees and less than 60 degrees.

Advantageously, it can be seen from the curves on FIG. 44, that a device 10 according to the present invention may advantageously encounter the aforementioned slope earlier in the stroke than a device according to the prior art. A device 10 according to the present invention may exhibit the aforementioned stroke starting at a device angle of 15, 20, 25, 30, 35, 40, 45, 50, 55, or 60 degrees and exhibit such slope for a range of 10, 15, 20, 25, 30, 35, 40, 45, 50, or 55 degrees, as set forth above and subject to the starting point.

The device of FIG. 14 exhibits a minimum slope (mathematically a negative maximum) slope throughout a device angle range from 30 to 60, 35 to 55, and particularly 40 to 50 degrees. The unpredicted earlier start to the aforementioned negative slope provides the benefit with the invention of FIG.

14 that the user more rapidly approaches a vanishing moment, and has improved control over the task.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for treating a target surface, such as cleaning a window, said device comprising:

a head for cleaning the target surface, said head having at least one widthwise and outwardly facing contact surface for contacting the target surface and treating a liquid thereon; and a handle articulably joined to said head and subtending a device angle of articulation, said head and said handle defining a positive moment therebetween in response to translation of said contact surface on said target surface, said moment remaining positive throughout articulation of said device angle up to a device angle of 90 to 135 degrees.

2. A device according to claim 1 wherein said moment changes from positive to negative at a device angle of 90 degrees with no friction between said device and said target surface in response to movement of said contact surface on said target surface.

3. A device according to claim 2 wherein said moment changes from positive to negative at a device angle of 90 degrees with no torsional force between said handle and said head.

4. A device according to claim 2 wherein handle and said head are joined by a convex or concave track having a complimentary slider therein.

5. A device according to claim 4 having a convex track disposed on said head and a slider complementarily and slidingly disposed in track, said slider being disposed on said handle.

6. A device according to claim 5 further comprising a rack and pinion gear juxtaposed with said track, wherein one of said rack and pinion is disposed on said head, the other of said rack and said pinion is joined to said handle, for relative motion therebetween.

7. A device for treating a target surface, such as cleaning a window, said device comprising:

a head for cleaning the target surface, said head having at least one widthwise and outwardly facing contact surface for contacting the target surface and treating a liquid thereon;

a handle articulably joined to said head and subtending a device angle of articulation therebetween; and a torsional spring having an applied moment greater than zero and less than 0.0034 N-m/degree, said spring biasing said handle and said head to a predetermined position, said head and said handle defining a positive moment therebetween in response to translation of said contact surface on said target surface, said moment remaining positive throughout articulation of said device angle from a device angle from 40 to 140 degrees.

8. A device according to claim 7 wherein said moment changes from positive to negative at a device angle of 90 degrees with no torsional force between said handle and said head.

9. A device according to claim 7 wherein said outwardly facing contact surfaces comprise a squeegee and a wiper parallel thereto.

10. A device according to claim 9 wherein said moment changes from positive to negative at a device angle of 90 to 119 degrees under a torsional spring force ranging from 0 to 0.0023 N-m.

11. A device according to claim 7 articulating from a device angle of 64 to 146 degrees without incurring forearm instability at a perpendicularity to said target surface.

12. A device according to claim 7 wherein handle and said head are joined by a convex or concave track having a complimentary slider therein.

* * * * *